US007876294B2

(12) United States Patent
Sasaki et al.

(10) Patent No.: US 7,876,294 B2
(45) Date of Patent: Jan. 25, 2011

(54) IMAGE DISPLAY AND ITS CONTROL METHOD

(75) Inventors: Isao Sasaki, Tokyo (JP); Koichi Iguchi, Tokyo (JP)

(73) Assignee: NEC Corporation (JP)

( * ) Notice: Subject to any disclaimer, the term of this patent is extended or adjusted under 35 U.S.C. 154(b) by 1158 days.

(21) Appl. No.: 10/506,371

(22) PCT Filed: Mar. 5, 2003

(86) PCT No.: PCT/JP03/02578

§ 371 (c)(1),
(2), (4) Date: Sep. 2, 2004

(87) PCT Pub. No.: WO03/075256

PCT Pub. Date: Sep. 12, 2003

(65) Prior Publication Data

US 2005/0206590 A1 Sep. 22, 2005

(30) Foreign Application Priority Data

Mar. 5, 2002 (JP) ..... 2002-059553
Mar. 14, 2002 (JP) ..... 2002-070730

(51) Int. Cl.
*G09G 3/30* (2006.01)

(52) U.S. Cl. ..... 345/77; 345/690

(58) Field of Classification Search ..... 345/76–83
See application file for complete search history.

(56) References Cited

U.S. PATENT DOCUMENTS 5,714,968 A * 2/1998 Ikeda ..... 345/77
5,903,246 A * 5/1999 Dingwall ..... 345/82
2001/0007447 A1 * 7/2001 Tanaka et al. ..... 345/87

FOREIGN PATENT DOCUMENTS

JP 2001-147659 5/2001
JP 2001-318627 11/2001

* cited by examiner

*Primary Examiner*—Amr Awad
*Assistant Examiner*—Michael Pervan
(74) *Attorney, Agent, or Firm*—Hayes Soloway P.C.

(57) ABSTRACT

An image display apparatus comprises a pixel having a drive transistor and a pixel display element which are connected in series between a first power line and a second power line, a holding capacitor connected to a gate electrode of the drive transistor, and a selection transistor connected between a signal line and the gate electrode of the drive transistor. When the selection transistor is turned on, gradation pixel data is written in the holding capacitor from the signal line. The charge of gradation pixel data written in the holding capacitor is discharged for a certain period through the drive transistor, thereafter the charge of the gradation pixel data stored in the holding capacitor is held by floating the gate electrode of the drive transistor.

23 Claims, 39 Drawing Sheets

IMAGE DISPLAY AND ITS CONTROL METHOD

TECHNICAL FIELD

The present invention relates to an image display apparatus and a control method for use with such an image display apparatus, and more particularly to an image display apparatus using pixel display elements that are current-driven based on gradation pixel data, such as an organic EL (electroluminescence) display, for example, a control method for use with such an image display apparatus, a drive circuit for causing current control elements such as organic EL elements to emit light in such an image display apparatus, and a drive method for the drive circuit.

BACKGROUND ART

Image display apparatus using pixel display elements that are driven under current control, such as organic EL displays or the like, have drive circuits associated with respective pixels of driving those pixel display elements, i.e., current control elements. The drive circuits are arrayed two-dimensionally in association with the respective pixels, making up the image display apparatus. In each of the drive circuits, gradation pixel data is written from a signal line through a selection transistor into a holding capacitor which is connected between the gate and source of a drive transistor. The pixel data is held in the holding capacitor during a display period. A signal charge corresponding to the display luminance of the pixel is written in the holding capacitor, and a current depending on the signal charge is supplied from the drive transistor to the pixel display element.

Heretofore, an image display apparatus of the type described above comprises, as shown in FIG. 1, display panel 10, control circuit 20, signal line driver 30, and scanning line driver 40. Display panel 10 comprises an organic EL display, for example, and has a plurality of signal lines $X_1, \ldots, X_i, \ldots, X_n$ to which gradation pixel data D are applied, a plurality of scanning line $Y_1, \ldots, Y_j, \ldots, Y_m$ to which scanning signals V are applied, and a plurality of pixels $\mathbf{10}_{ij}$ (i=1, 2, . . . , n, j=1, 2, . . . , m) disposed at points of intersection between signal lines $X_1, \ldots, X_i, \ldots X_n$ and scanning line $Y_1, \ldots, Y_j, \ldots, Y_m$. Of pixels $\mathbf{10}_{ij}$, those pixels on scanning lines that are selected by scanning signals V are supplied with gradation pixel data D to display an image.

Control circuit 20 supplies image input signal VD supplied from an external source to signal line driver 30 and also supplies vertical scanning signal PV to scanning line driver 40. Signal line driver 30 applies gradation pixel data D depending on image input signal VD to signal lines $X_1, \ldots, X_i, \ldots X_n$. Scanning line driver 40 successively generates scanning signals V in synchronism with vertical scanning signal PV supplied from control circuit 2, and applies scanning signals V successively to corresponding scanning line $Y_1, \ldots, Y_j, \ldots, Y_m$ of display panel 10.

FIG. 2 is a circuit diagram showing an electric arrangement of pixel $\mathbf{10}_{i,j}$ (e.g., i=3, j=2) in FIG. 1.

Pixel $\mathbf{10}_{3,2}$ comprises power line 11, ground line 12, selection transistor $\mathbf{13}_{3,2}$ in the form of an n-channel MOS field-effect transistor (FET) (hereinafter referred to as "nMOS"), holding capacitor $\mathbf{14}_{3,2}$, drive transistor $\mathbf{15}_{3,2}$ in the form of a p-channel MOSFET (hereinafter referred to as "pMOS"), pixel display element $\mathbf{16}_{3,2}$ as a current control element, and parasitic capacitor $\mathbf{17}_{3,2}$. Other pixel $\mathbf{10}_{i,j}$, such as pixels $\mathbf{10}_{4,2}$, $\mathbf{10}_{5,2}$ (not shown), that are positioned adjacent to pixel $\mathbf{10}_{3,2}$ are of the same structure. Selection transistor $\mathbf{13}_{3,2}$, holding capacitor $\mathbf{14}_{3,2}$, drive transistor $\mathbf{15}_{3,2}$, pixel display element $\mathbf{16}_{3,2}$, and parasitic capacitor $\mathbf{17}_{3,2}$ make up a drive circuit. The pixel display element should preferably comprise an organic EL element, for example.

Selection transistor $\mathbf{13}_{3,2}$ has a gate electrode connected to a selection line (not shown), a drain electrode to signal line $X_3$, and a source electrode to the gate electrode of drive transistor $\mathbf{15}_{3,2}$. Holding capacitor $\mathbf{14}_{3,2}$ is connected between the gate electrode of drive transistor $\mathbf{15}_{3,2}$ and power line 11. Drive transistor $\mathbf{15}_{3,2}$ has its gate electrode connected to the source electrode of selection transistor $\mathbf{13}_{3,2}$ and one end of holding capacitor $\mathbf{14}_{3,2}$, a source electrode connected to power line 11, and a drain electrode to the anode of pixel display element $\mathbf{16}_{3,2}$. Pixel display element $\mathbf{16}_{3,2}$ is connected between the drain electrode of drive transistor $\mathbf{15}_{3,2}$ and ground line 12, and emits light at a luminance depending on current $IL_{3,2}$ from drive transistor $\mathbf{15}_{3,2}$. Parasitic capacitor $\mathbf{17}_{3,2}$ comprises a parasitic capacitor across pixel display element $\mathbf{16}_{3,2}$.

In pixel $\mathbf{10}_{3,2}$, during a selection period, i.e., when scanning signal V is applied to scanning line $Y_2$, selection transistor $\mathbf{13}_{3,2}$ is turned on, applying gradation pixel data D applied to signal line $X_3$ between the gate and source of drive transistor $\mathbf{15}_{3,2}$. At this time, holding capacitor $\mathbf{14}_{3,2}$ is charged. Then, when the selection period changes to a non-selection period, selection transistor $\mathbf{13}_{3,2}$ is turned off. Since the gate-to-source voltage VGS of drive transistor $\mathbf{15}_{3,2}$ is held by holding capacitor $\mathbf{14}_{3,2}$, current $IL_{3,2}$ depending on written gradation pixel data D remains to be continuously supplied from drive transistor $\mathbf{15}_{3,2}$ to pixel display element $\mathbf{16}_{3,2}$ during the non-selection period. Pixel $\mathbf{10}_{4,2}$, $\mathbf{10}_{5,2}$ and the like that are positioned adjacent to pixel $\mathbf{10}_{3,2}$ operate in the same manner.

The above conventional image display apparatus has suffered the following problems:

As shown in FIG. 3, drive transistor $\mathbf{15}_{3,2}$ of pixel $\mathbf{10}_{3,2}$, drive transistor $\mathbf{15}_{4,2}$ of pixel $\mathbf{10}_{4,2}$, and drive transistor $\mathbf{15}_{5,2}$ of pixel $\mathbf{10}_{5,2}$ have their respective VGS-IDS (gate-to-source voltage vs. drain-to-source current) characteristics that vary from pMOS to pMOS. In particular, their threshold values widely vary from each other such that even when identical gradation pixel data D are applied between the gates and sources of drive transistors $\mathbf{15}_{3,2}$, $\mathbf{15}_{4,2}$, $\mathbf{15}_{5,2}$, they have different drain-to-source currents IDS $IL_{3,2}$, $IL_{4,2}$, $IL_{5,2}$. Therefore, since different current flow respectively through pixel display element $\mathbf{16}_{3,2}$ of pixel $\mathbf{10}_{3,2}$, pixel display element $\mathbf{16}_{4,2}$ of pixel $\mathbf{10}_{4,2}$, and pixel display element $\mathbf{16}_{5,2}$ of pixel $\mathbf{10}_{5,2}$, pixel display elements $\mathbf{16}_{3,2}$, $\mathbf{16}_{4,2}$, $\mathbf{16}_{5,2}$ emit light at different luminances. During the non-selection period, since the gate-to-source voltages VGS of those drive transistors are held by the corresponding holding capacitors, even though gradation pixel data D are identical, different currents based on the variations of the drive transistors are caused to continuously flow to the current control elements by the drive circuits.

As described above, the conventional image display apparatus is problematic in that even when identical gradation pixel data, i.e., signal voltages, are written, the current control elements emit light at different luminances, lowering the quality of the displayed image.

R. Dawson, et al. have proposed a drive circuit, to be described below, for preventing drive current variations from occurring due to threshold value variations of drive transistors (R. Dawson, et al., "A Poly-Si Active-Matrix OLED Display with Integrated Drivers," SID' 99 DIGEST, pp. 11-14).

FIG. 4 shows an arrangement of a drive circuit for a current control element proposed by R. Dawson, et al. As shown in FIG. 4, the drive circuit for the current control element comprises selection transistor 24A, holding capacitor 25, drive transistor 26, current control element 27, parasitic capacitor 28, decoupling capacitor 29, and switching transistors 31, 32, which are connected between power line 21, ground line 22, and signal line 23.

Selection transistor 14A comprises a pMOS and has a gate electrode connected to a selection line (not shown), a source electrode to signal line 23, and a drain electrode to one end of decoupling capacitor 29. Holding capacitor 25 is connected between the gate electrode of drive transistor 26 and power line 21. Drive transistor 26 comprises pMOS and has its gate electrode connected to the other end of decoupling capacitor 29 and one end of holding capacitor 15, a source electrode to power line 11, and a drain electrode to the source electrode of switching transistor 32.

Current control element 27 is connected between the drain electrode of switching transistor 32 and ground line 22, and emits light at a luminance depending on a current from drive transistor 26. Parasitic capacitor 28 comprises a parasitic capacitor across current control element 27. Decoupling capacitor 29 is connected between the drain electrode of selection transistor 24A and the gate electrode of drive transistor 26, and isolates selection transistor 24A and drive transistor 26 from each other in terms of direct currents. Switching transistor 31 comprises pMOS and has a gate electrode connected to a resetting line (not shown), a source electrode to the gate electrode of drive transistor 26, and a drain electrode to the drain electrode of drive transistor 26. Switching transistor 32 comprises pMOS and has a gate electrode connected to the resetting line, a source electrode to the drain electrode of drive transistor 26, and a drain electrode to one end of current control element 27.

FIG. 5 is a timing chart illustrative of the manner in which the drive circuit of the conventional current control element shown in FIG. 4 operates. Operation of the drive circuit of the conventional current control element shown in FIG. 4 will be described below.

Before a selection period starts, the drive circuit shown in FIG. 4 is required to discharge parasitic capacitor 28 of current control element 27 to set drain voltage VD of drive transistor 26 to the ground line potential. The voltage of signal line 23 is set to voltage VDD of power line 21.

When the selection period starts, a row selection signal is given to the selection line to turn on selection transistor 24A, and a resetting signal is given from a resetting driver (not shown) to the resetting line to turn on switching transistor 31 and turn off switching transistor 32. The gate and drain electrodes of drive transistor 26 are electrically connected to each other, starting to discharge holding capacitor 25. When a sufficient time elapses, gate voltage VG of drive transistor 26 drops to threshold value VT. Thereafter, switching transistor 31 is turned off, floating the gate electrode of drive transistor 26.

Then, when the input voltage from signal line 23 switches from voltage VDD of power line 21 to write voltage VDATA, gate-to-drain voltage VGS of drive transistor 26 is determined by a capacitance division between capacitance value CD of decoupling capacitor 29 and capacitance value CS of holding capacitor 25, according to the following equation:

$$VGS = VG - VDD \tag{1}$$

$$= VT + CD \cdot (VDATA - VDD) / (CS + CD)$$

However, the drain-to-source current of a transistor is generally expressed by a function of (VGS−VT). Since (VGS−VT) is determined by VCATA as can be seen from the above equation, a variation of the threshold value of drive transistor 26 is corrected.

The circuit shown in FIG. 4 requires four transistor for one pixel and also requires a decoupling capacitor in addition to a holding capacitor. Therefore, the aperture of the pixel is reduced, resulting in manufacturing process difficulty. If the value of decoupling capacitance CD is small, then write voltage VDATA needs to be increased, and it is desirable to achieve the relationship. CD>CS. To meet such a demand, a chip area for forming decoupling capacitance CD is increased. Another shortcoming is that it takes time to discharge the parasitic capacitor of the current control element prior to the selection period, and it needs a complex operation to discharge the parasitic capacitor.

DISCLOSURE OF THE INVENTION

It is an object of the present invention to provide an image display apparatus for suppressing light emission luminance variations of respective pixel display elements to increase the quality of the displayed image.

Another object of the present invention is to provide a control method for use with such an image display apparatus.

Still another object of the present invention is to provide a drive circuit for a current control element, which is capable of correcting threshold value variations of drive transistors with a minimum of components.

Yet another object of the present invention is to provide a drive method for a drive circuit for a current control element, which is capable of correcting threshold value variations of drive transistors with a minimum of components.

According to a first aspect of the present invention, an image display apparatus comprises a pixel having a drive transistor and a pixel display element which are connected in series between a first power line and a second power line, a holding capacitor connected to a gate electrode of the drive transistor, and a selection transistor connected between a signal line and the gate electrode of the drive transistor, control means for turning on the selection transistor thereby to write gradation pixel data in the holding capacitor from the signal line, discharging charges of the gradation pixel data written in the holding capacitor through the drive transistor for a predetermined time, and thereafter floating the gate electrode of the drive transistor thereby to hold the charges of the gradation pixel data stored in the holding capacitor.

According to a second aspect of the present invention, a control method for an image display apparatus including a pixel having a drive transistor and a pixel display element which are connected in series between a first power line and a second power line, a holding capacitor connected to a gate electrode of the drive transistor, and a selection transistor connected between a signal line and the gate electrode of the drive transistor, comprises the pixel data writing step of turning on the selection transistor thereby to write gradation pixel data in the holding capacitor from the signal line, the discharging step of discharging charges of the gradation pixel data written in the holding capacitor through the drive transistor for a predetermined time, and after the discharging step, the pixel data holding step of floating the gate electrode of the drive transistor thereby to hold the charges of the gradation pixel data stored in the holding capacitor.

According to a third aspect of the present invention, a drive circuit for a current control element comprises a drive transistor and a pixel display element which are connected in series between a first power line and a second power line, a holding capacitor connected to a gate electrode of the drive transistor, and a selection transistor connected between a signal line and the gate electrode of the drive transistor, wherein the selection transistor is turned on to input a first signal voltage from the signal line to discharge signal charges written in the holding capacitor through the drive transistor in a selection period of the drive circuit, thereafter a second signal voltage is input from the signal line and held in the holding capacitor, and the selection transistor is turned off to pass a current through the drive transistor to the current control element in a non-selection period of the drive circuit.

According to a fourth aspect of the present invention, a drive circuit includes a drive transistor and a pixel display element which are connected in series between a first power line and a second power line, a holding capacitor connected to a gate electrode of the drive transistor, and a selection transistor connected between a signal line and the gate electrode of the drive transistor, and the drive circuit is driven by a drive method which comprises the steps of turning on the selection transistor to input a first signal voltage from the signal line to discharge signal charges written in the holding capacitor through the drive transistor in a selection period of the drive circuit, inputting a second signal voltage from the signal line and holding the second signal voltage in the holding capacitor, and turning off the selection transistor to pass a current through the drive transistor to the current control element in a non-selection period of the drive circuit.

BEST MODE FOR CARRYING OUT THE INVNTION

Embodiments of the present invention will be described below with reference to the drawings.

First Embodiment

Figure 6:
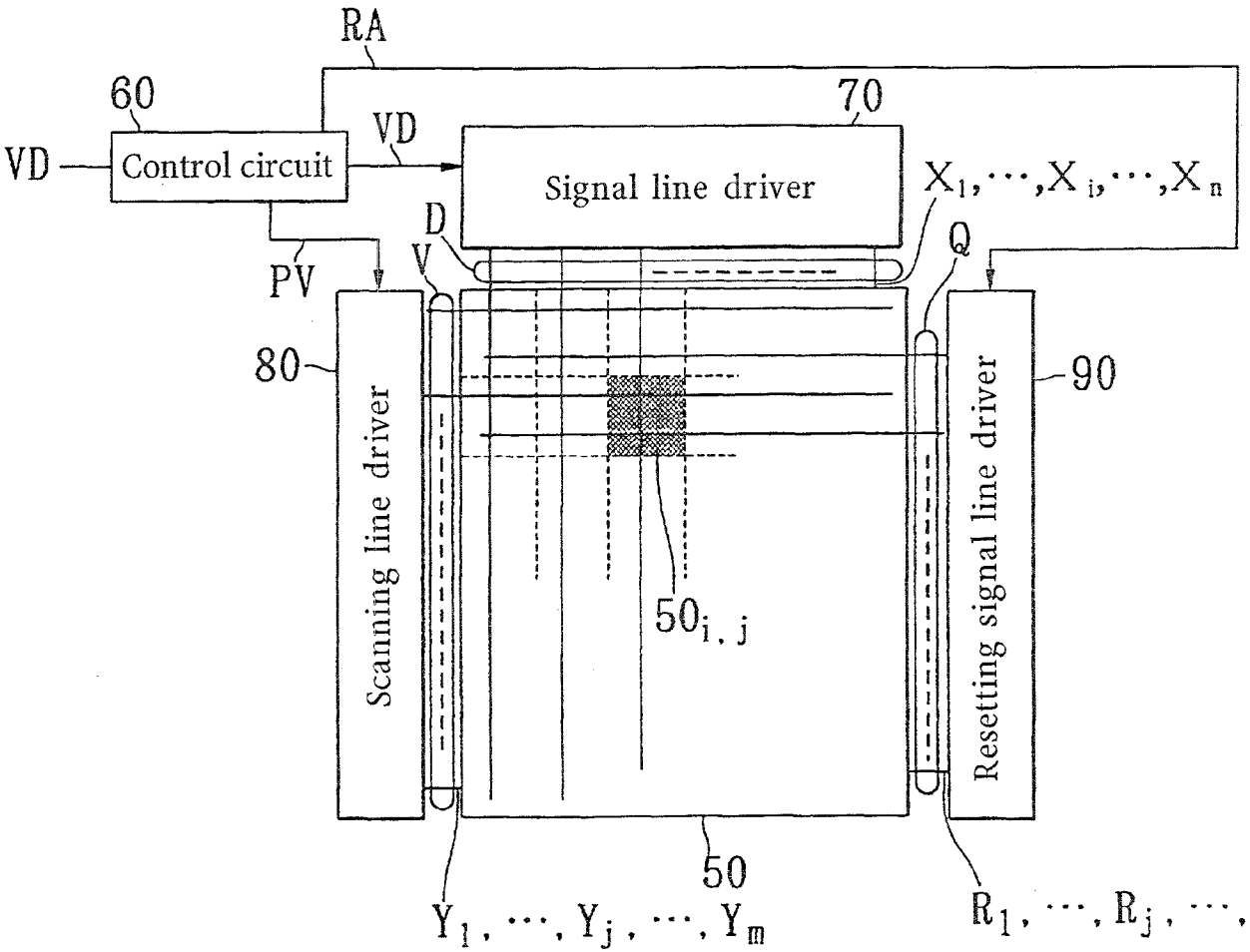
FIG. 6 is a block diagram of an electric arrangement of an image display apparatus according to a first embodiment of the present invention.

FIG. 6 is a block diagram of an electric arrangement of an image display apparatus according to a first embodiment of the present invention.

The image display apparatus comprises display panel 50, control circuit 60, signal line driver 70, scanning line driver 80, and resetting signal line driver 90. Display panel 50 comprises an organic EL display, for example, and has a plurality of signal lines $X_1, \ldots, X_i, \ldots, X_n$ to which gradation pixel data D are applied, a plurality of scanning line $Y_1, \ldots, Y_j, \ldots, Y_m$ to which scanning signals V are applied, a plurality of resetting signal lines $R_1, \ldots, R_j, \ldots, R_m$ to which resetting signals Q are applied, and a plurality of pixels $\mathbf{50}_{i,j}$ (i=1, 2, . . . , n, j=1, 2, . . . , m) disposed at points of intersection between signal lines $X_1, \ldots, X_i, \ldots, X_n$ and scanning lines $Y_1, \ldots, Y_j, \ldots, Y_m$. Of pixels $\mathbf{50}_{i,j}$, those pixels on scanning lines that are selected by scanning signals V are supplied with gradation pixel data D to display an image.

Control circuit 60 supplies image input signal VD supplied from an external source to signal line driver 70, supplies vertical scanning signal PV to scanning line driver 40, and supplies resetting control signal RA to resetting signal line driver 90. Signal line driver 70 applies gradation pixel data D depending on image input signal VD to signal lines $X_1, \ldots, X_i, \ldots, X_n$. Scanning line driver 80 successively generates scanning signals V in synchronism with vertical scanning signal PV supplied from control circuit 60, and applies scanning signals V successively in the order of lines, for example, to corresponding scanning line $Y_1, \ldots, Y_j, \ldots, Y_m$ of display panel 10. Resetting signal line driver 90 applies reset signals Q to respective resetting signal lines $R_1, \ldots, R_i, \ldots, R_m$ based on resetting control signal RA.

Figure 7:
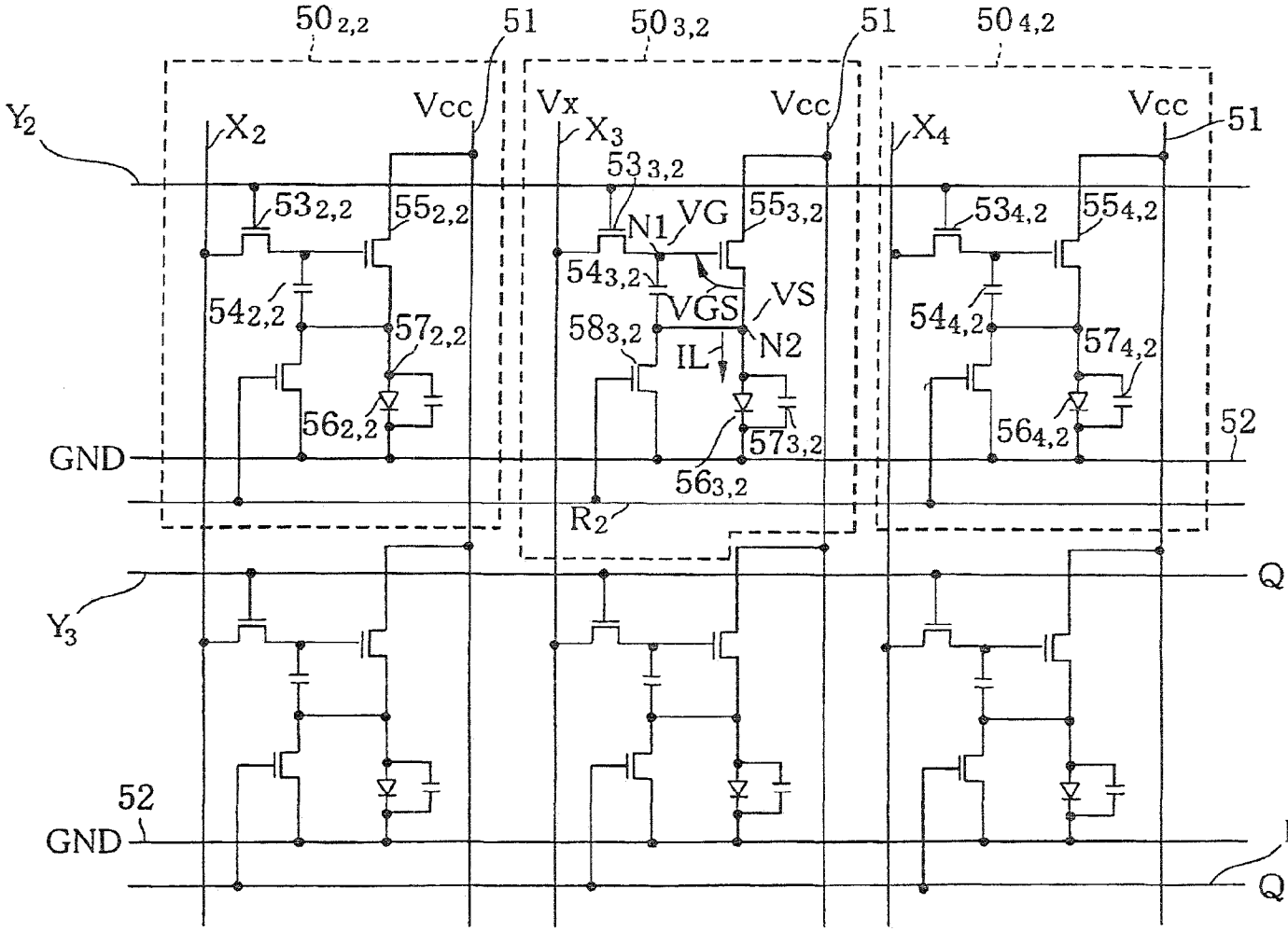
FIG. 7 is a circuit diagram of an electric arrangement of a pixel and pixels adjacent thereto in the image display apparatus shown in FIG. 6.

FIG. 7 shows an electric arrangement of pixel $\mathbf{50}_{i,j}$ (e.g., i=3, j=2) and pixels 50, adjacent thereto in FIG. 6. Pixel $\mathbf{50}_{3,2}$ comprises power line 51, ground line 52, selection transistor $\mathbf{53}_{3,2}$, holding capacitor $\mathbf{54}_{3,2}$, drive transistor $\mathbf{55}_{3,2}$, pixel display element $\mathbf{56}_{3,2}$, parasitic capacitor $\mathbf{57}_{3,2}$ and resetting transistor $\mathbf{58}_{3,2}$. Power line 51 is supplied with power voltage Vcc with respect to ground line 52. Selection transistor $\mathbf{53}_{3,2}$ comprises an nMOS, for example, and has a drain electrode connected to signal line $X_3$, a source electrode to node N1, and a gate electrode to scanning line $Y_2$. Selection transistor $\mathbf{53}_{3,2}$ performs on/off control of a conduction state between signal line $X_3$ and node N1 based on scanning signal V.

Holding capacitor $\mathbf{54}_{3,2}$ is connected between node N1 and node N2, and holds the voltage between the source and gate electrodes of drive transistor $\mathbf{55}_{3,2}$. Drive transistor $\mathbf{55}_{3,2}$ comprises an nMOS, for example, and has a drain electrode connected to power line 51 (power voltage Vcc), a source electrode to node N2, and a gate electrode to node N1. Drive transistor $\mathbf{55}_{3,2}$ passes output current IL, which is controlled based on the voltage between the source and gate electrodes thereof, from power voltage Vcc to node N2. Pixel display element $\mathbf{56}_{3,2}$ has an anode connected to node N2 and a cathode to ground line 52, with parasitic capacitor $\mathbf{57}_{3,2}$ connected between the anode and cathode thereof. Pixel display element $\mathbf{56}_{3,2}$ displays a pixel with a gradation based on output current IL from drive transistor $\mathbf{55}_{3,2}$. Pixel display element $\mathbf{56}_{3,2}$ preferably comprises an organic EL element. Resetting transistor $\mathbf{58}_{3,2}$ comprises an nMOS, for example, and has a drain electrode connected to node N2, a source electrode to ground line 52, and a gate electrode to resetting signal line $R_2$. Resetting transistor $\mathbf{58}_{3,2}$ performs on/off control of a conduction state between node N2 and ground line 52 based on resetting signal Q. Pixels $\mathbf{50}_{2,2}$, $\mathbf{50}_{4,2}$ which are positioned adjacent to pixel $\mathbf{50}_{3,2}$ also have selection transistor $\mathbf{53}_{2,2}$, drive transistor $\mathbf{55}_{2,2}$, selection transistor $\mathbf{53}_{4,2}$, drive transistor $\mathbf{55}_{4,2}$, etc., and are of the same arrangement. Other pixels $\mathbf{50}_{i,j}$ are also of the same arrangement.

Figure 8:
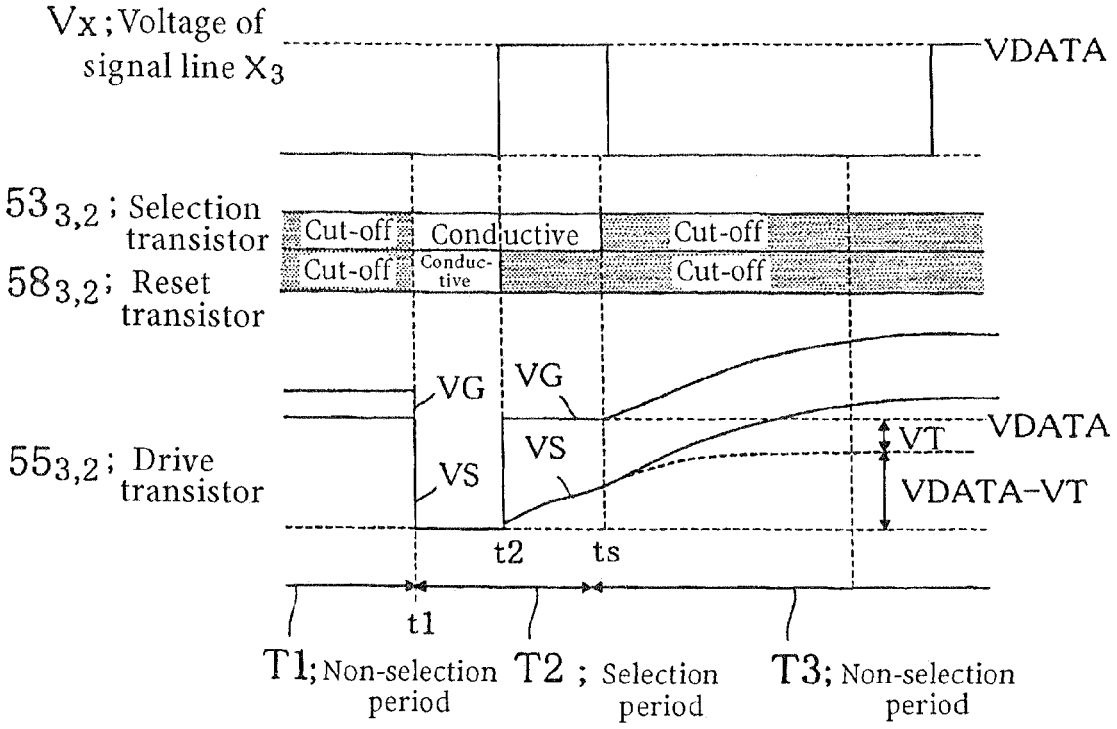
FIG. 8 is a timing chart showing the manner in which an image display section operates.
Figure 9:
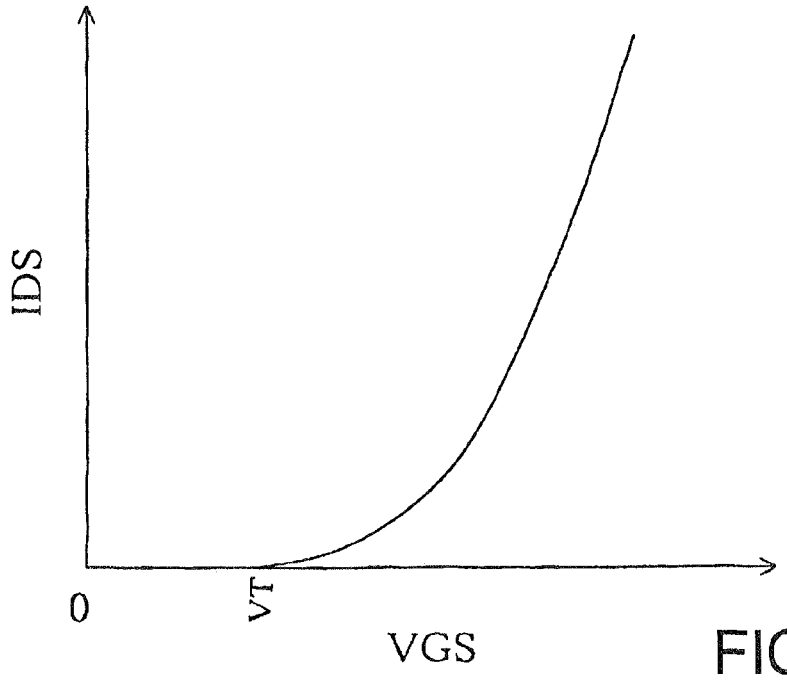
FIG. 9 is a graph showing the IDS-VGS characteristics of a drive transistor.
Figure 10:
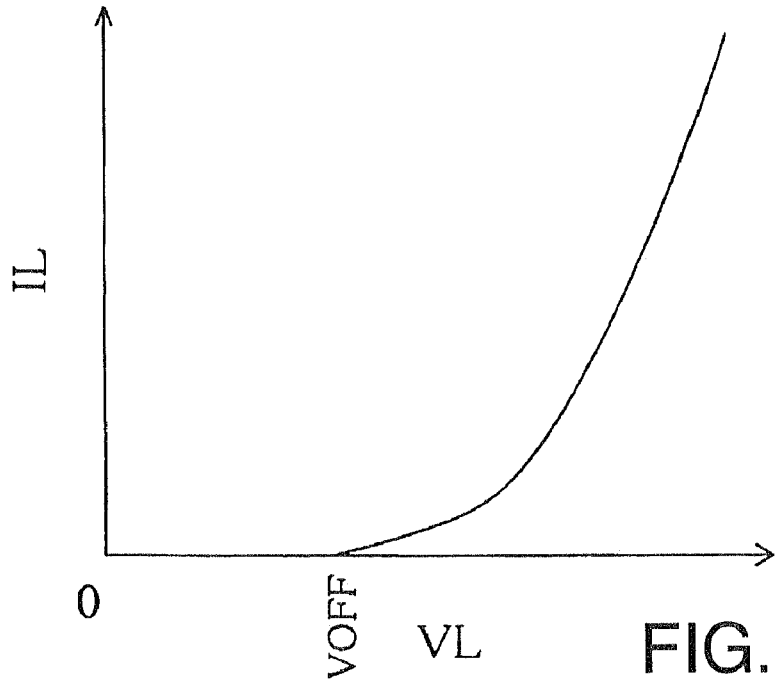
FIG. 10 is a graph showing the VL-IS characteristics of a pixel display element.
Figure 11:
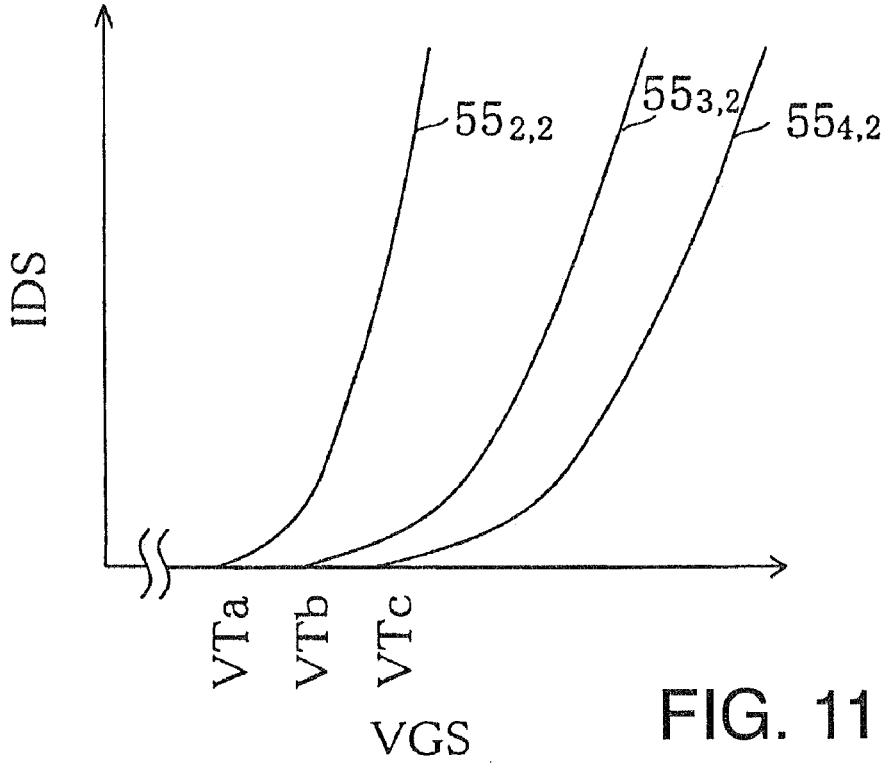
FIG. 11 is a graph showing the IDS-VGS characteristics of drive transistors of respective pixels.
Figure 12:
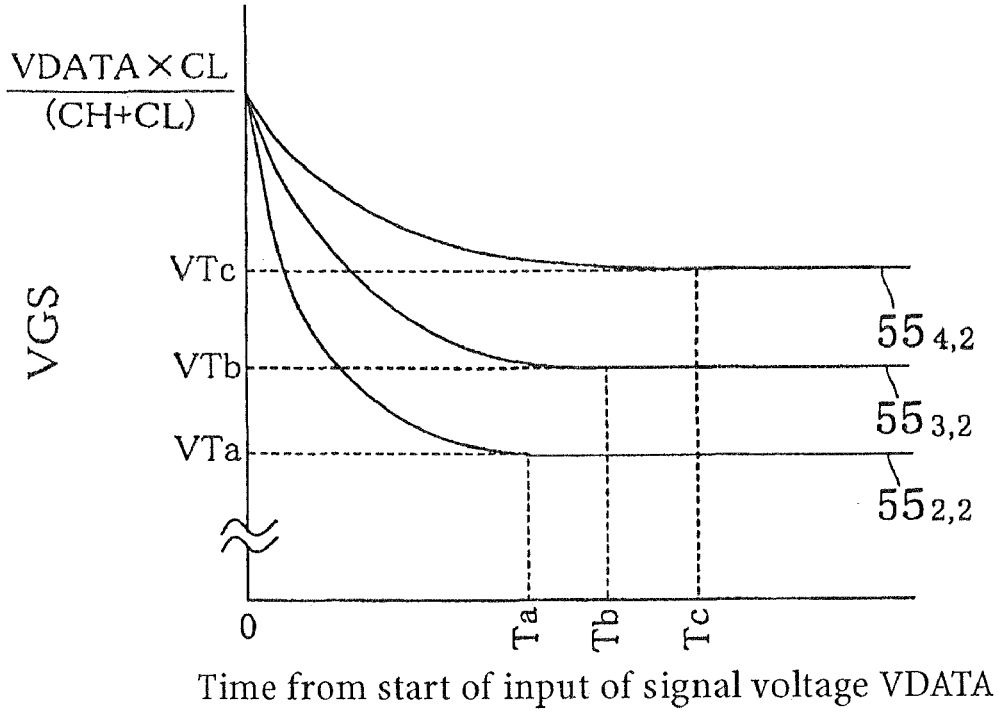
FIG. 12 is a graph showing the transient characteristics of the gate-to-source voltage VGS of drive transistors of respective pixels.
Figure 13:
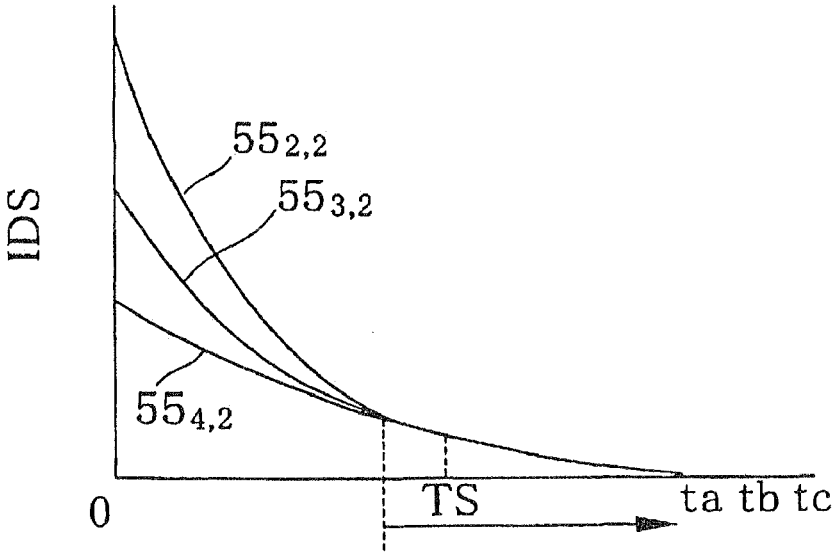
FIG. 13 is a graph showing the transient characteristics of the drain currents IDS of drive transistors of respective pixels.
Figure 14:
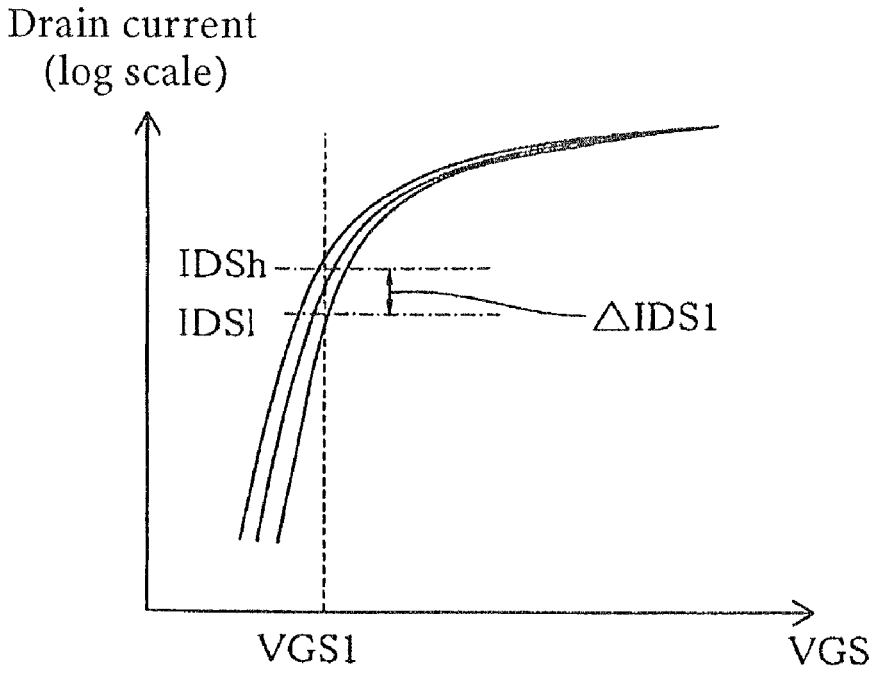
FIG. 14 is a graph showing the IDS-VGS characteristics of drive transistors of respective pixels.
Figure 15:
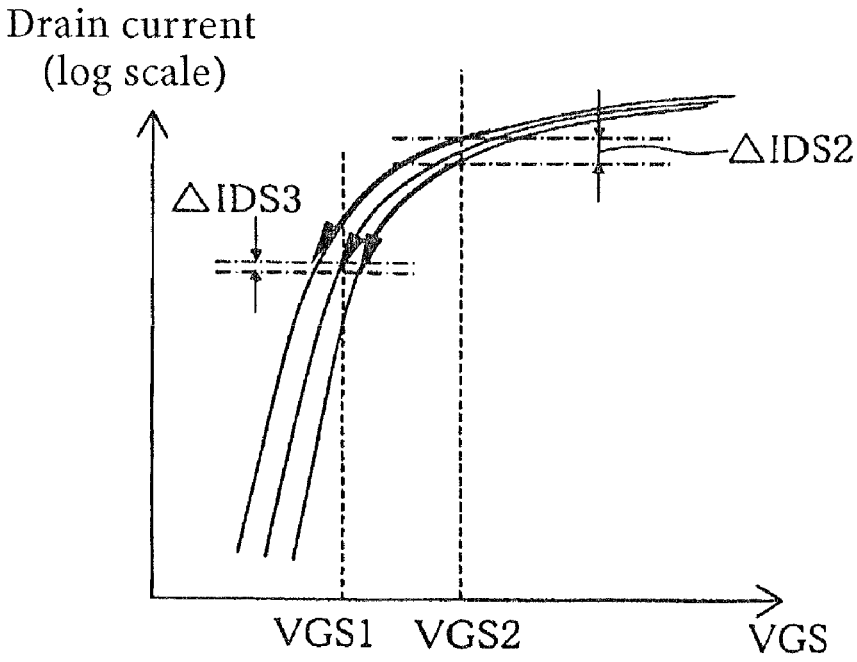
FIG. 15 is a graph showing the IDS-VGS characteristics of drive transistors of respective pixels.

FIG. 8 is a timing chart showing the manner in which image display section $\mathbf{50}_{3,2}$ shown in FIG. 7 operates. FIG. 9 shows the IDS-VGS characteristics of drive transistor $\mathbf{55}_{3,2}$; FIG. 10 shows the VL-IS characteristics of pixel display element $\mathbf{56}_{3,2}$; FIG. 11 shows the IDS-VGS characteristics of drive transistors $\mathbf{55}_{3,2}$, $\mathbf{55}_{2,2}$, $\mathbf{55}_{4,2}$ of the respective pixels; FIG. 12 shows the transient characteristics of the VGS (gate-to-source voltage) of drive transistors $\mathbf{55}_{3,2}$, $\mathbf{55}_{2,2}$, $\mathbf{55}_{4,2}$ of the respective pixels; FIG. 13 shows the transient characteristics of the IDS (drain current) of drive transistors $\mathbf{55}_{3,2}$, $\mathbf{55}_{2,2}$, $\mathbf{55}_{4,2}$ of the respective pixels; FIG. 14 shows the IDS-VGS characteristics of drive transistors $\mathbf{55}_{3,2}$, $\mathbf{55}_{2,2}$, $\mathbf{55}_{4,2}$ of the respective pixels; and FIG. 15 shows the IDS-VGS characteristics of drive transistors $\mathbf{55}_{3,2}$, $\mathbf{55}_{2,2}$, $\mathbf{55}_{4,2}$ of the respective pixels. A control method for the image display apparatus shown in FIG. 6 will be described with reference to these figures.

In non-selection period T1, selection transistor $\mathbf{53}_{3,2}$ and resetting transistor $\mathbf{58}_{3,2}$ are in off-state (non-conductive state). When selection period T2 starts at time t1, scanning signal V is applied to scanning line $Y_2$ to turn on selection transistor $\mathbf{53}_{3,2}$ (to conductive state) from off-state, and resetting signal Q is applied to resetting signal line $R_2$ to turn on resetting transistor $\mathbf{58}_{3,2}$ (to conductive state) from off-state. At this time, voltage Vx supplied to signal line $X_3$ is 0 V which is the same as the ground level. Since selection transistor $53_{3,2}$ and resetting transistor $58_{3,2}$ are turned on, holding capacitor $54_{3,2}$ and parasitic capacitor $57_{3,2}$ are discharged, bringing gate voltage VG and source voltage VS of drive transistor $55_{3,2}$ to 0 V (first discharging process). As gate-to-source voltage VGS of drive transistor $55_{3,2}$ is 0 V, no current flows between the drain and source of drive transistor $55_{3,2}$.

At time t2, resetting transistor $58_{3,2}$ is turned off from on-state, and voltage Vx of signal line $X_3$ changes from 0 V to VDATA, writing gradation pixel data D (pixel data writing process). Immediately thereafter, gate-to-source voltage VGS of drive transistor $55_{3,2}$ is expressed by:

$$VGS=VDATA\times CL/(CH+CL)$$

where CH: capacitance value of holding capacitor $54_{3,2}$;

CL: capacitance value of parasitic capacitor $57_{3,2}$.

Source voltage VS of drive transistor $55_{3,2}$ is expressed by:

$$VS=VDATA\times CH/(CH+CL)$$

Figure 19:
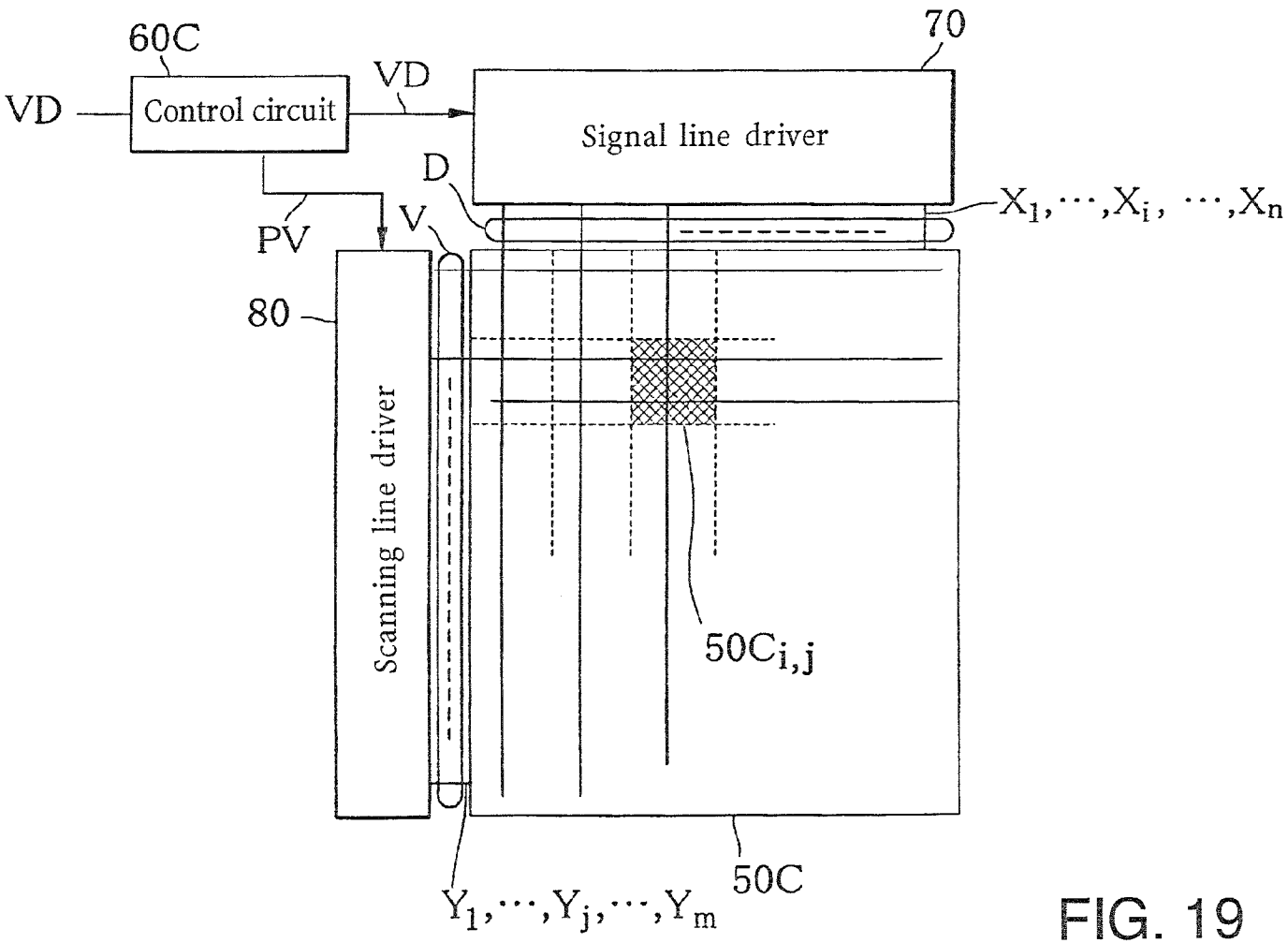
FIG. 19 is a block diagram of an electric arrangement of an image display apparatus according to a third embodiment of the present invention.

At this time, gate-to-source voltage VGS of drive transistor $55_{3,2}$ is higher than threshold value VT of drive transistor $55_{3,2}$ (i.e., VGS>VT) on the VGS-IDS characteristics shown in FIG. 19. Inter-terminal VL across pixel display element $56_{3,2}$, i.e., source voltage VS of drive transistor $55_{3,2}$, is smaller than voltage VOFF at which current IL starts to flow (i.e., VS<VOFF), on the VL-IL characteristics shown in FIG. 20. Since gate-to-source voltage VGS of drive transistor $55_{3,2}$ is higher than threshold value VT (VGS>VT), current IL flows between the drain and source of drive transistor $55_{3,2}$. Current IL charges parasitic capacitor $57_{3,2}$ increasing inter-terminal voltage VL across pixel display element $56_{3,2}$, i.e., source voltage VS of drive transistor $55_{3,2}$. At the same time, because gate voltage VG drive transistor $55_{3,2}$ is of constant value VDATA, gate-to-source voltage VGS of drive transistor $55_{3,2}$ decreases toward threshold value VT. That is, source voltage VS of drive transistor $55_{3,2}$ approaches [VDATA−VT].

Figure 21:
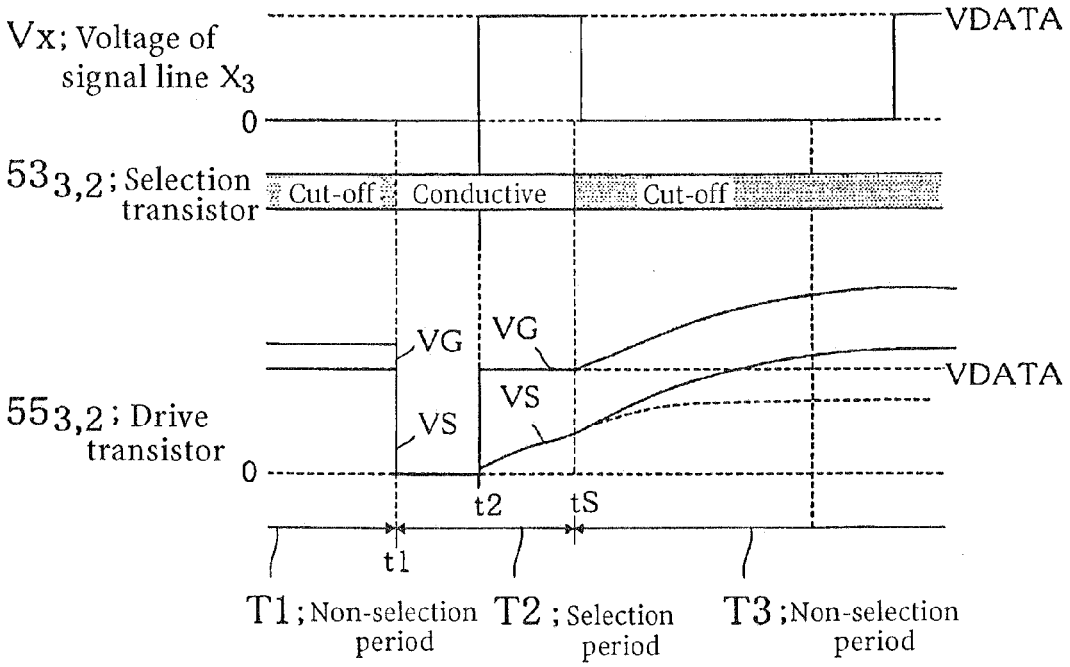
FIG. 21 is a timing chart showing the manner in which an image display section operates.
Figure 22:
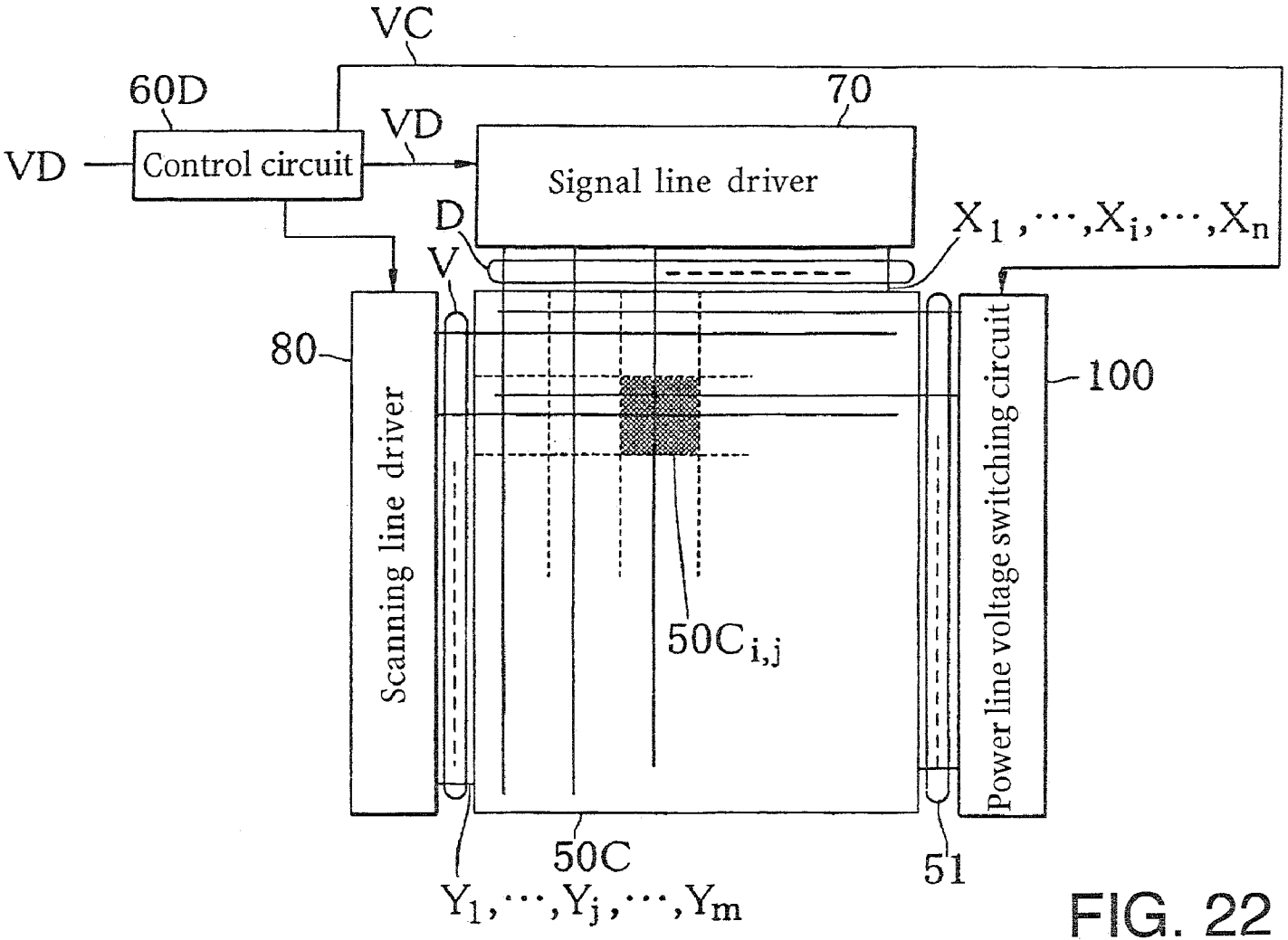
FIG. 22 is a block diagram of an electric arrangement of an image display apparatus according to a fourth embodiment of the present invention.
Figure 23:
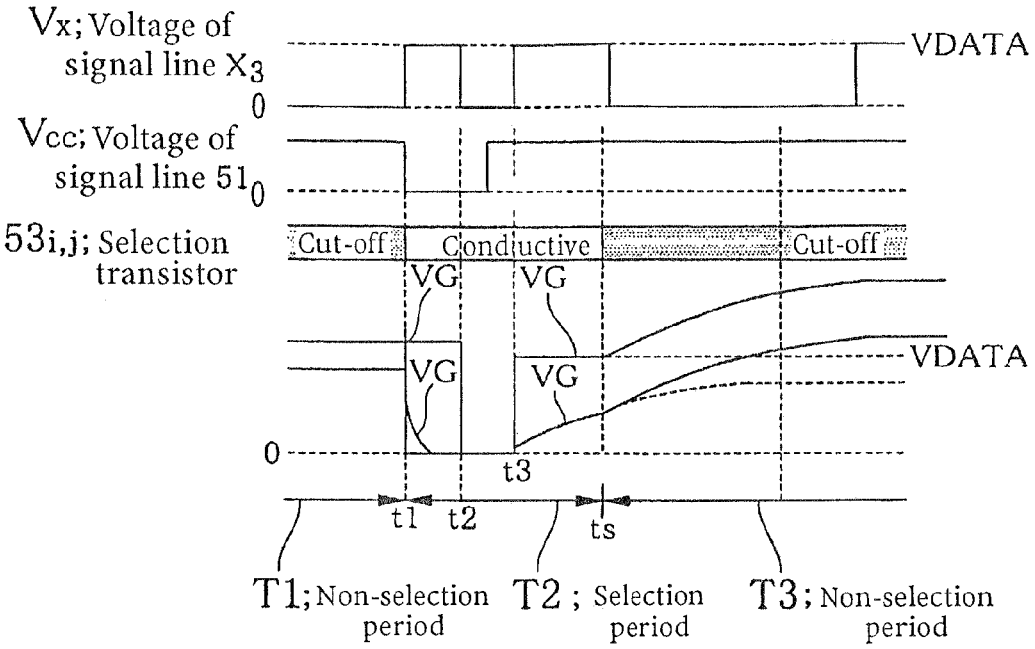
FIG. 23 is a timing chart showing the manner in which an image display section operates.

Since drive transistor $55_{3,2}$ and drive transistors $55_{2,2}$, $55_{4,2}$ in FIG. 7 are thin-film transistors formed on a glass substrate (not shown), the VGS-IDS characteristics representing the relationship between drain-to-source current IDS and gate-to-source voltage VGS vary between individual drive transistors $55_{2,2}$, $55_{3,2}$, $55_{4,2}$ as shown in FIG. 21. For example, as shown in FIG. 22, as a sufficient time elapses after the transition of voltage Vx of signal line $X_3$ from 0 V to VDATA, gate-to-source voltages VGS of drive transistors $55_{2,2}$, $55_{3,2}$, $55_{4,2}$ become threshold values VTa, VTb, VTc, respectively, of drive transistors $55_{2,2}$, $55_{3,2}$, $55_{4,2}$. Drain-to-source currents IDS of drive transistors $55_{2,2}$, $55_{3,2}$, $55_{4,2}$ progressively decrease to 0 from their current values immediately after the pixel data have written, as shown in FIG. 23.

In the present embodiment, at time ts prior to times ta, tb, tc when gate-to-source voltages VGS of drive transistors $55_{2,2}$, $55_{3,2}$, $55_{4,2}$ become threshold values VTa, VTb, VTc, respectively, selection transistors $53_{2,2}$, $53_{3,2}$, $53_{4,2}$ are turned off, stopping the discharging of charges stored in holding capacitors $54_{2,2}$, $54_{3,2}$, $54_{4,2}$ (second discharging process), whereupon selection period T2 changes to non-selection period T3. After signal charges are written in holding capacitors $54_{2,2}$, $54_{3,2}$, $54_{4,2}$, the stored signal charges are discharged as drain-to-source currents through drive transistors $55_{2,2}$, $55_{3,2}$, $55_{4,2}$. At this time, of drive transistors $55_{2,2}$, $55_{3,2}$, $55_{4,2}$, a transistor with a greater current capacity passes a greater discharged current, so that its gate-to-source voltage VGS drops earlier, and the rate at which the current decreases is greater. On the other hand, a transistor with a smaller current capacity passes a smaller discharged current, so that its gate-to-source voltage VGS drops slower, and the rate at which the current decreases is smaller.

For example, as shown in FIG. 14, when constant signal voltage VGS1 corresponding to a set gradation current is written in holding capacitors $54_{2,2}$, $54_{3,2}$, $54_{4,2}$, a current having current value IDSh flows through the transistor with the greater current capacity, and a current having current value IDSl flows through the transistor with the smaller current capacity. If the current value of a transistor having an average current capacity is represented by ID1, then a variation indicated by ΔIDS1/IDS1 (where, ΔIDS1=IDSh−IDSl) occurs. In the present embodiment, as shown in FIG. 15, signal voltage VGS2 higher than signal voltage VGS1 corresponding to the set gradation current is applied to the gate electrodes of drive transistors $55_{2,2}$, $55_{3,2}$, $55_{4,2}$, storing charges in holding capacitors $54_{2,2}$, $54_{3,2}$, $54_{4,2}$. A variation of current IL at this time is indicated by ΔIDS2/IDS2.

Thereafter, the charges stored in holding capacitors $54_{2,2}$, $54_{3,2}$, $54_{4,2}$ are discharged for a certain period of time through drive transistors $55_{2,2}$, $55_{3,2}$, $55_{4,2}$ with their gate-to-source voltages VGS dropping in the directions indicated by the respective allows in FIG. 15. The gate-to-source voltage VGS drops earlier in the transistor with the greater current capacity, and slower in the transistor with the smaller current capacity. Consequently, current variation ΔIDS3/IDS3 after the discharging is stopped is smaller than current variation ΔIDS2/IDS2 immediately after the signal voltages are written.

Since drive transistors $55_{2,2}$, $55_{3,2}$, $55_{4,2}$ have such characteristics that a drive transistor having a larger gate-to-source voltage generally has a smaller drain-to-source current variation, variation ΔIDS2/IDS2 is smaller than variation ΔIDS1/IDS1, resulting in a reduction in the current variation. As a result, when the discharging is stopped at time ts that is a certain period of time after time t2 and selection period T2 changes to non-selection period T3, a current variation with respect to the average current, i.e., [{(the current flowing through the transistor with the greater current capacity)−(the current flowing through the transistor with the smaller current capacity)}/(the current flowing through the average transistor)], is smaller than the variation of current IL after the pixel data are written.

In non-selection period T3, selection transistors $53_{2,2}$, $53_{3,2}$, $53_{4,2}$ are turned off, floating the gate electrodes of drive transistors $55_{2,2}$, $55_{3,2}$, $55_{4,2}$. Gate-to-source voltages VGS of drive transistors $55_{2,2}$, $55_{3,2}$, $55_{4,2}$ are held respectively by holding capacitors $54_{2,2}$, $54_{3,2}$, $54_{4,2}$ (charge holding process). Specifically, respective source voltages VS of drive transistors $55_{2,2}$, $55_{3,2}$, $55_{4,2}$ build up as parasitic capacitors $57_{2,2}$, $57_{3,2}$, $57_{4,2}$ are charged, and simultaneously respective gate voltages VG of drive transistors $55_{2,2}$, $55_{3,2}$, $55_{4,2}$ build up through holding capacitors $54_{2,2}$, $54_{3,2}$, $54_{4,2}$ while keeping gate-to-source voltages VGS constant.

When inter-terminal voltages VL (=VS) across pixel display elements $55_{2,2}$, $56_{3,2}$, $56_{4,2}$ reach a voltage that is sufficient to pass currents IL determined by gate-to-source voltages VGS of drive transistors $55_{2,2}$, $55_{3,2}$, $55_{4,2}$, gate voltages VG and source voltages VS of drive transistors $55_{2,2}$, $55_{3,2}$, $55_{4,2}$ stop increasing and become constant. Thereafter, inasmuch as gate-to-source voltages VGS of drive transistors $55_{2,2}$, $55_{3,2}$, $55_{4,2}$ are held respectively by holding capacitors $54_{2,2}$, $54_{3,2}$, $54_{4,2}$, constant currents IL keep flowing through pixel display elements $56_{2,2}$, $56_{3,2}$, $56_{4,2}$. The magnitude of currents IL keep flowing through pixel display elements $56_{2,2}$, $56_{3,2}$, $56_{4,2}$. In non-selection period T3 is adjusted based on the signal charges written in holding capacitors $54_{2,2}$, $54_{3,2}$, $54_{4,2}$ and a set discharge time (an interval between time t2 and time ts), and is set such that currents IL corresponding to the luminance gradation flow.

According to the first embodiment, as described above, signal voltage VGS2 higher than signal voltage VGS1 corresponding to the set gradation current is written in the gate electrodes of drive transistors $55_{2,2}$, $55_{3,2}$, $55_{4,2}$ and the charges stored in holding capacitors $54_{2,2}$, $54_{3,2}$, $54_{4,2}$ are discharged for a certain period of time through drive transistors $55_{2,2}$, $55_{3,2}$, $55_{4,2}$. Therefore, variations of the drain-to-source currents of drive transistors $55_{2,2}$, $55_{3,2}$, $55_{4,2}$ are reduced. Consequently, variations of the currents flowing through pixel display elements $56_{2,2}$, $56_{3,2}$, $56_{4,2}$ are reduced, and so are variations of the luminance gradations of pixels displayed by pixel display elements $56_{2,2}$, $56_{3,2}$, $56_{4,2}$, resulting in the increased quality of the displayed image.

Second Embodiment

Figure 16:
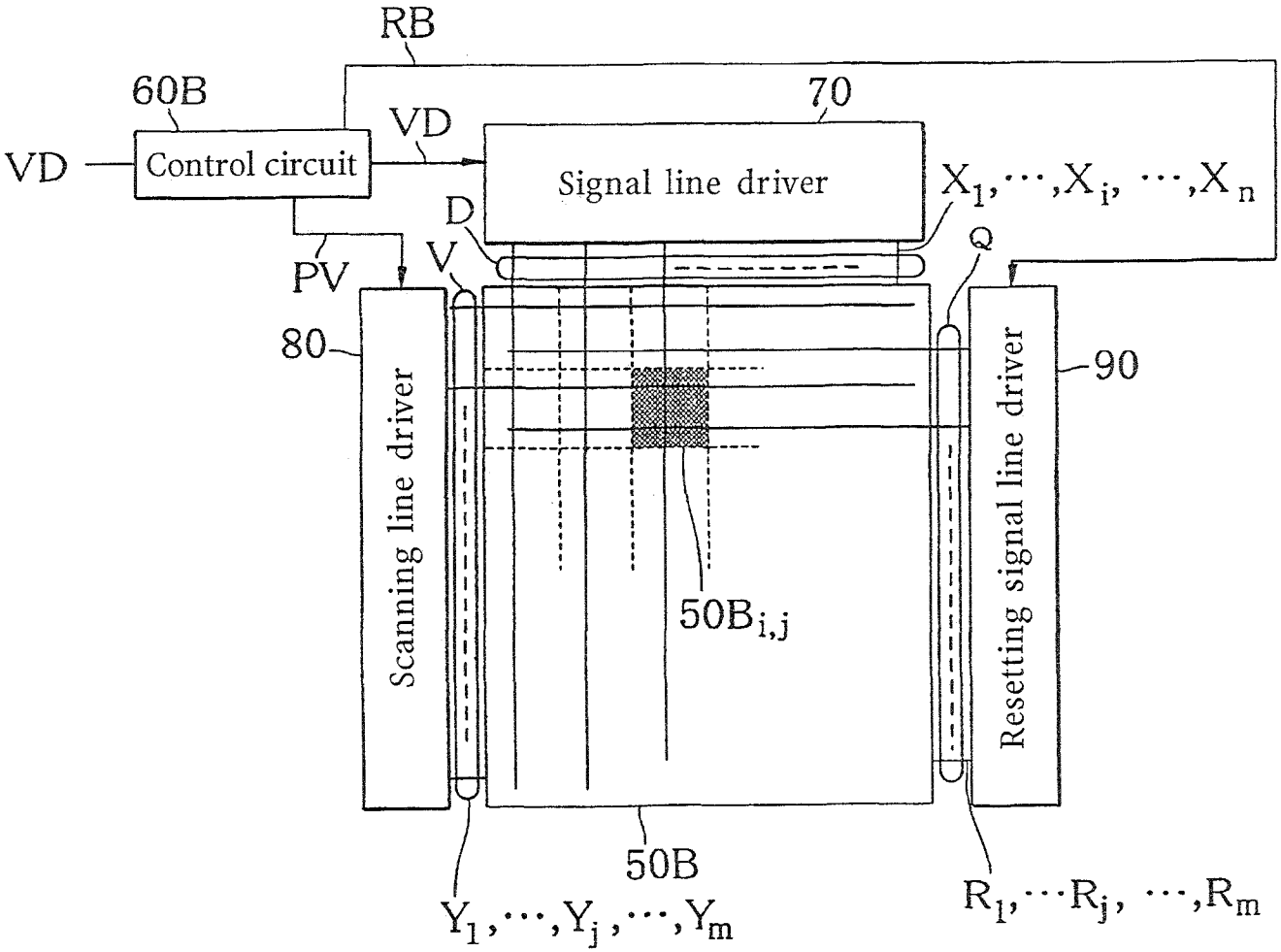
FIG. 16 is a block diagram of an electric arrangement of an image display apparatus according to a second embodiment of the present invention.

FIG. 16 is a block diagram of an electric arrangement of an image display apparatus according to a second embodiment of the present invention. Common reference characters are assigned to those elements in FIG. 16 which are common to the elements shown in FIG. 6 illustrating the first embodiment.

The image display apparatus according to the present embodiment has control circuit 60B having a different function and display panel 50B having a different arrangement, instead of control circuit 60 and display panel 50 shown in FIG. 6. Control circuit 60B supplies resetting control signal RB having a different timing from resetting control signal RA shown in FIG. 6 to resetting signal line driver 90. Display panel 50B has pixels $50B_{i,j}$ having a different arrangement, instead of pixels $50_{i,j}$ shown in FIG. 6. Other details are identical to those shown in FIG. 6.

Figure 17:
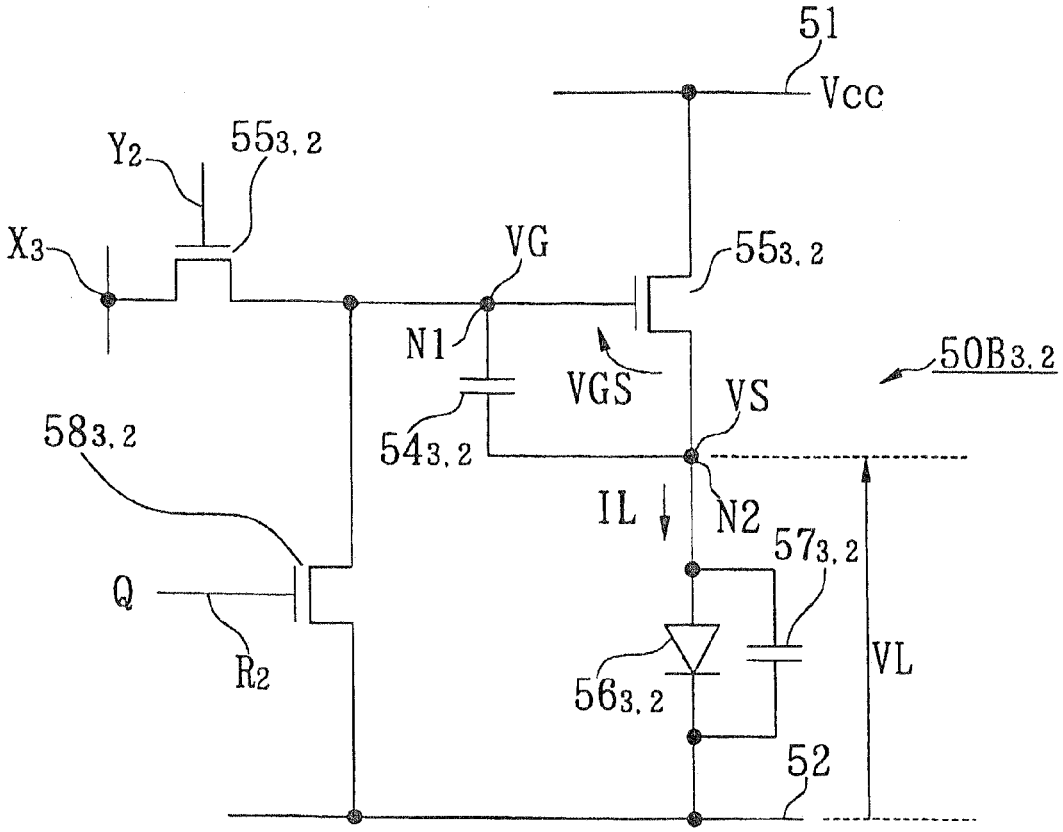
FIG. 17 is a circuit diagram of an electric arrangement of a pixel in the image display apparatus shown in FIG. 16.

FIG. 17 is a circuit diagram of an electric arrangement of pixel $50B_{i,j}$ (e.g., i=3, j=2) in the image display apparatus shown in FIG. 16. Common reference characters are assigned to those elements in FIG. 17 which are common to the elements shown in FIG. 7 according to the first embodiment.

In pixel $50B_{i,j}$, as shown in FIG. 17, resetting transistor $58_{3,2}$ has a drain electrode connected to node N1, and performs on/off control of a conduction state between node N1 and ground line 52 based on resetting signal Q. Other details are identical to those of the pixel shown in FIG. 7. Pixels $50B_{2,2}$, $50B_{4,2}$ and the like (not shown) that are positioned adjacent to pixel $50B_{3,2}$ are of the same structure.

Figure 18:
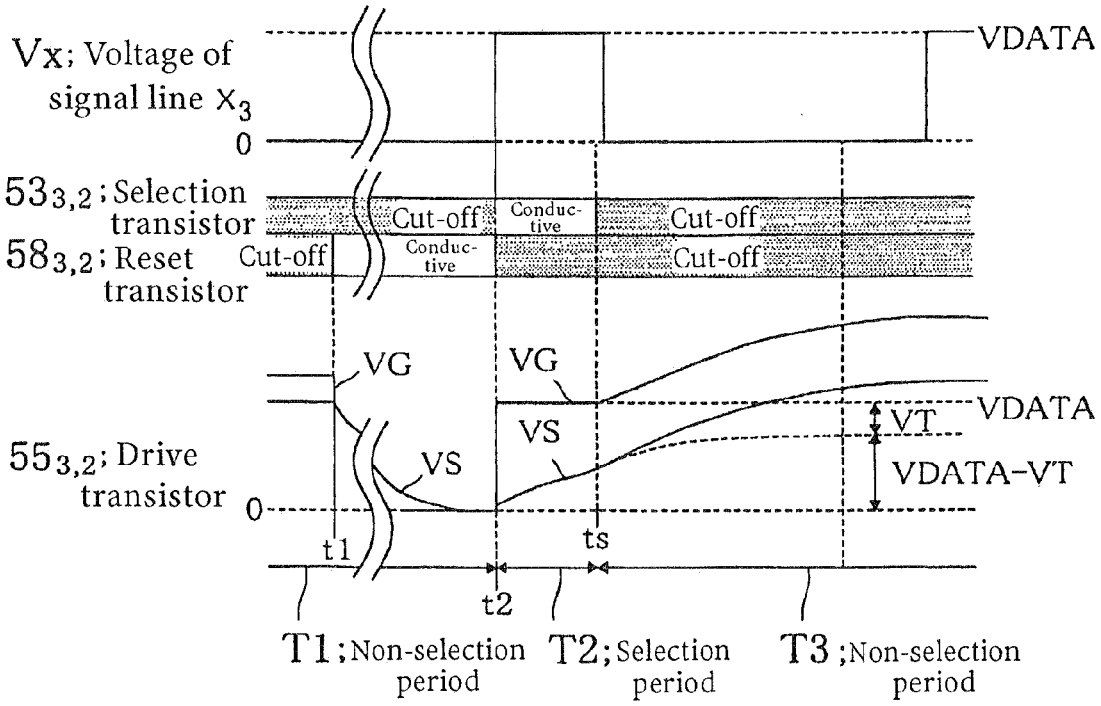
FIG. 18 is a timing chart showing the manner in which an image display section operates.

FIG. 18 is a timing chart showing the manner in which image display section $50B_{3,2}$ shown in FIG. 17 operates. A display control method for the image display apparatus shown in FIG. 16 will be described with reference to FIG. 18.

In non-selection period T1, selection transistor $53_{3,2}$ is turned off. At time t1, resetting signal Q is applied to resetting signal line $R_2$ to turn on resetting transistor $58_{3,2}$ to on-state (conductive state) from off-state. Since resetting transistor $58_{3,2}$ is turned on, gate voltage VG of drive transistor $55_{3,2}$ is brought to 0 V. Therefore, gate-to-source voltage VGS of drive transistor $55_{3,2}$ becomes a negative voltage, drive transistor $55_{3,2}$ is turned off. At this time, the charges stored in parasitic capacitor $57_{3,2}$ are discharged through pixel display element $56_{3,2}$ to ground line 52 (first discharging process). When a sufficient time elapses after resetting transistor $58_{3,2}$ becomes on-state (conductive state), all the charges stored in parasitic capacitor $57_{3,2}$ are discharged, bringing source voltage VS of drive transistor $55_{3,2}$ to 0 V.

When selection period T2 starts at time t2, resetting transistor $58_{3,2}$ is turned off, and selection transistor $53_{3,2}$ is turned on. At this time, voltage Vx of signal line $X_3$ changes from 0 V to VDATA, writing gradation pixel data D (pixel data writing process). Immediately thereafter, gate-to-source voltage VGS of drive transistor $55_{3,2}$ is expressed, using capacitance value CH of holding capacitor $54_{3,2}$ and capacitance value CL of parasitic capacitor $57_{3,2}$ of the current control element, by:

$$VGS=VDATA\times CL/(CH+CL)$$

Source voltage VS of drive transistor $55_{3,2}$ is expressed by:

$$VS=VDATA\times CH/(CH+CL)$$

At this time, gate-to-source voltage VGS of drive transistor $65_{3,2}$ is higher than threshold value VT of drive transistor $55_{3,2}$ (i.e., VGS>VT), as shown in FIG. 9 according to the first embodiment. Inter-terminal voltage VL across pixel display element $56_{3,2}$, i.e., source voltage VS of drive transistor $55_{3,2}$, is smaller than voltage VOFF at which current IL starts to flow (i.e., VS<VOFF), on the VL-IL characteristics shown in FIG. 10 according to the first embodiment. Subsequently, the image display apparatus according to the second embodiment operates in the same manner as with the first embodiment, and offers the same advantages as with the first embodiment.

Third Embodiment

FIG. 19 is a block diagram of an electric arrangement of an image display apparatus according to a third embodiment of the present invention. Common reference characters are assigned to those elements in FIG. 19 which are common to the elements shown in FIG. 6 according to the first embodiment.

The image display apparatus shown in FIG. 19 has control circuit 60C having a different function and display panel 50C having a different arrangement, instead of control circuit 60 and display panel 50 in the image display apparatus shown in FIG. 6. Resetting signal line driver 90 shown in FIG. 6 is dispensed with. Control circuit 60C supplies image input signal VD having a different timing from control circuit 60 to signal line driver 70. Display panel 50C has pixels $50C_{i,j}$ having a different arrangement, instead of pixels $50_{i,j}$ shown in FIG. 6. Other details are identical to those of the image display apparatus shown in FIG. 6.

Figure 20:
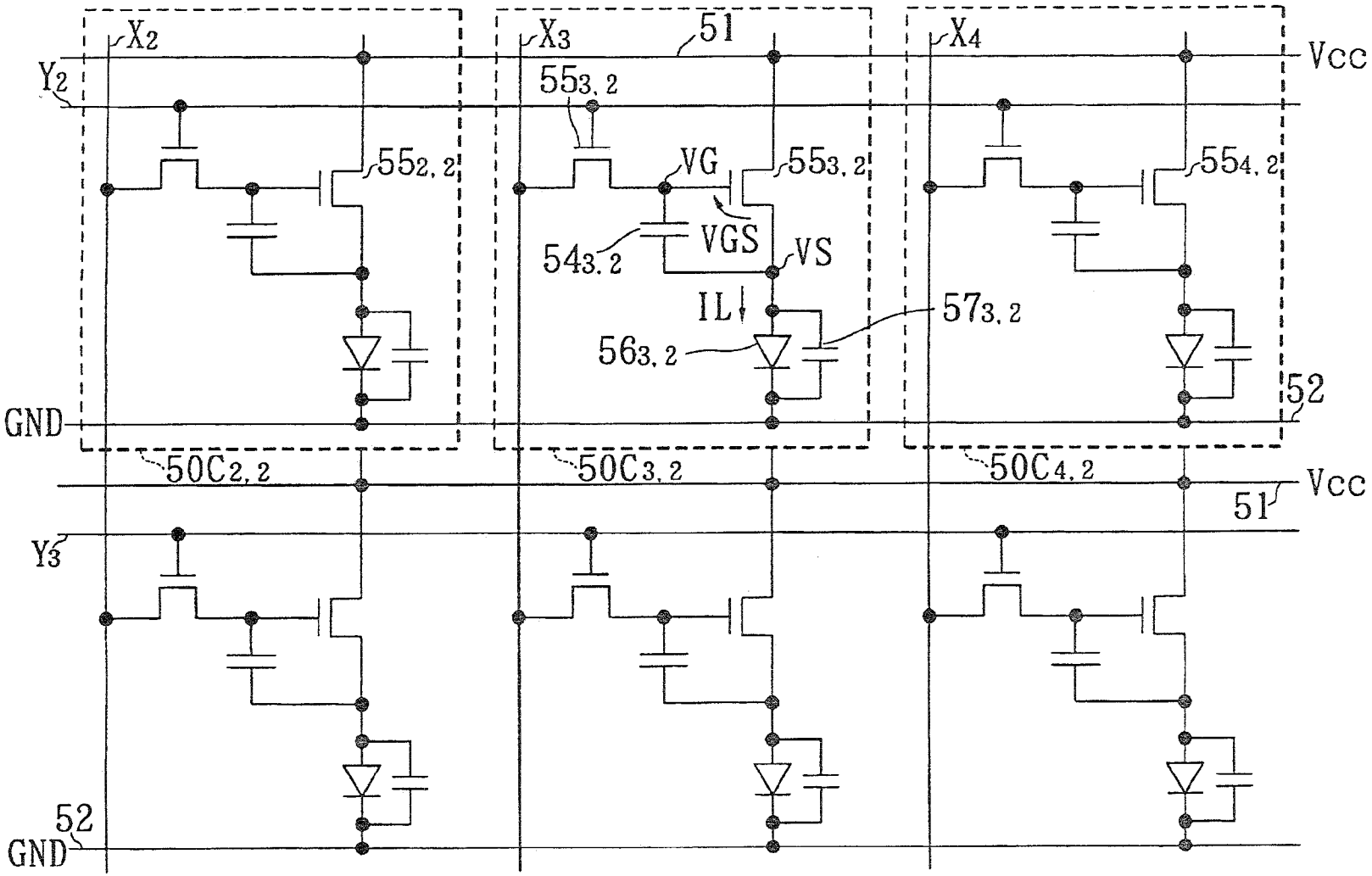
FIG. 20 is a diagram of an electric arrangement of a pixel in the image display apparatus shown in FIG. 19.

FIG. 20 is a circuit diagram of an electric arrangement of pixel $50C_{i,j}$ (e.g., i=3, j=2) in the image display apparatus shown in FIG. 19. Common reference characters are assigned to those elements in FIG. 20 which are common to the elements shown in FIG. 7 according to the first embodiment.

In pixel $50C_{i,j}$, as shown in FIG. 20, resetting transistor $58_{3,2}$ and resetting signal line $R_2$ shown in FIG. 7 are dispensed with. Other details are identical to those shown in FIG. 7. Pixels $50C_{2,2}$, $50C_{4,2}$ and the like that are positioned adjacent to pixel $50C_{3,2}$ are of the same structure.

FIG. 21 is a timing chart showing the manner in which image display section $50C_{3,2}$ shown in FIG. 20 operates. A display control method for the image display apparatus shown in FIG. 19 will be described with reference to FIG. 21.

In non-selection period T1, selection transistor $53_{3,2}$ is turned off. When selection period T2 starts at time t1, selection transistor $53_{3,2}$ is turned on from off-state. At this time, voltage Vx input to signal line $X_3$ is 0 V which is the same as the ground level. Since selection transistor $53_{3,2}$ is turned on, charge of holding capacitor $54_{3,2}$ starts being discharged. Similarly, at the same time, charge of parasitic capacitor $57_{3,2}$ is discharged through pixel display element $56_{3,2}$. When a sufficient time elapses after selection period T2 starts, gate voltage VG and source voltage VS of drive transistor $55_{3,2}$ are brought to 0 V. Since gate-to-source voltage VGS of drive transistor $55_{3,2}$ is 0 V, no current flows between the drain and source of drive transistor $55_{3,2}$.

At time t2, voltage Vx of signal line $X_3$ changes from 0 V to VDATA, writing gradation pixel data D (pixel data writing process). Subsequently, the image display apparatus according to the third embodiment operates in the same manner as with the first embodiment, and offers the same advantages as with the first embodiment.

Fourth Embodiment

FIG. 22 is a block diagram of an electric arrangement of an image display apparatus according to a fourth embodiment of the present invention. Common reference characters are assigned to those elements in FIG. 22 which are common to the elements shown in FIG. 6 according to the first embodiment and the elements shown in FIG. 19 according to the third embodiment.

The image display apparatus according to the fourth embodiment has control circuit 60D having a new function added, display panel 50C which is the same as the display panel shown in FIG. 19, and power line voltage switching circuit 100, instead of control circuit 60, display panel 50, and resetting signal line driver 90 in the image display apparatus shown in FIG. 6. Control circuit 60D has a function to supply power line switching control signal VC to power line voltage switching circuit 100, in addition to the function of control circuit 60. Power line voltage switching circuit 100 switches the voltage supplied to power line 51 to power voltage Vcc or ground level (0 V) based on power line switching control signal VC.

FIG. 23 is a timing chart showing the manner in which image display section $50C_{3,2}$ (see FIG. 20) operates. A control method for the image display apparatus according to the present embodiment will be described with reference to FIG. 23.

In non-selection period T1, selection transistor $53_{3,2}$ is turned off. When selection period T2 starts at time t1, selection transistor $53_{3,2}$ is turned on from off-state. At this time, voltage Vx Input to signal line $X_3$ is a voltage large enough to turn on drive transistor $55_{3,2}$. At the same time, the voltage of power line 51 is brought to 0 V. Since drive transistor $55_{3,2}$ is turned on, charge of parasitic capacitor $57_{3,2}$ is discharged through this drive transistor $55_{3,2}$. After source voltage Vs of drive transistor $55_{3,2}$ becomes 0 V, voltage Vx Input to signal line $X_3$ becomes 0 V. As selection transistor $53_{3,2}$ is turned on, charge of holding capacitor $54_{3,2}$ is discharged, bringing gate voltage VG to 0 V at time t2. Thereafter since gate-to-source voltage VGS of drive transistor $55_{3,2}$ is 0 V, no current flows between the drain and source of this drive transistor $55_{3,2}$.

Next, at time t3, voltage Vx of signal line $X_3$ changes from 0 V to VDATA, writing gradation pixel data D (pixel data writing process). Subsequently, the image display apparatus according to the fourth embodiment operates in the same manner as with the first embodiment, and offers the same advantages as with the first embodiment.

Fifth Embodiment

Figure 24:
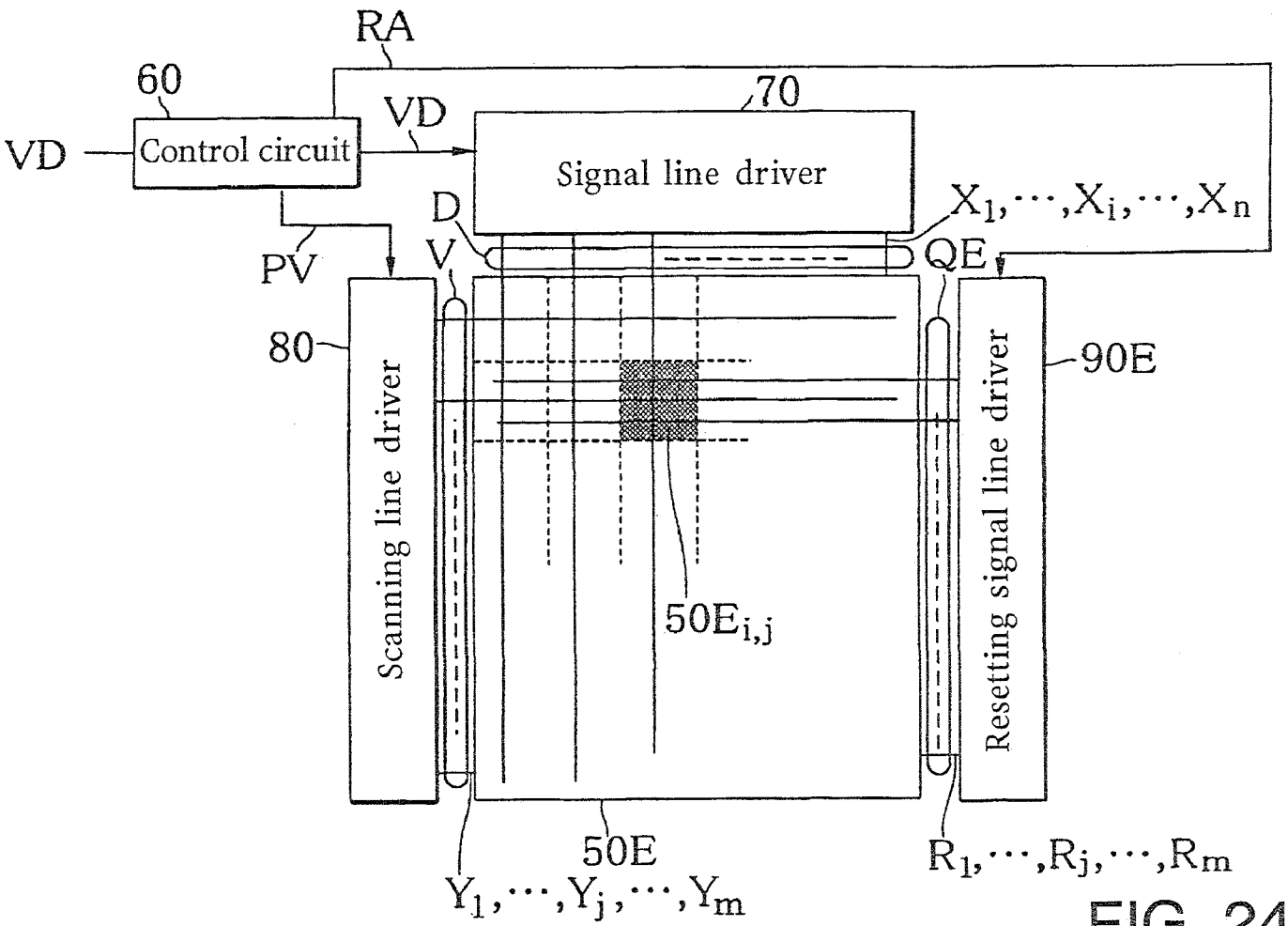
FIG. 24 is a block diagram of an electric arrangement of an image display apparatus according to a fifth embodiment of the present invention.

FIG. 24 is a block diagram of an electric arrangement of an image display apparatus according to a fifth embodiment of the present invention. Common reference characters are assigned to those elements in FIG. 24 which are common to the elements shown in FIG. 6 according to the first embodiment.

The image display apparatus according to the fifth embodiment has display panel 50E having a different arrangement and resetting signal line driver 90E having a different function, instead of display panel 50 and resetting signal line driver 90 in the image display apparatus shown in FIG. 6. Display panel 50E has pixels $50E_{i,j}$ having a different arrangement, instead of pixels $50_{i,j}$ shown in FIG. 6. Resetting signal line driver 90E applies resetting signals QE, which are of opposite phase to resetting signals Q, to resetting signal lines $R_1, \ldots, R_j, \ldots, R_m$, based on resetting control signal RA. In display panel 50E, resetting signals QE are applied to resetting signal lines $R_1, \ldots, R_j, \ldots, R_m$.

Figure 25:
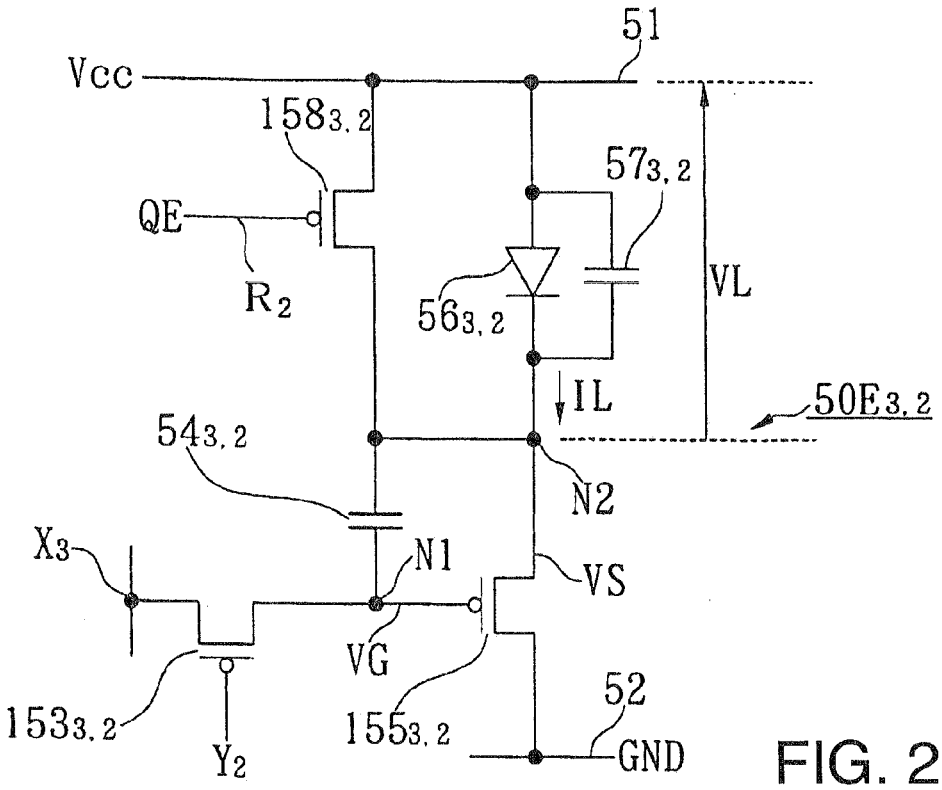
FIG. 25 is a diagram of an electric arrangement of a pixel in the image display apparatus shown in FIG. 24.

FIG. 25 is a circuit diagram of an electric arrangement of pixel $50E_{i,j}$ (e.g., i=3, j=2) in the image display apparatus shown in FIG. 24. Common reference characters are assigned to those elements in FIG. 25 which are common to the elements shown in FIG. 7 according to the first embodiment.

As shown in FIG. 25, pixel $50E_{i,j}$ comprises power line 51, ground line 52, selection transistor $153_{3,2}$, holding capacitor $54_{3,2}$, drive transistor $155_{3,2}$, pixel display element $56_{3,2}$, parasitic capacitor $57_{3,2}$, and resetting transistor $158_{3,2}$. Power line 51 is supplied with power voltage Vcc with respect to ground line 52. Selection transistor $153_{3,2}$ has a drain electrode connected to signal line $X_3$, a source electrode to node N1, and a gate electrode to scanning line $Y_2$. Selection transistor $153_{3,2}$ performs on/off control of a conduction state between signal line $X_3$ and node N1 based on scanning signal V.

Holding capacitor $54_{3,2}$ is connected between node N1 and node N2, and holds the voltage between the source and gate electrodes of drive transistor $155_{3,2}$. Drive transistor $155_{3,2}$ has a source electrode connected to node N2, a drain electrode to ground line 52, and a gate electrode to node N1. Drive transistor $155_{3,2}$ passes output current IL, which is controlled based on the voltage between the source and gate electrodes thereof, from node N2 to ground line 52. Pixel display element $56_{3,2}$ has an anode connected to power line 51 and a cathode to node N2, with parasitic capacitor $57_{3,2}$ between the anode and cathode thereof. Pixel display element $56_{3,2}$ displays a pixel with a gradation based on output current IL from drive transistor $155_{3,2}$. Resetting transistor $158_{3,2}$ has a source electrode to power line 51, a drain electrode to node N2, and a gate electrode to resetting signal line $R_2$. Resetting transistor $158_{3,2}$ performs on/off control of a conduction state between node N2 and power line 51 based on resetting signal QE. Other pixels $50_{i,j}$ are also of the same arrangement.

In the image display apparatus according to the present embodiment, selection transistor $153_{3,2}$, drive transistor $155_{3,2}$, and resetting transistor $158_{3,2}$ operate complementarily to selection transistor $53_{3,2}$, drive transistor $55_{3,2}$, and resetting transistor $58_{3,2}$ in the image display apparatus shown in FIG. 7 according to the first embodiment. Since the image display apparatus according to the present embodiment operates in the same manner as with the first embodiment, it offers the same advantages as with the first embodiment.

Sixth Embodiment

Figure 26:
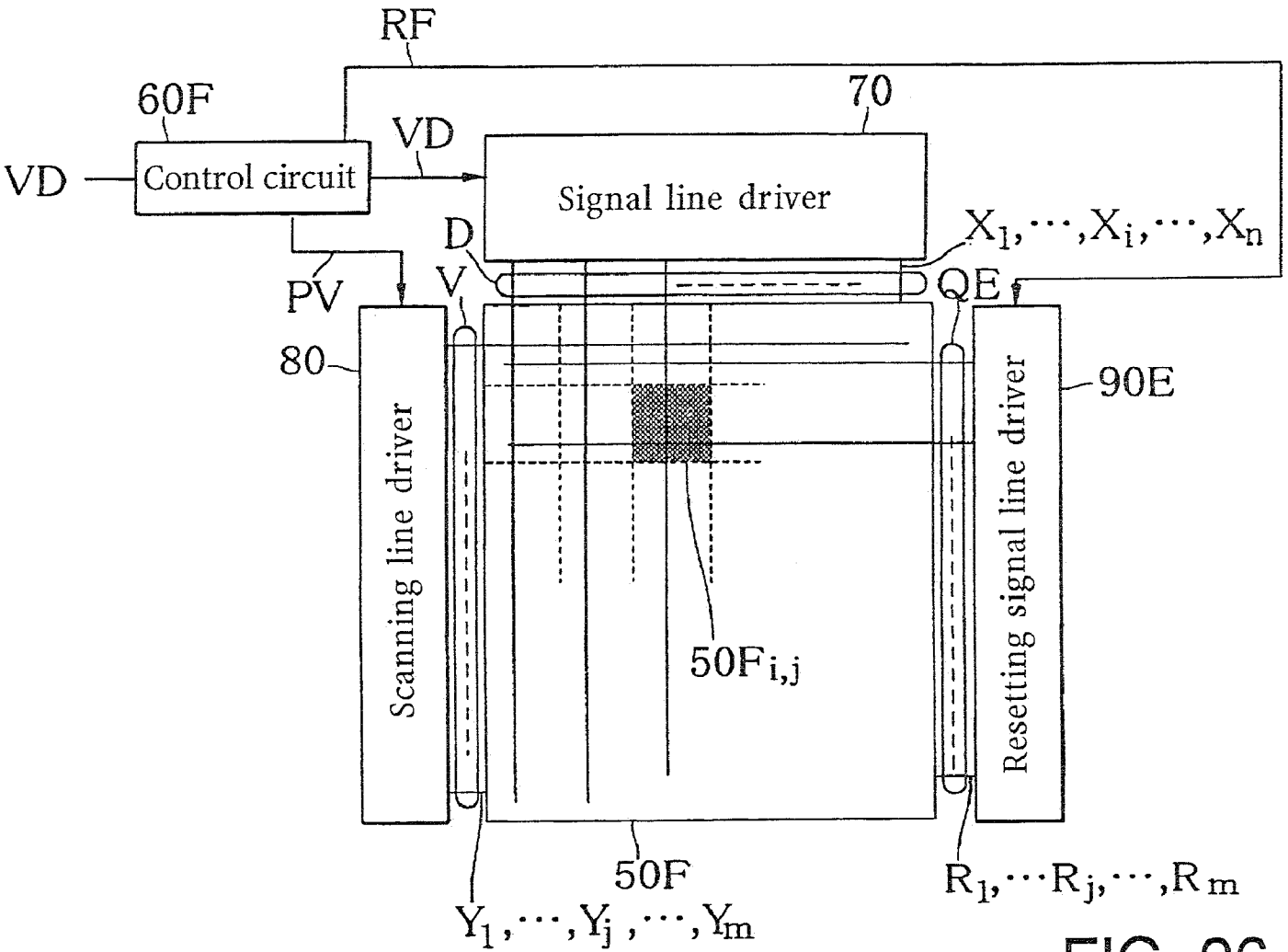
FIG. 26 is a block diagram of an electric arrangement of an image display apparatus according to a sixth embodiment of the present invention.

FIG. 26 is a block diagram of an electric arrangement of an image display apparatus according to a sixth embodiment of the present invention. Common reference characters are assigned to those elements in FIG. 26 which are common to the elements shown in FIG. 24 according to the fifth embodiment.

The image display apparatus according to the sixth embodiment has control circuit 60F having a different function and display panel 50F having a different arrangement, instead of control circuit 60 and display panel 50E in the image display apparatus shown in FIG. 24. Control circuit 60F supplies resetting control signal RF having a different timing from resetting control signal RA shown in FIG. 24 to resetting signal line driver 90E. Display panel 50F has pixels $\mathbf{50}F_{i,j}$ having a different arrangement, instead of pixels $\mathbf{50}E_{i,j}$ in the image display apparatus shown in FIG. 24. Other details are identical to those shown in FIG. 24.

Figure 27:
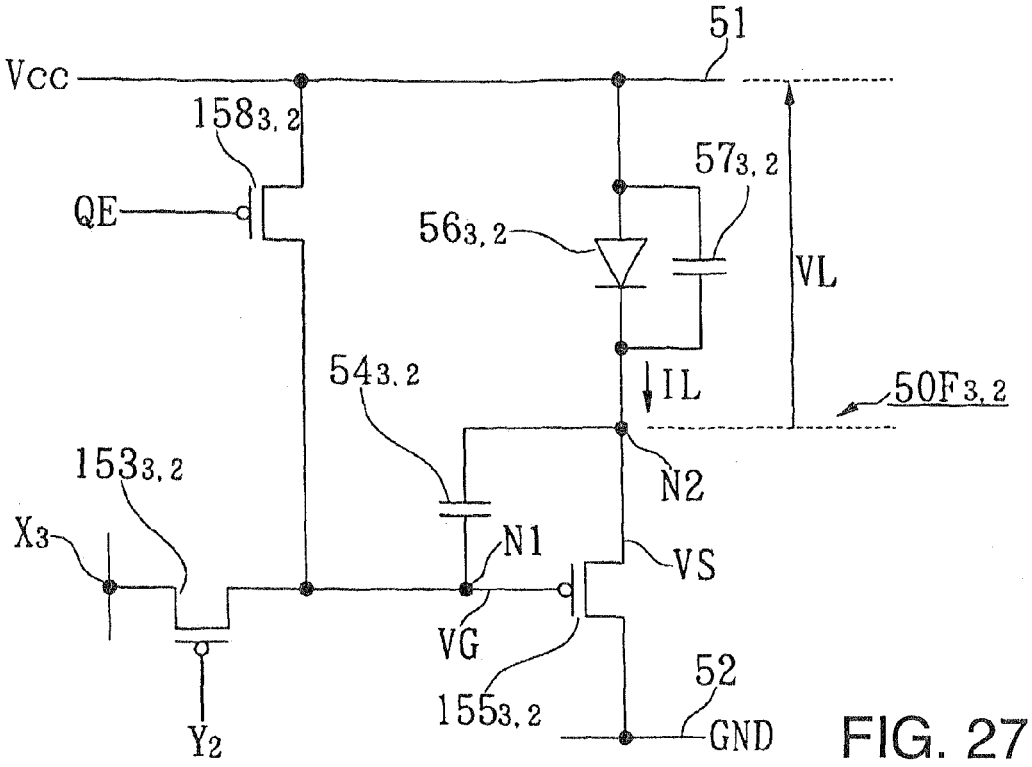
FIG. 27 is a diagram of an electric arrangement of a pixel in the image display apparatus shown in FIG. 26.

FIG. 27 is a circuit diagram of an electric arrangement of pixel $\mathbf{50}F_{i,j}$ (e.g., i=3, j=2) in the image display apparatus shown in FIG. 26. Common reference characters are assigned to those elements in FIG. 27 which are common to the elements shown in FIG. 25 according to the fifth embodiment.

In pixel $\mathbf{50}F_{i,j}$, as shown in FIG. 27, resetting transistor $\mathbf{158}_{3,2}$ has a drain electrode connected to node N1, and performs on/off control of a conduction state between node N1 and power line 51 based on resetting signal QE. Other details are identical to those of the pixel shown in FIG. 25. Pixels $\mathbf{50}F_{2,2}$, $\mathbf{50}F_{4,2}$ and the like (not shown) that are positioned adjacent to pixel $\mathbf{50}F_{3,2}$ are of the same structure.

In this image display apparatus, selection transistor $\mathbf{153}_{3,2}$, drive transistor $\mathbf{155}_{3,2}$, and resetting transistor $\mathbf{158}_{3,2}$ operate complementarily to selection transistor $\mathbf{53}_{3,2}$, drive transistor $\mathbf{55}_{3,2}$, and resetting transistor $\mathbf{58}_{3,2}$. In the image display apparatus shown in FIG. 17 according to the second embodiment. Since the image display apparatus according to the present embodiment operates in the same manner as with the second embodiment, it offers the same advantages as with the second embodiment.

Seventh Embodiment

Figure 28:
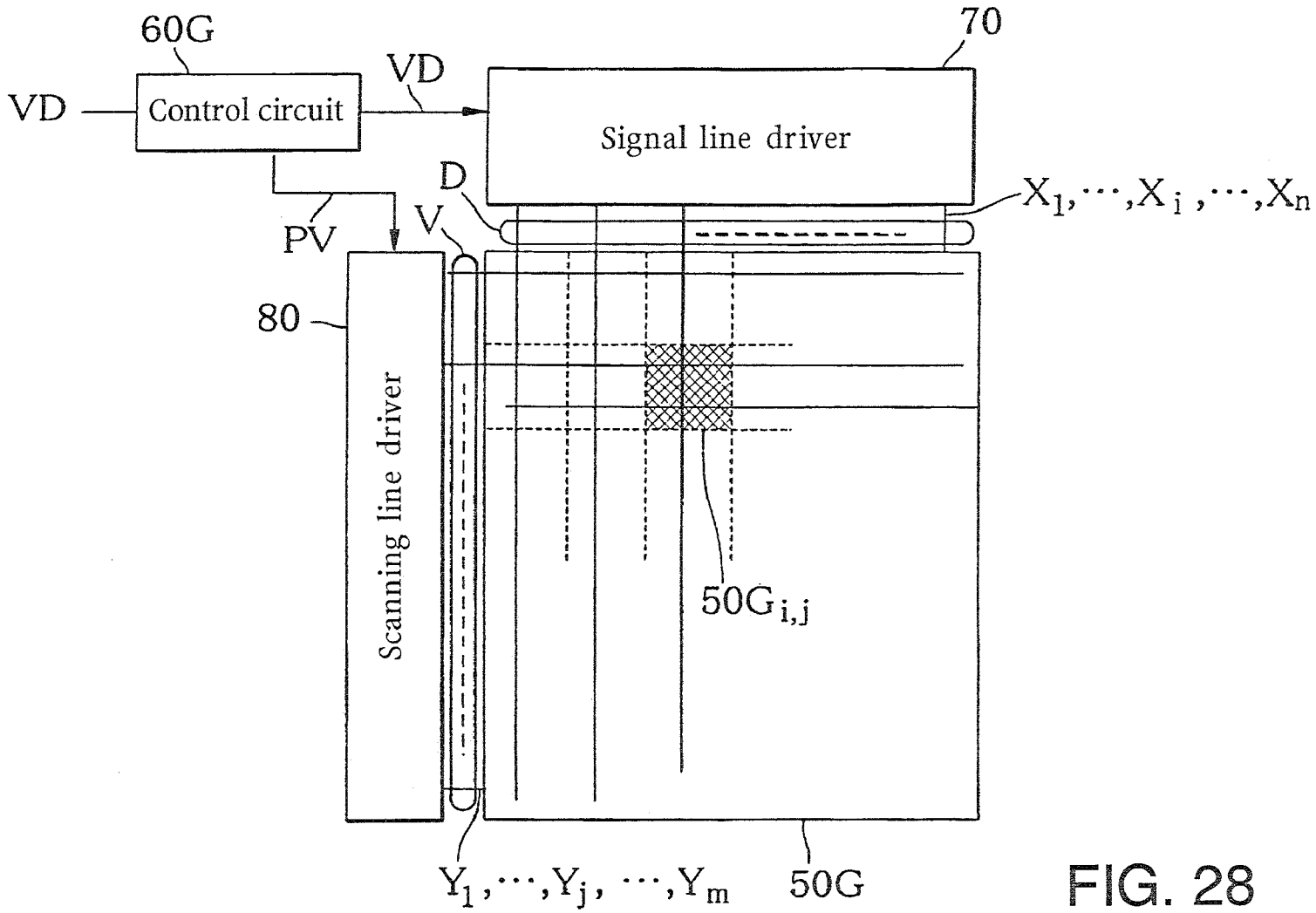
FIG. 28 is a block diagram of an electric arrangement of an image display apparatus according to a seventh embodiment of the present invention.

FIG. 28 is a block diagram of an electric arrangement of an image display apparatus according to a seventh embodiment of the present invention. Common reference characters are assigned to those elements in FIG. 28 which are common to the elements shown in FIG. 24 according to the fifth embodiment.

The image display apparatus according to the seventh embodiment has control circuit 60G having a different function and display panel 50G having a different arrangement, instead of control circuit 60 and display panel 50E in the image display apparatus shown in FIG. 24. Resetting signal line driver 90E shown in FIG. 24 is dispensed with. Control circuit 60G supplies image input signal VD having a different timing from control circuit 60 to signal line driver 70. Display panel 50G has pixels $\mathbf{50}G_{i,j}$ having a different arrangement, instead of pixels $\mathbf{50}E_{i,j}$ shown in FIG. 24. Other details are identical to those of the image display apparatus shown in FIG. 24.

Figure 29:
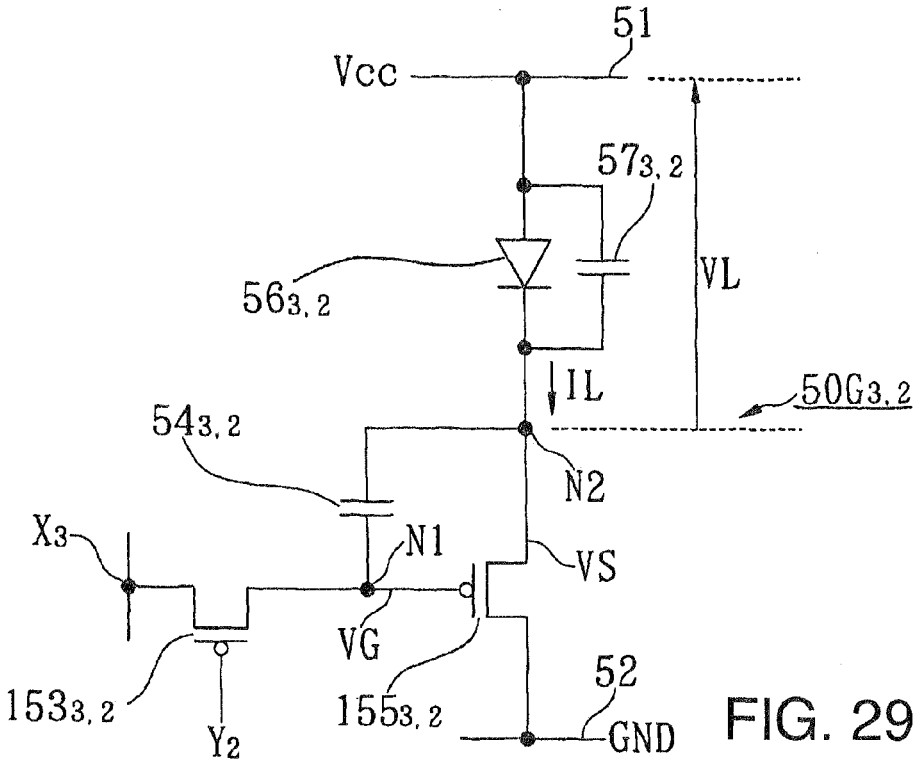
FIG. 29 is a diagram of an electric arrangement of a pixel in the image display apparatus shown in FIG. 28.

FIG. 29 is a circuit diagram of an electric arrangement of pixel $\mathbf{50}G_{i,j}$ (e.g., i=3, j=2) in the image display apparatus shown in FIG. 28. Common reference characters are assigned to those elements in FIG. 29 which are common to the elements shown in FIG. 25 according to the fifth embodiment.

In pixel $\mathbf{50}CG_{i,j}$, as shown in FIG. 29, resetting transistor $\mathbf{158}_{3,2}$ and resetting signal line $R_2$ shown in FIG. 25 are dispensed with. Other details are identical to those shown in FIG. 25. Pixels $\mathbf{50}G_{2,2}$, $\mathbf{50}G_{4,2}$ and the like that are positioned adjacent to pixel $\mathbf{50}G_{3,2}$ are of the same structure.

In this image display apparatus, selection transistor $\mathbf{153}_{3,2}$ and drive transistor $\mathbf{155}_{3,2}$ operate complementarily to selection transistor $\mathbf{53}_{3,2}$ and drive transistor $\mathbf{55}_{3,2}$. In the image display apparatus shown in FIG. 20 according to the third embodiment. Since the image display apparatus according to the present embodiment operates in the same manner as with the third embodiment, it offers the same advantages as with the third embodiment.

Eighth Embodiment

Figure 30:
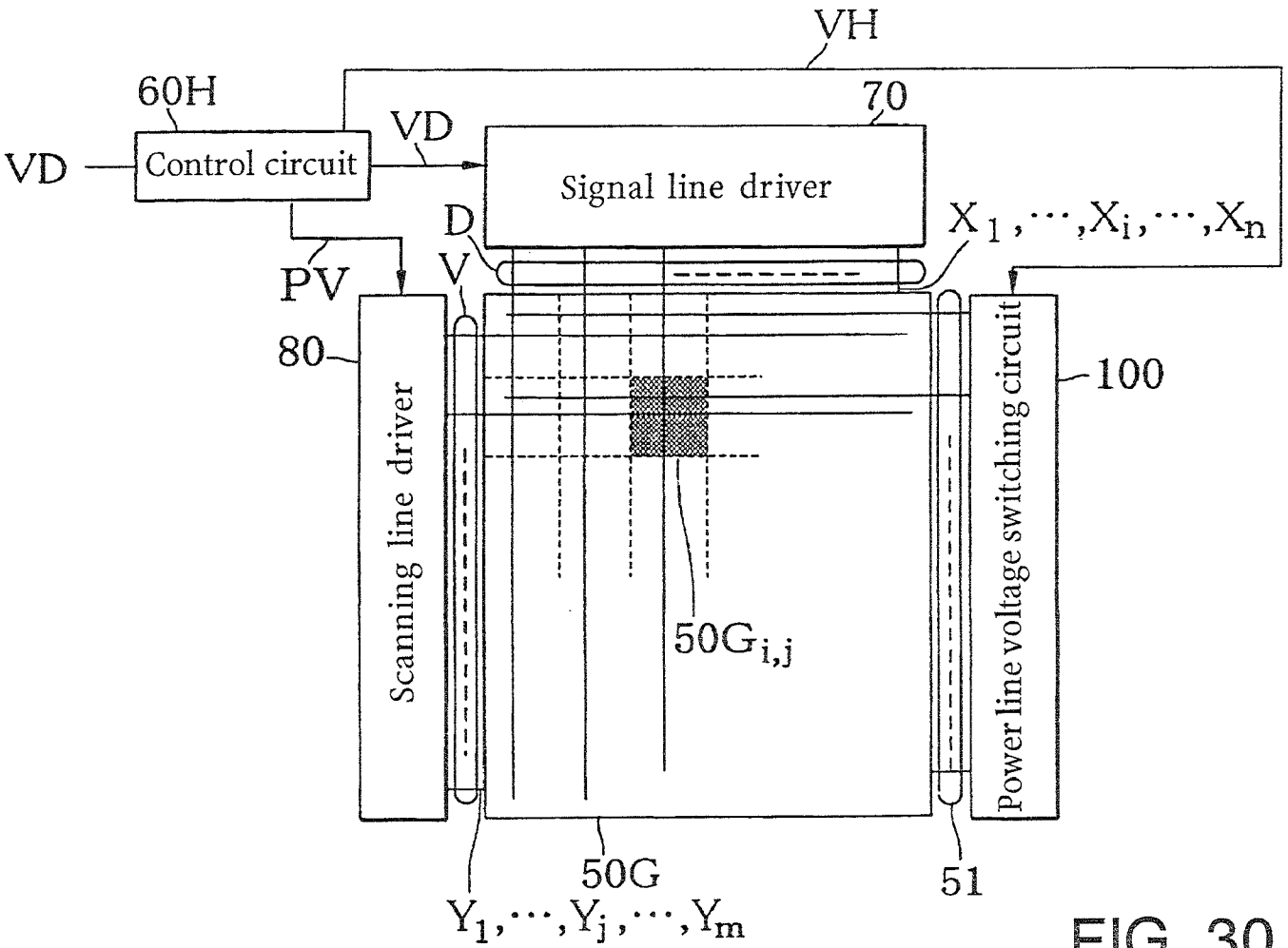
FIG. 30 is a block diagram of an electric arrangement of an image display apparatus according to an eighth embodiment of the present invention.

FIG. 30 is a block diagram of an electric arrangement of an image display apparatus according to an eighth embodiment of the present invention. Common reference characters are assigned to those elements in FIG. 30 which are common to the elements shown in FIG. 22 according to the fourth embodiment, the elements shown in FIG. 24 according to the fifth embodiment, and the elements shown in FIG. 28 according to the seventh embodiment.

The image display apparatus according to the eighth embodiment has control circuit 60H having a new function added, display panel 50G which is the same as the display panel shown in FIG. 28, and power line voltage switching circuit 100 which is the same as the power line voltage switching circuit shown in FIG. 22, instead of control circuit 80, display panel 50E, and resetting signal line driver 90E in the image display apparatus shown in FIG. 24. Control circuit 60H has a function to supply power line switching control signal VH to power line voltage switching circuit 100, in addition to the function of control circuit 60. Power line voltage switching circuit 100 switches the voltage supplied to power line 51 to power voltage Vcc or ground level (0 V) based on power line switching control signal VH.

In this image display apparatus, selection transistor $\mathbf{153}_{3,2}$ and drive transistor $\mathbf{155}_{3,2}$ operate complementarily to selection transistor $\mathbf{53}_{3,2}$ and drive transistor $\mathbf{55}_{3,2}$ in the image display apparatus according to the fourth embodiment. Since the image display apparatus according to the present embodiment operates in the same manner as with the fourth embodiment, it offers the same advantages as with the fourth embodiment.

Ninth Embodiment

Figure 31:
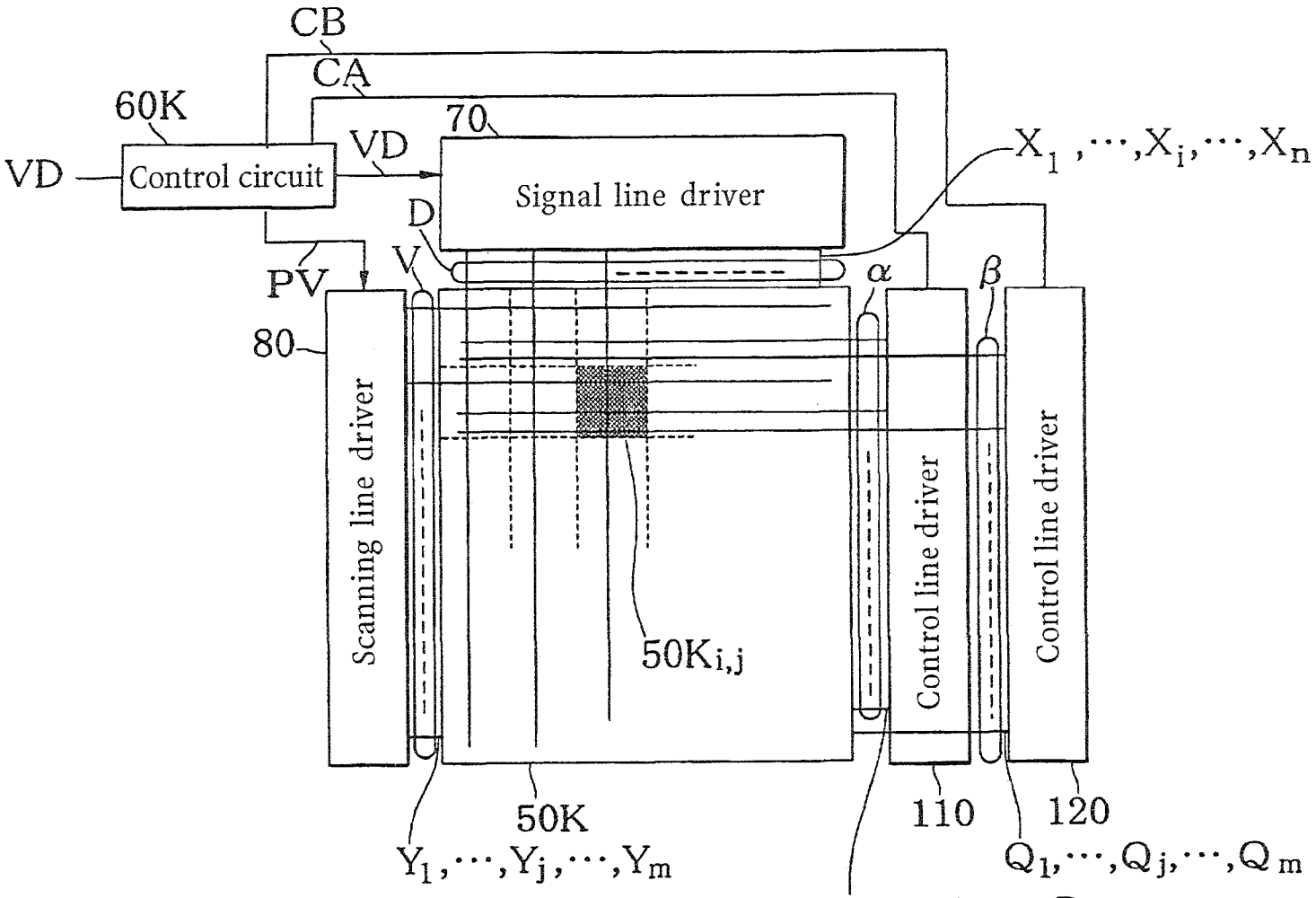
FIG. 31 is a block diagram of an electric arrangement of an image display apparatus according to a ninth embodiment of the present invention.

FIG. 31 is a block diagram of an electric arrangement of an image display apparatus according to a ninth embodiment of the present invention. Common reference characters are assigned to those elements in FIG. 31 which are common to the elements shown in FIG. 8 according to the first embodiment.

The image display apparatus according to the ninth embodiment has control circuit 60K having a new function added, display panel 50K having a different arrangement, and control line drivers 110, 120, instead of control circuit 60, display panel 50, and resetting signal line driver 90 in the image display apparatus shown in FIG. 6. Control circuit 60K has a function to supply control signals CA, CB to control line drivers 110, 120, respectively, in addition to the function of control circuit 60. Display panel 50K has pixels $\mathbf{50}K_{i,j}$ having a different arrangement, instead of pixels $\mathbf{50}_{i,j}$ shown in FIG. 6, and also has control lines $P_1, \ldots, P_j, \ldots, P_m$ and control lines $Q_1, \ldots, Q_j, \ldots, Q_m$. Control line driver 110 applies control line drive signals a to control lines $P_1, \ldots, P_j, \ldots, P_m$, based on control signal CA. Control line driver 120 applies control line drive signals β to control lines $Q_1, \ldots, Q_j, \ldots, Q_m$ based on control signal CB.

Figure 32:
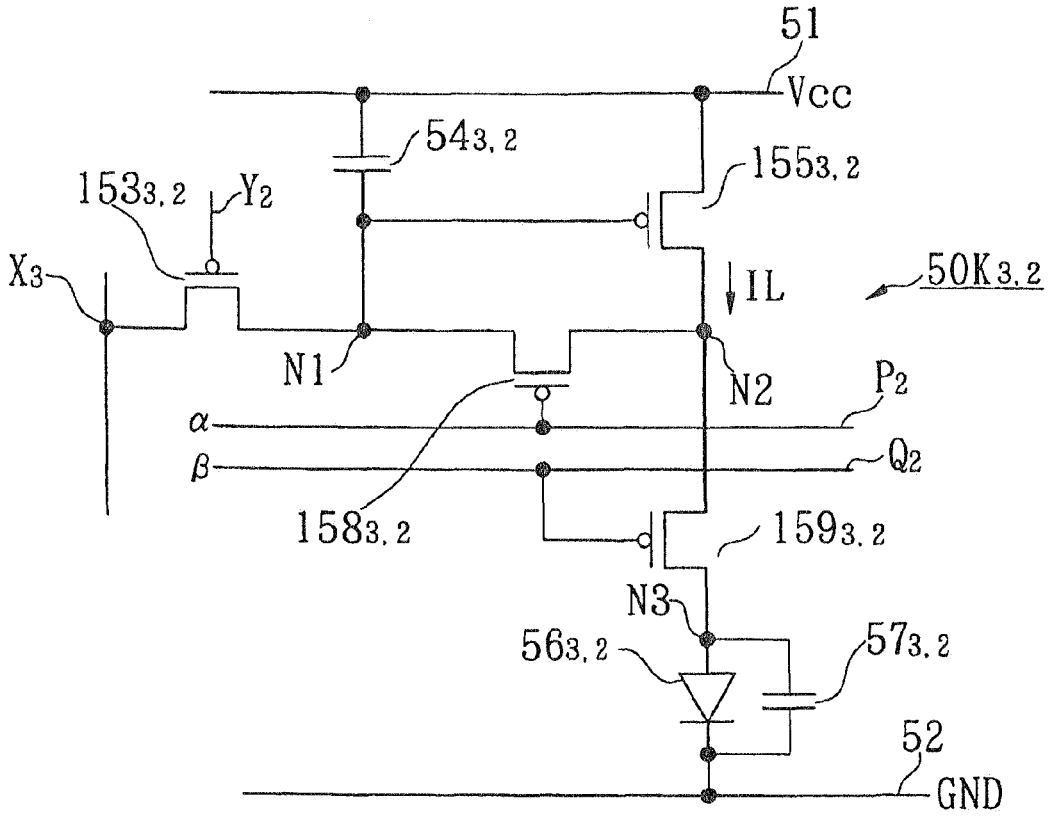
FIG. 32 is a diagram of an electric arrangement of a pixel in the image display apparatus shown in FIG. 31.

FIG. 32 is a circuit diagram of an electric arrangement of pixel $\mathbf{50}K_{i,j}$ (e.g., i=3, j=2) in the image display apparatus shown in FIG. 31. Common reference characters are assigned to those elements in FIG. 32 which are common to the elements shown in FIG. 7 according to the first embodiment.

As shown in FIG. 32, pixel $\mathbf{50}K_{i,j}$ comprises power line 51, ground line 52, selection transistor $\mathbf{153}_{3,2}$, holding capacitor $\mathbf{54}_{3,2}$, drive transistor $\mathbf{155}_{3,2}$, pixel display element $\mathbf{56}_{3,2}$, parasitic capacitor $\mathbf{57}_{3,2}$, control transistor $\mathbf{158}_{3,2}$, and pMOS $\mathbf{159}_{3,2}$. Selection transistor $\mathbf{153}_{3,2}$ has a drain electrode connected to signal line $X_3$, a source electrode to node N1, and a gate electrode to scanning line $Y_2$. Selection transistor $\mathbf{153}_{3,2}$ performs on/off control of a conduction state between signal line $X_3$ and node N1 based on scanning signal V. Holding capacitor $\mathbf{54}_{3,2}$ is connected between node N1 and power line 51 (power source voltage Vcc), and holds the voltage between the source and gate electrodes of drive transistor $\mathbf{155}_{3,2}$.

Drive transistor $\mathbf{155}_{3,2}$ has a source electrode connected to power line 51, a drain electrode to node N2, and a gate electrode to node N1. Drive transistor $\mathbf{155}_{3,2}$ passes output current IL, which is controlled based on the voltage between the source and gate electrodes thereof, from power line 51 to node N1. Pixel display element $\mathbf{56}_{3,2}$ has parasitic capacitor $\mathbf{57}_{3,2}$, and also has an anode connected to node N3 and a cathode to ground line 52. Pixel display element $\mathbf{56}_{3,2}$ displays a pixel with a gradation based on output current IL by drawing output current IL from drive transistor $\mathbf{155}_{3,2}$ through pMOS $\mathbf{159}_{3,2}$ and passing output current IL to ground line 52. Control transistor $\mathbf{158}_{3,2}$ has a source electrode connected to node N1, a drain electrode to node N2, and a gate electrode to control line $P_2$, and performs on/off control of a conduction state between node N1 and node N2 based on control line drive signal α. pMOS $\mathbf{159}_{3,2}$ has a source electrode connected to node N2, a drain electrode to node N3, and a gate electrode to control line $Q_2$, and performs on/off control of a conduction state between node N2 and node N3 based on control line drive signal β. Other pixels $\mathbf{50}K_{i,j}$ and the like are also of the same arrangement.

Figure 33:
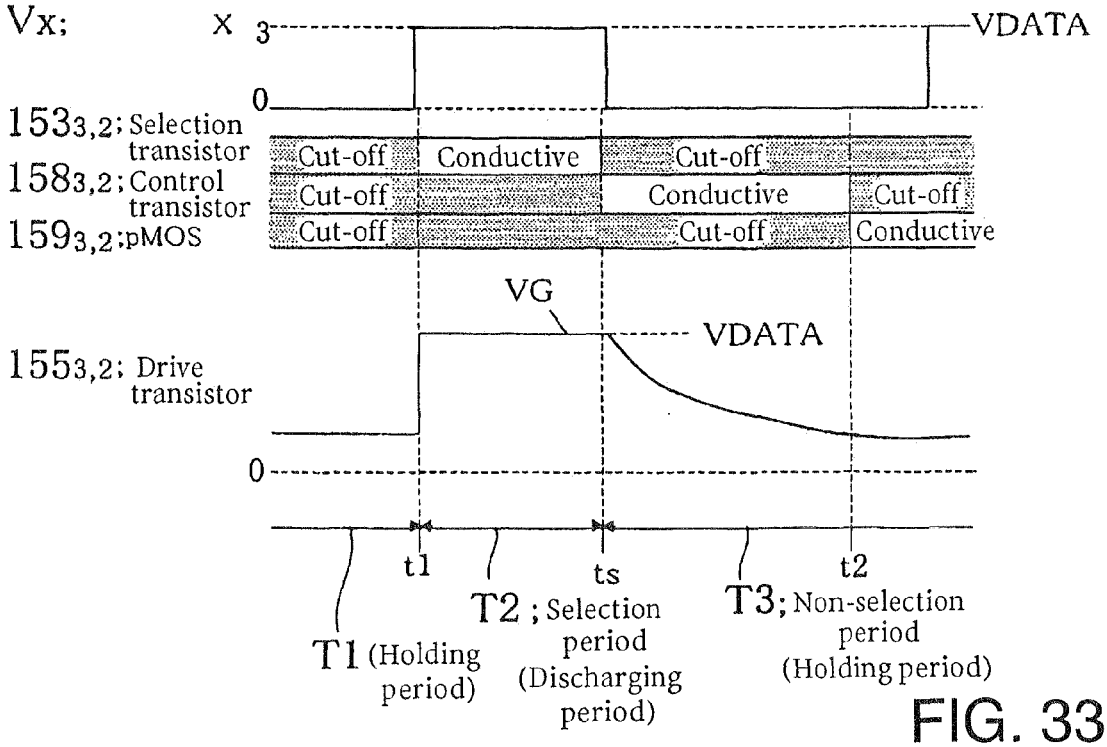
FIG. 33 is a timing chart showing the manner in which an image display section operates.
Figure 34:
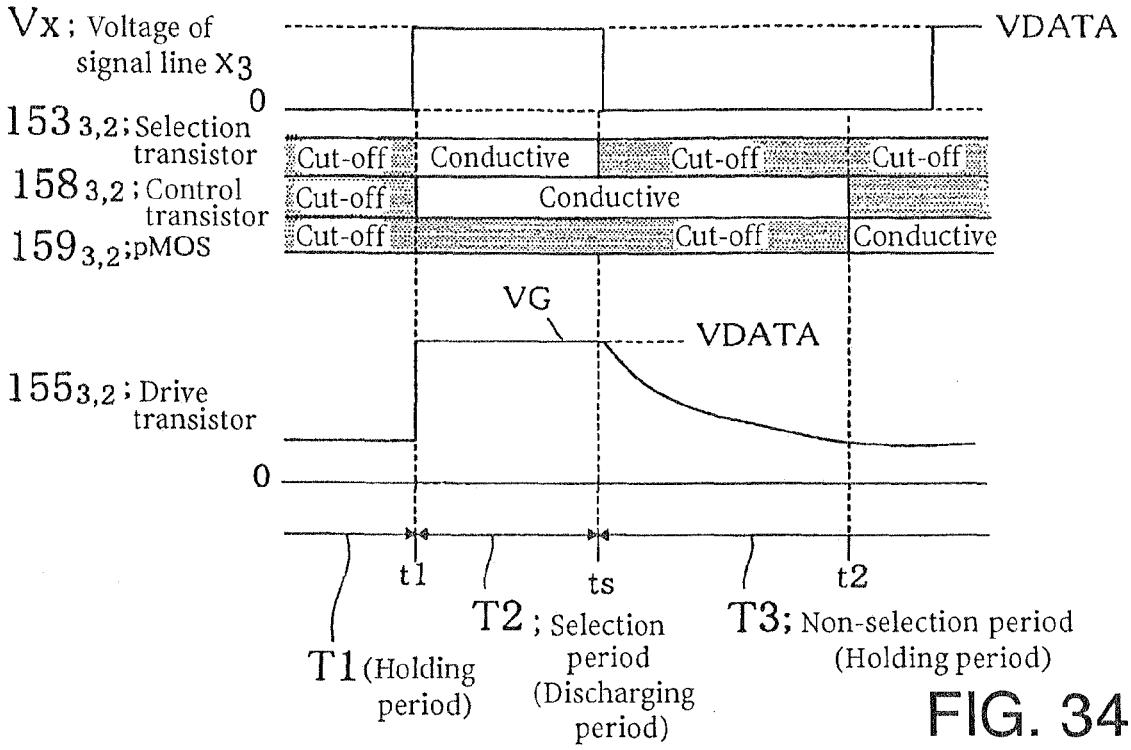
FIG. 34 is a timing chart showing the manner in which an image display section operates.

FIGS. 33 and 34 are timing charts showing the manner in which image display section $\mathbf{50}K_{3,2}$ shown in FIG. 32 operates. A display control method for the image display apparatus according to the present embodiment will be described with reference to these drawings.

As shown in FIG. 33, during a holding period T1, selection transistor $\mathbf{153}_{3,2}$, drive transistor $\mathbf{155}_{3,2}$, control transistor $\mathbf{158}_{3,2}$, and pMOS $\mathbf{159}_{3,2}$ are turned off. When selection period T2 starts at time t1, scanning signal V is applied to scanning line $Y_2$ to turn on selection transistor $\mathbf{153}_{3,2}$ from off-state, and signal charges of gradation pixel data D from signal line $X_3$ are stored in holding capacitor $\mathbf{54}_{3,2}$ (pixel data writing process).

At time ts, selection transistor $\mathbf{153}_{3,2}$ is turned off and control transistor $\mathbf{158}_{3,2}$ is turned on, starting to discharge the charge of holding capacitor $\mathbf{54}_{3,2}$ through control transistor $\mathbf{158}_{3,2}$ and drive transistor $\mathbf{155}_{3,2}$. After the discharging for a certain period of time, control transistor $\mathbf{158}_{3,2}$ is turned off and pMOS $\mathbf{159}_{3,2}$ is turned on at time t2 (discharging process). Since gate-to-source voltage VGS of drive transistor $\mathbf{155}_{3,2}$ is held by holding capacitor $\mathbf{54}_{3,2}$ (pixel data holding process), constant current IL keeps flowing through pixel display element $\mathbf{56}_{3,2}$. Subsequently, as with the first embodiment, variations of currents flowing through pixel display elements $\mathbf{56}_{2,2}$, $\mathbf{56}_{3,2}$, $\mathbf{56}_{4,2}$ are reduced, and so are variations of luminance gradations displayed by pixel display elements $\mathbf{56}_{2,2}$, $\mathbf{56}_{3,2}$, $\mathbf{56}_{4,2}$, resulting in an increased quality level of the displayed image.

Further, as shown in FIG. 34, during selection period T2, control transistor $\mathbf{158}_{3,2}$ is turned on, writing signal charges of gradation pixel data D from signal line $X_3$ in holding capacitor $\mathbf{54}_{3,2}$ while the drain and gate electrodes of drive transistor $\mathbf{155}_{3,2}$ are being connected (pixel data writing process). Thereafter, at time ts, selection transistor $\mathbf{153}_{3,2}$ is turned off, starting to discharge the charge of holding capacitor $\mathbf{54}_{3,2}$ through control transistor $\mathbf{158}_{3,2}$ and drive transistor $\mathbf{155}_{3,2}$. After the discharging for a certain period of time, control transistor $\mathbf{158}_{3,2}$ is turned off and pMOS $\mathbf{159}_{3,2}$ is turned on at time t2 (discharging process). Since gate-to-source voltage VGS of drive transistor $\mathbf{155}_{3,2}$ is held by holding capacitor $\mathbf{54}_{3,2}$ (pixel data holding process), constant current IL keeps flowing through pixel display element $\mathbf{56}_{3,2}$. Subsequently, as with the first embodiment, variations of currents flowing through pixel display elements $\mathbf{56}_{2,2}$, $\mathbf{56}_{3,2}$, $\mathbf{56}_{4,2}$ are reduced, and so are variations of luminance gradations displayed by these pixel display elements $\mathbf{56}_{2,2}$, $\mathbf{56}_{3,2}$, $\mathbf{56}_{4,2}$, resulting in an increased quality level of the displayed image.

Tenth Embodiment

Figure 35:
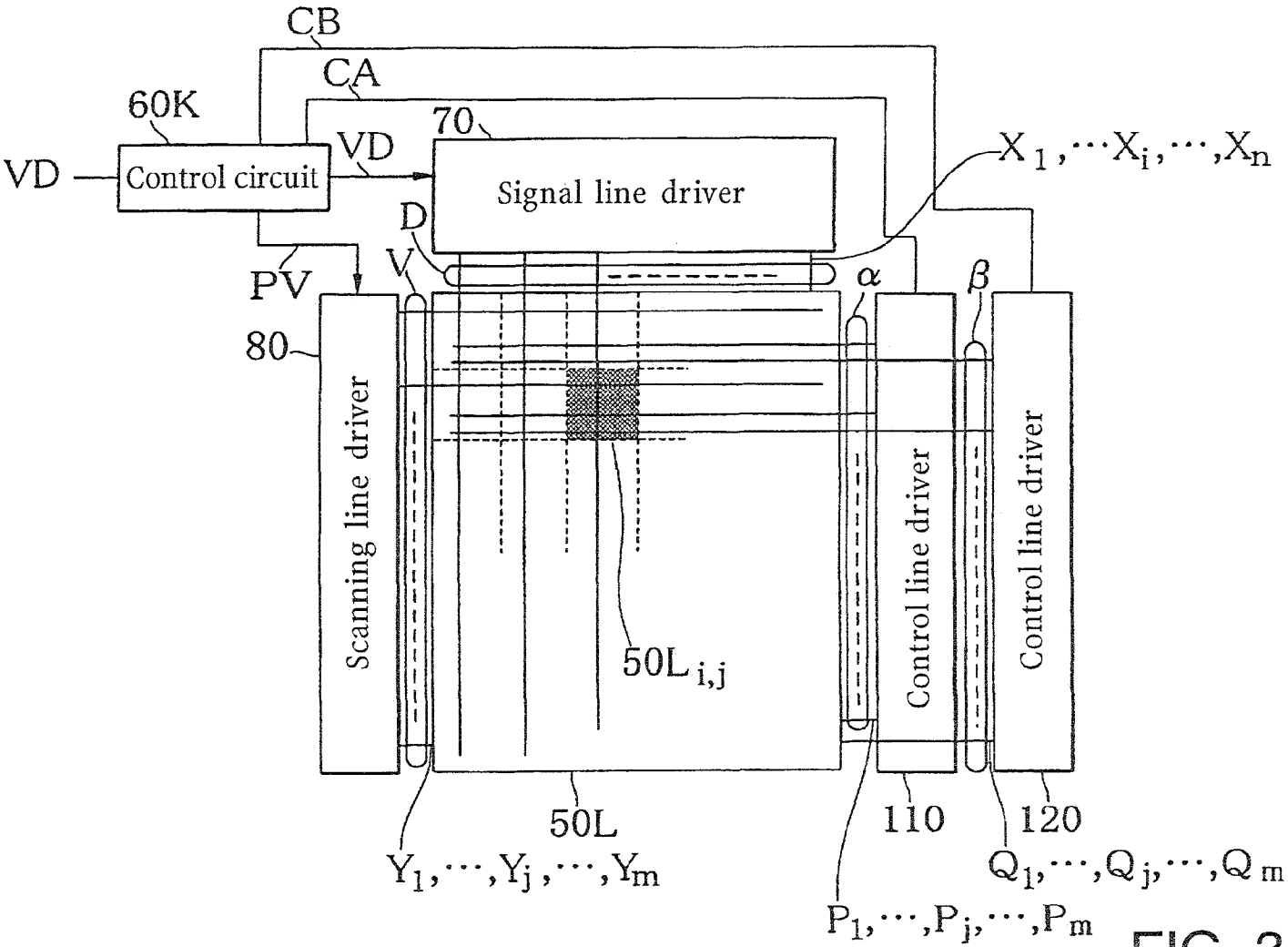
FIG. 35 is a block diagram of an electric arrangement of an image display apparatus according to a tenth embodiment of the present invention.

FIG. 35 is a block diagram of an electric arrangement of an image display apparatus according to a tenth embodiment of the present invention. Common reference characters are assigned to those elements in FIG. 35 which are common to the elements shown in FIG. 31 according to the ninth embodiment.

The image display apparatus according to the tenth embodiment has display panel 50L having a different arrangement, instead of display panel 50K in the image display apparatus shown in FIG. 31. Display panel 50L has pixels $\mathbf{50}L_{i,j}$ having a different arrangement, instead of pixels $\mathbf{50}K_{i,j}$ shown in FIG. 31.

Figure 36:
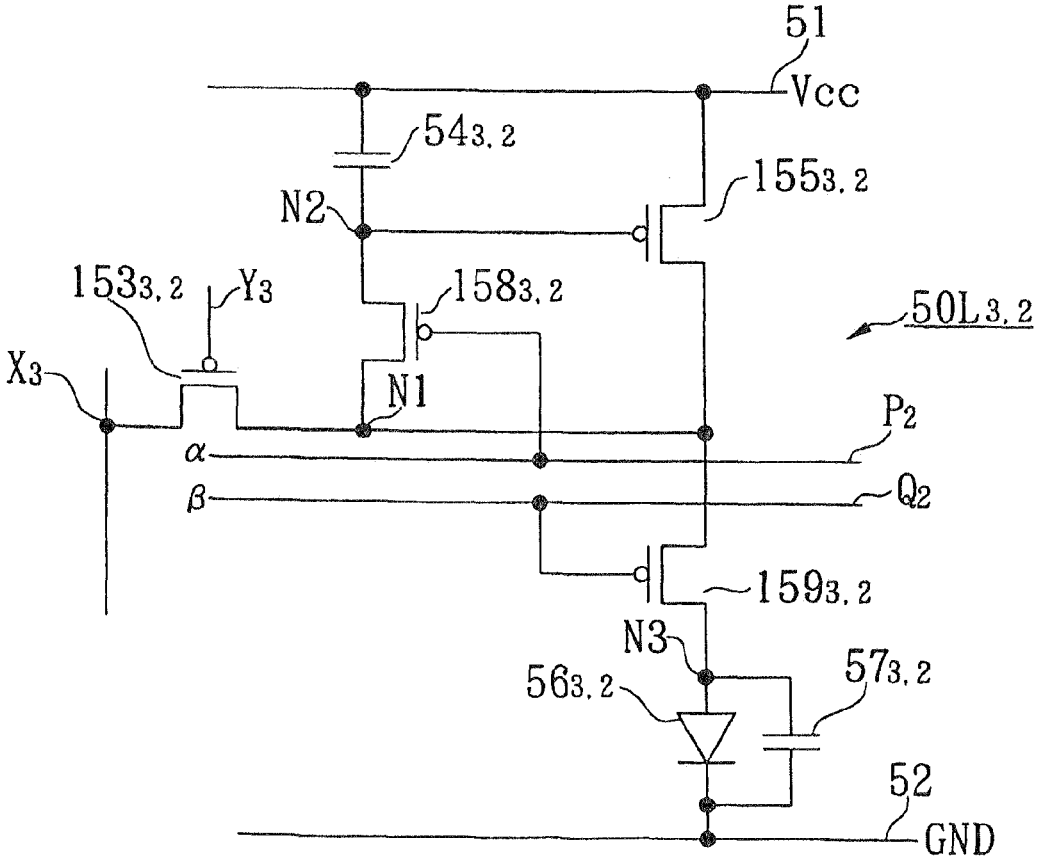
FIG. 36 is a diagram of an electric arrangement of a pixel in the image display apparatus shown in FIG. 35.

FIG. 36 is a circuit diagram of an electric arrangement of pixel $\mathbf{50}L_{i,j}$ (e.g., i=3, j=2) in the image display apparatus shown in FIG. 35. Common reference characters are assigned to those elements in FIG. 36 which are common to the elements shown in FIG. 32 according to the ninth embodiment.

In pixel $\mathbf{50}L_{3,2}$, as shown in FIG. 36, control transistor $\mathbf{158}_{3,2}$ has a drain electrode connected to node N2, and drive transistor $\mathbf{155}_{3,2}$ has a gate electrode connected to same node N2. Control transistor $\mathbf{158}_{3,2}$ has a source electrode connected to node N1, and drive transistor $\mathbf{155}_{3,2}$ has a drain electrode connected to same node N1. Control transistor $\mathbf{158}_{3,2}$ performs on/and control of a conduction state between node N1 and node N2 based on control line drive signal α. Other details are identical to those shown in FIG. 32.

This image display apparatus operates in the same manner as the image display apparatus shown in FIG. 34 according to the ninth embodiment, and offers the same advantages as the image display apparatus according to the ninth embodiment.

Eleventh Embodiment

Figure 37:
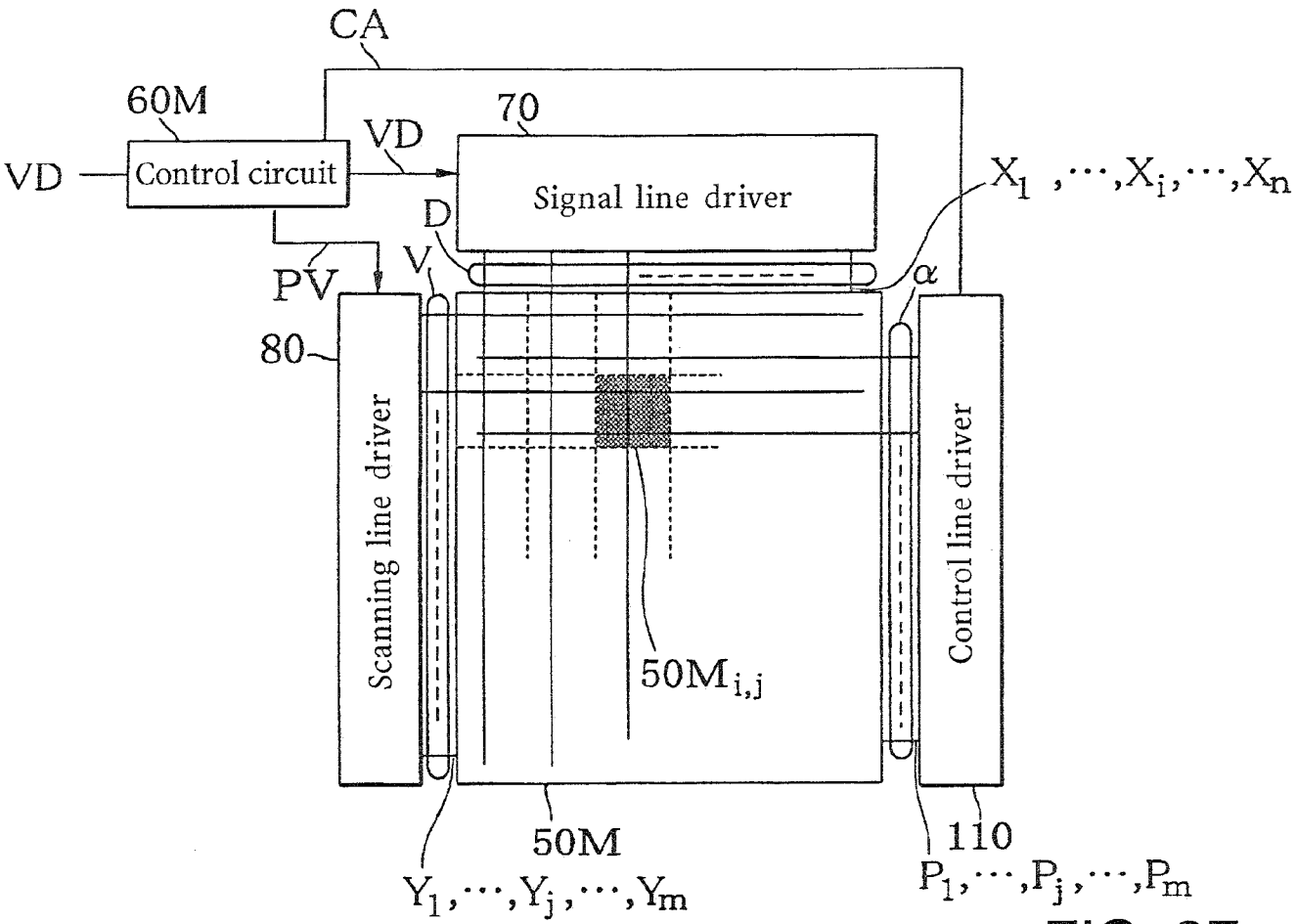
FIG. 37 is a block diagram of an electric arrangement of an image display apparatus according to an eleventh embodiment of the present invention.

FIG. 37 is a block diagram of an electric arrangement of an image display apparatus according to an eleventh embodiment of the present invention. Common reference characters are assigned to those elements in FIG. 37 which are common to the elements shown in FIG. 31 according to the ninth embodiment.

The image display apparatus according to the eleventh embodiment has control circuit 60M having a different function and display panel 60M having a different arrangement, instead of control circuit 60K and display panel 50K in the image display apparatus shown in FIG. 31. Control line driver 120 is dispensed with. In control circuit 60M, the function of control circuit 60K to output control signal CB is dispensed with. Display panel 50M has pixels $\mathbf{50}M_{i,j}$ having a different arrangement, instead of pixels $\mathbf{50}K_{i,j}$ shown in FIG. 31, and control lines $Q_1, \ldots, Q_j, \ldots, Q_m$ are dispensed with.

Figure 38:
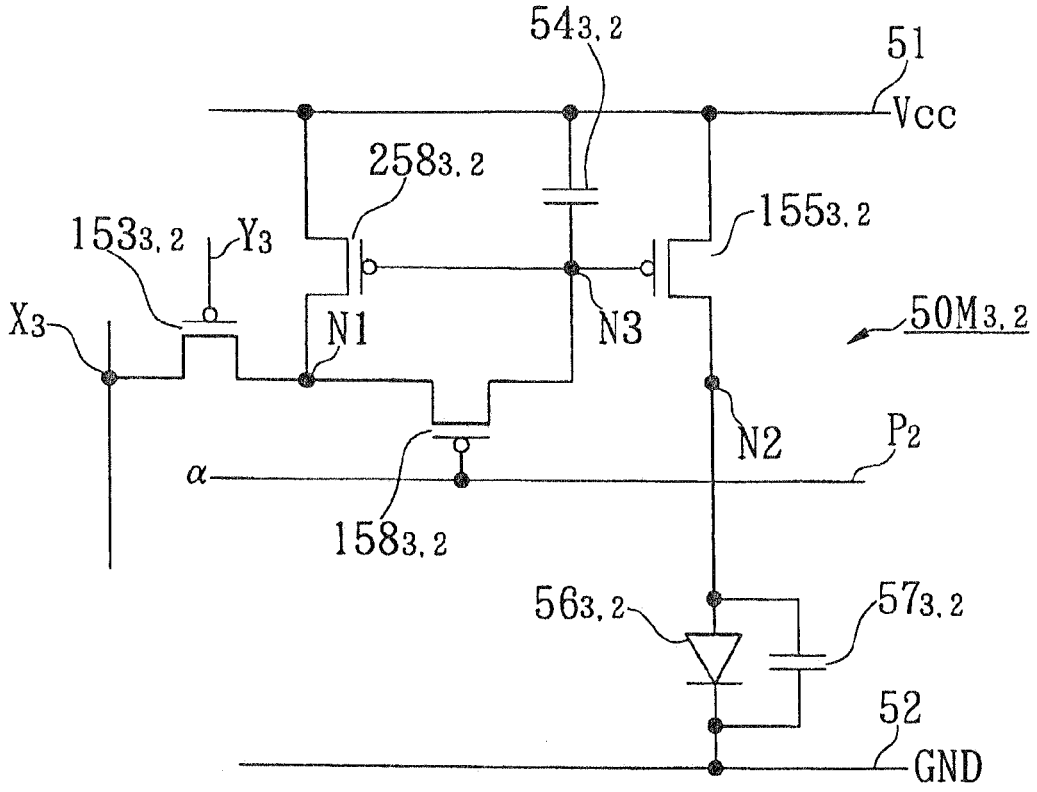
FIG. 38 is a diagram of an electric arrangement of a pixel in the image display apparatus shown in FIG. 37.

FIG. 38 is a circuit diagram of an electric arrangement of pixel $\mathbf{50}M_{i,j}$ (e.g., i=3, j=2) in the image display apparatus shown in FIG. 37. Common reference characters are assigned to those elements in FIG. 38 which are common to the elements shown in FIG. 36 according to the tenth embodiment.

Pixel 50$M_{3,2}$ has input drive transistor 258$M_{3,2}$ in addition to the arrangement of pixel 50$L_{i,j}$ shown in FIG. 36, and pMOS 159$_{3,2}$ and control line $Q_2$ are dispensed with. Input drive transistor 258$M_{3,2}$ comprises a pMOS and has a source electrode connected to power line 51, a drain electrode to node N1, and a gate electrode to node N3. Input drive transistor 258$_{3,2}$ passes an output current controlled based on the voltage between the source and gate electrodes thereof from power line 51 to node N1. Output drive transistor 155$_{3,2}$ has a drain electrode connected to node N2, and the anode of pixel display element 56$_{3,2}$ is connected to same node N2. The gate electrode of output drive transistor 155$_{3,2}$ is connected to node N3. Other details are identical to those shown in FIG. 36.

Figure 39:
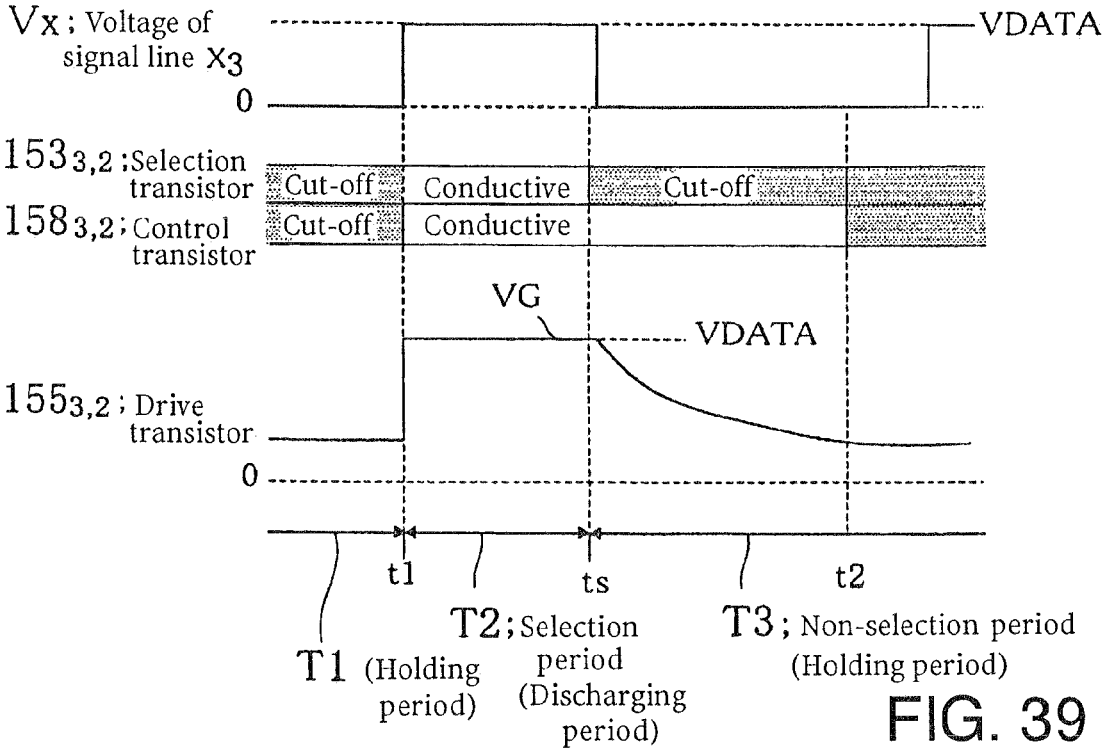
FIG. 39 is a timing chart showing the manner in which an image display section operates.

FIG. 39 is a timing chart showing the manner in which image display section 50$M_{3,2}$ shown in FIG. 38 operates. A display control method for the image display apparatus according to the eleventh embodiment will be described with reference to FIG. 39.

As shown in FIG. 39, during holding period T1, selection transistor 153$_{3,2}$, control transistor 158$_{3,2}$, and pMOS 159$_{3,2}$ are turned off. When selection period T2 starts at time t1, scanning signal V is applied to scanning line $Y_2$ to turn on selection transistor 153$_{3,2}$ from off-state, and control line drive signal $\alpha$ is applied to control line $P_2$ to turn on control transistor 158$_{3,2}$. Signal charges of gradation pixel data from signal line $X_3$ are stored in holding capacitor 54$_{3,2}$ (pixel data writing process).

At time ts, selection transistor 153$_{3,2}$ is turned off is turned on, starting to discharge the charge of holding capacitor 54$_{3,2}$ through control transistor 158$_{3,2}$ and input drive transistor 258$_{3,2}$ (discharging process). After the discharging for a certain period of time, control transistor 158$_{3,2}$ is turned off, floating the gate electrode of output drive transistor 155$_{3,2}$. Since gate-to-source voltage VGS of output drive transistor 155$_{3,2}$ is held by holding capacitor 54$_{3,2}$ (pixel data holding process), constant current IL keeps flowing through pixel display element 56$_{3,2}$. In the above discharging process, holding capacitor 54$_{3,2}$ is discharged for a certain period of time thereby to reduce variations of currents between the sources and drains of input drive transistor 258$_{3,2}$ and output drive transistor 155$_{3,2}$. The eleventh embodiment offers the same advantages as the ninth embodiment.

Twelfth Embodiment

Figure 40:
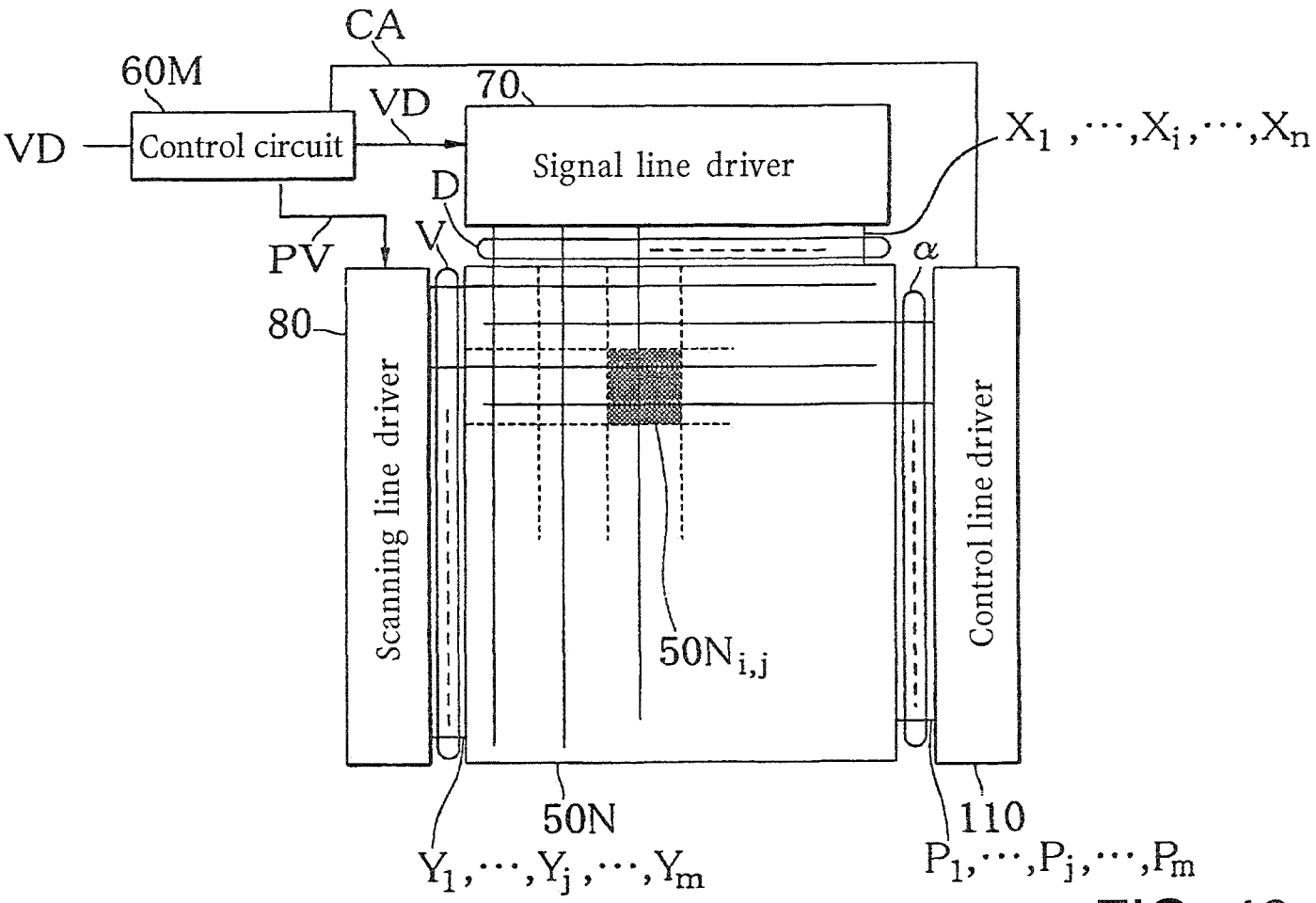
FIG. 40 is a block diagram of an electric arrangement of an image display apparatus according to a twelfth embodiment of the present invention.

FIG. 40 is a block diagram of an electric arrangement of an image display apparatus according to a twelfth embodiment of the present invention. Common reference characters are assigned to those elements in FIG. 40 which are common to the elements shown in FIG. 37 according to the eleventh embodiment.

The image display apparatus according to the twelfth embodiment has display panel 50N having a different arrangement, instead of display panel 50M in the image display apparatus shown in FIG. 37. Display panel 50N has pixels 50$N_{i,j}$ having a different arrangement, instead of pixels 50$M_{i,j}$ shown in FIG. 37.

Figure 41:
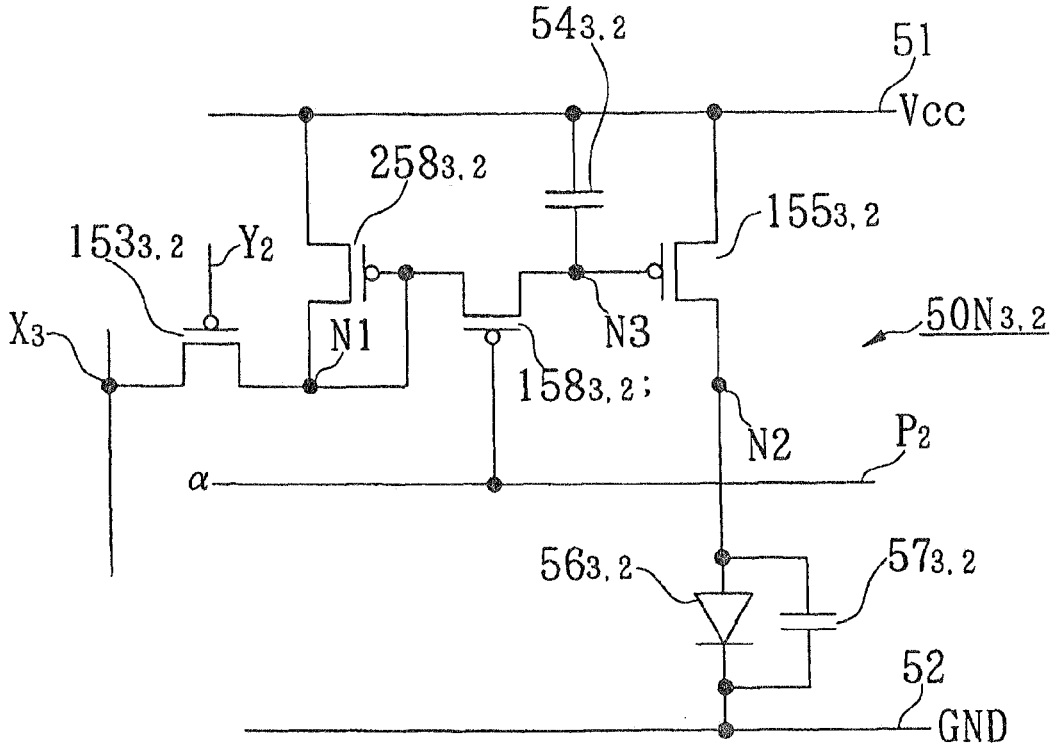
FIG. 41 is a diagram of an electric arrangement of a pixel in the image display apparatus shown in FIG. 40.

FIG. 41 is a circuit diagram of an electric arrangement of pixel 50$N_{i,j}$ (e.g., i=3, j=2) in the image display apparatus shown in FIG. 40. Common reference characters are assigned to those elements in FIG. 41 which are common to the elements shown in FIG. 38 according to the eleventh embodiment.

In pixel 50$N_{i,j}$, the gate electrode of input drive transistor 258$_{3,2}$ is connected to node N1. Input drive transistor 258$_{3,2}$ passes an output current controlled based on the voltage between the source and gate electrodes thereof from power line 51 to node N1. Other details are identical to those shown in FIG. 38. The image display apparatus according to the twelfth embodiment operates in the same manner as with the eleventh embodiment, and offers the same advantages as with the eleventh embodiment.

Thirteenth Embodiment

Figure 42:
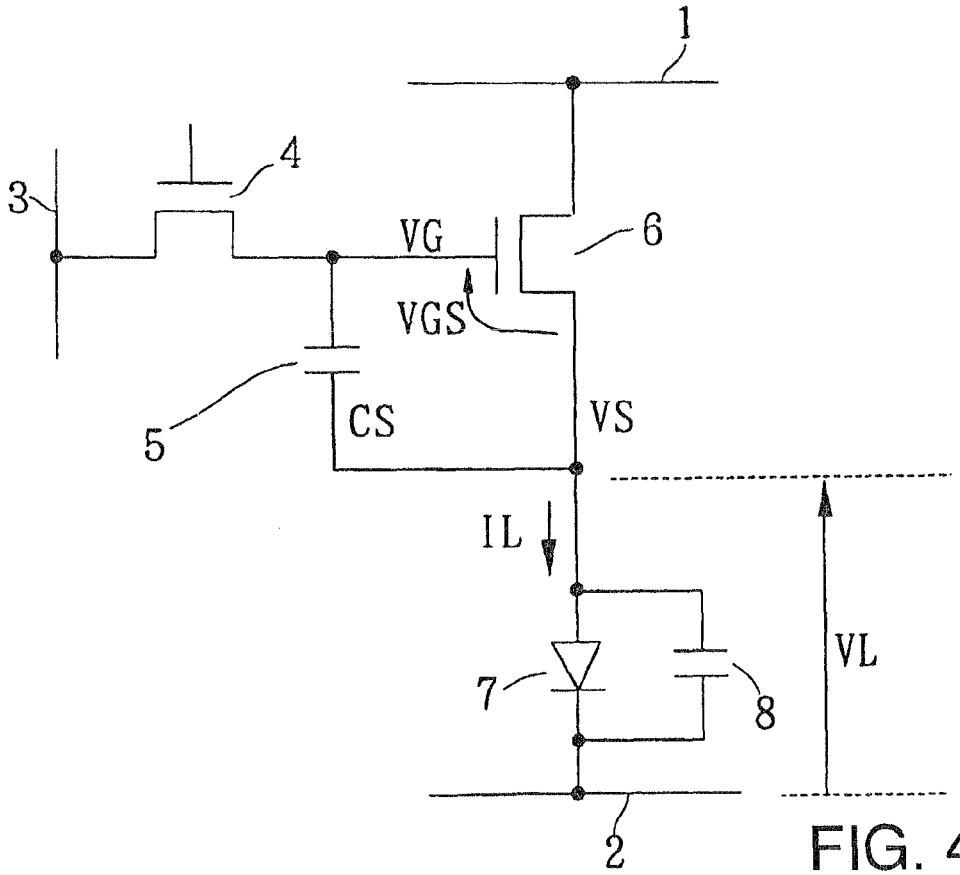
FIG. 42 is a circuit diagram of an arrangement of a drive circuit for a current control element according to a thirteenth embodiment of the present invention.

FIG. 42 is a circuit diagram of an arrangement of a drive circuit for a current control element according to a thirteenth embodiment of the present invention.

According to the thirteenth embodiment, the drive circuit for the current control element generally comprises selection transistor 4, holding capacitor 5, drive transistor 6, current control element 7 which is typically a pixel display element, and parasitic capacitor 8, all connected between power line 1, ground line 2, and signal line 3.

Selection transistor 4 is in the form of an N-channel field-effect transistor (nMOS), and has a gate electrode connected to a selection line (not shown), a drain electrode to signal line 3, and a source electrode to the gate electrode of drive transistor 6. Holding capacitor 5 is connected between the gate and source electrodes of drive transistor 6. Drive transistor 6 comprises an nMOS and has its gate electrode connected to the source electrode of selection transistor 4 and one end of holding capacitor 5, a drain electrode to power line 1 and a source electrode to the anode of current control element 7. Current control element 7 comprises a pixel display element such as an organic EL element, and is connected between the source electrode of drive transistor 6 and ground line 2. Current control element 7 emits light at a luminance depending on current IL from drive transistor 6. Parasitic capacitor 8 comprises a parasitic capacitor across current control element 7.

Figure 43:
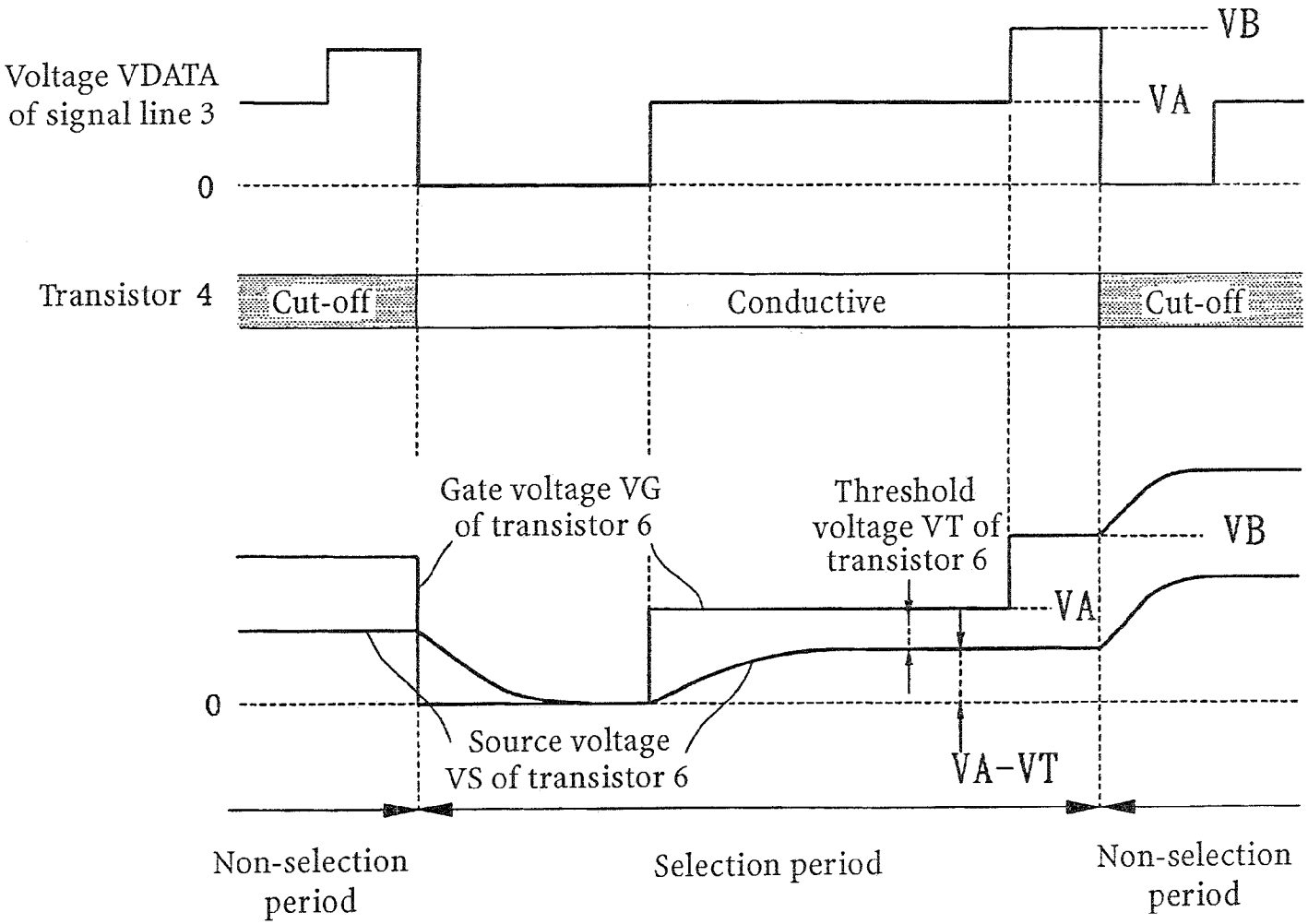
FIG. 43 is a timing chart showing the manner in which the drive circuit for the current control element shown in FIG. 42 operates.
Figure 44:
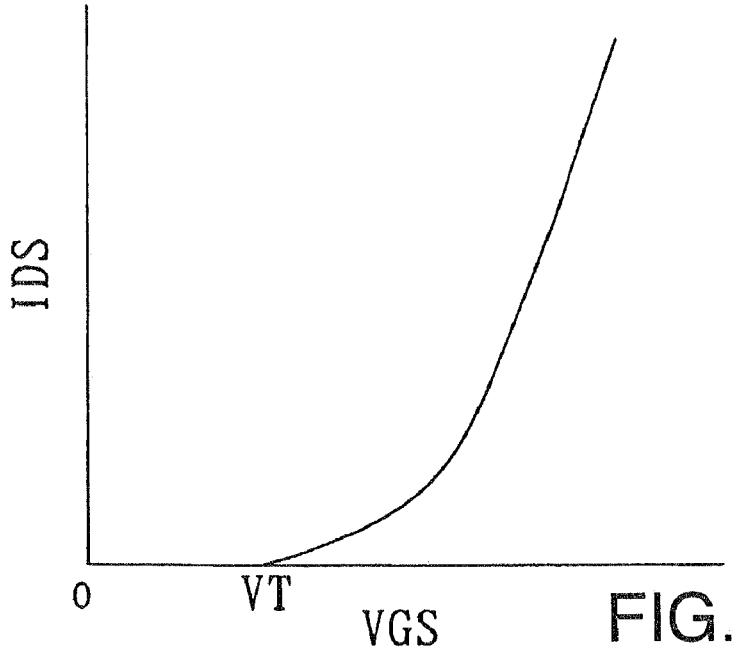
FIG. 44 is a graph showing the IDS-VGS characteristics of a drive transistor in the circuit shown in FIG. 42.
Figure 45:
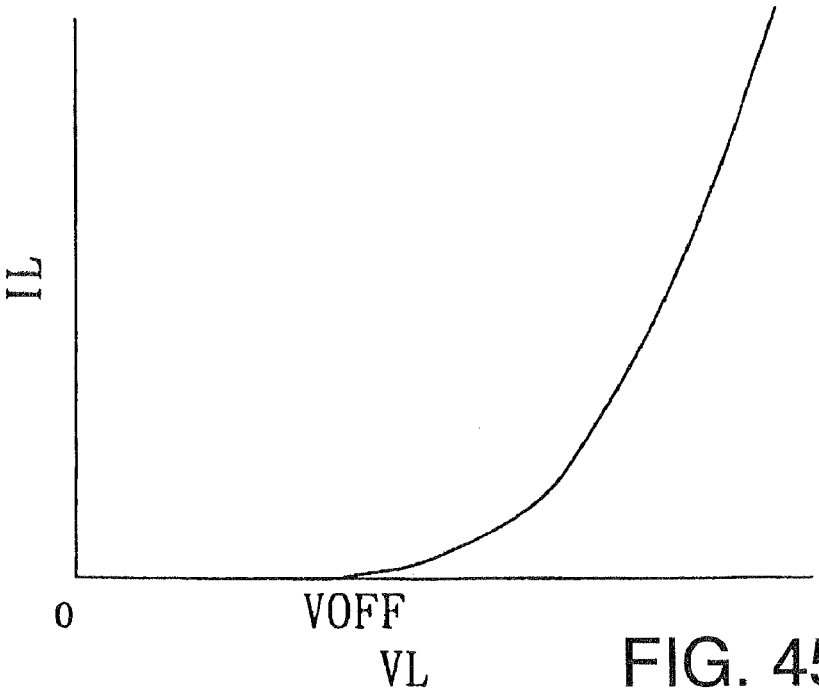
FIG. 45 is a graph showing the IL-VL characteristics of the current control element shown in FIG. 42.
Figure 46:
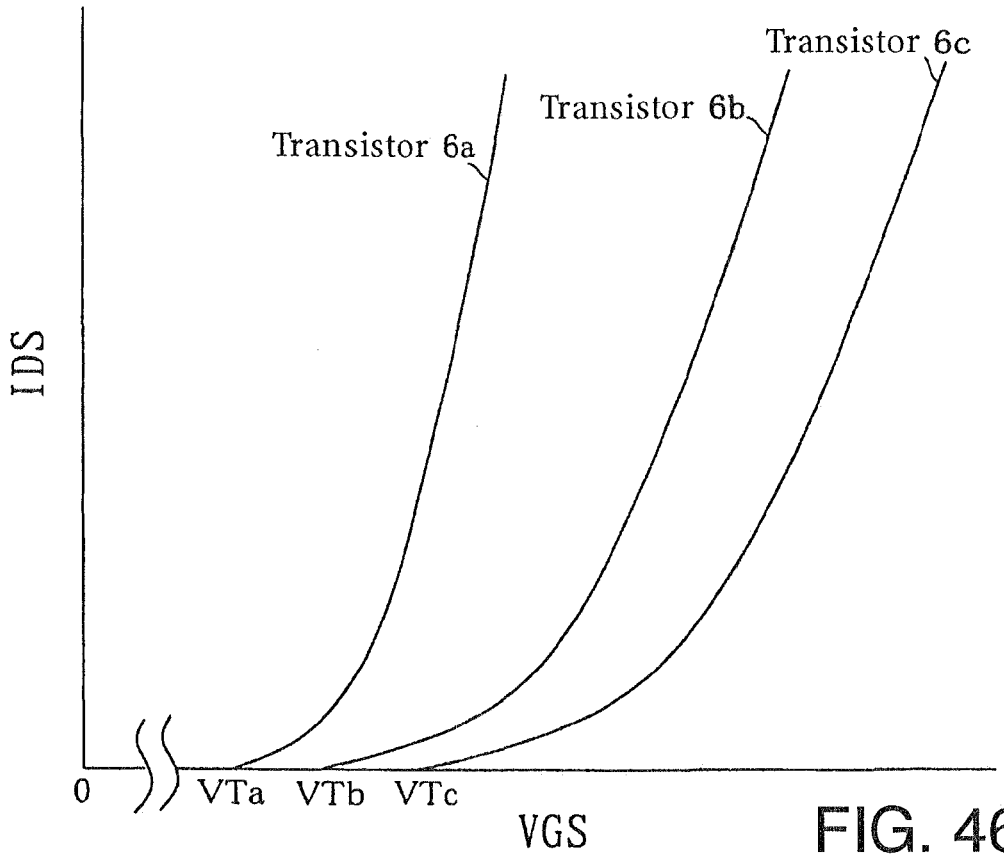
FIG. 46 is a graph showing the IDS-VGS characteristics of drive transistors having characteristic variations.
Figure 47:
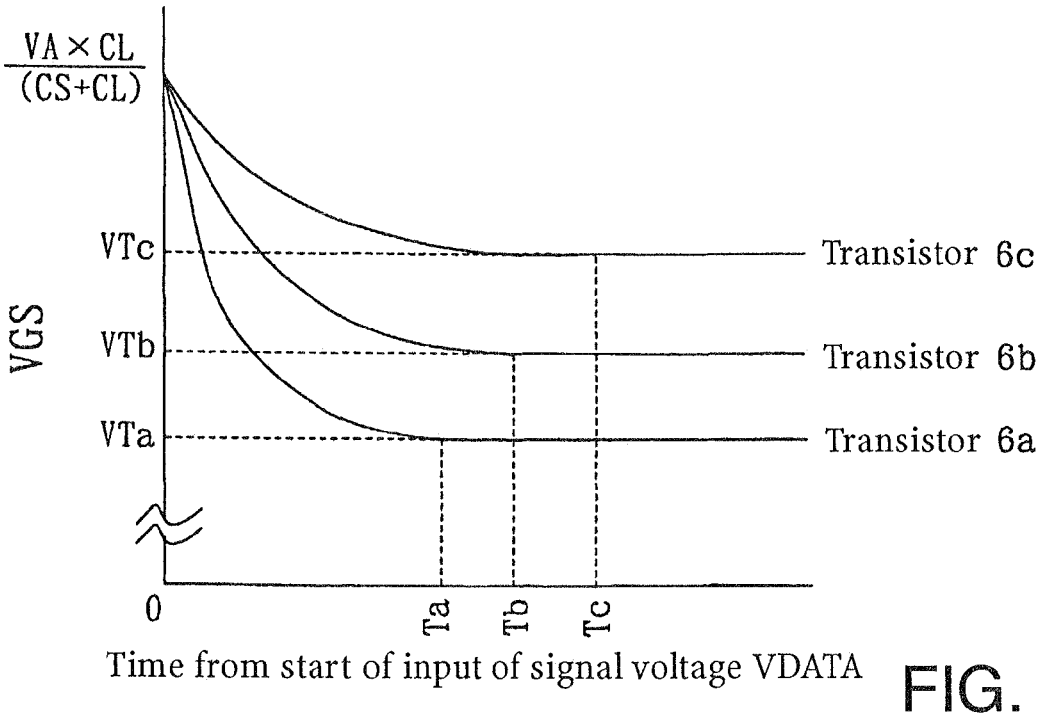
FIG. 47 is a graph showing the transient characteristics of the gate-to-source voltage VGS of drive transistors having characteristic variations.

FIG. 43 is a timing chart showing the manner in which the drive circuit for the current control element operates. Further, FIG. 44 shows the IDS-VGS characteristics of the drive transistor; FIG. 45 shows the IL-VL characteristics of the current control element. FIG. 46 shows the IDS-VGS characteristics of drive transistors having characteristic variations; and FIG. 47 shows the transient characteristics of VGS of drive transistors having characteristic variations. Operation of the drive circuit for the current control element according to the present embodiment will be described below with reference to FIGS. 42 to 46.

As shown in FIG. 43, when a selection period of the drive circuit starts, selection transistor 4 is turned to conductive state from cut-off state. At this time, voltage VDATA input to signal line 3 is 0 V which is the same potential as ground line 2. In this state, since selection transistor 4 is in the conductive state, charge of holding capacitor 5 starts to be discharged through signal line 3. At the same time, charge of parasitic capacitor 8 of current control element 7 is discharged through current control element 7.

When a sufficient time elapses after the selection period starts, both gate voltage VG and source voltage VS of drive transistor 6 become 0 V. Since gate-to-source voltage VGS of drive transistor 6 is zero, no current flows between the drain and source of drive transistor 6.

Then, the input voltage of signal line 3 switches from 0 V to VA. Immediately after signal line 3 switches from 0 V to VA, gate-to-source voltage VGS of drive transistor 6 is determined by capacitance value CS of holding capacitor 5 and capacitance value CS of parasitic capacitor 8 of current control element 7, according to the following equation:

$$VGS=VA\times CL/(CS+CL) \quad (2)$$

Source voltage VS of drive transistor 6 is expressed by the following equation:

$$VS=VA\times CS/(CS+CL) \quad (3)$$

At this time, gate-to-source voltage VGS of drive transistor 6 needs to be greater than threshold voltage VT on the IDS-VGS characteristics of the drive transistor shown in FIG. 44. Inter-terminal voltage VL across current control element 7, i.e., source voltage VS of drive transistor 6, needs to be smaller than forward rise voltage VOFF on the voltage vs. current characteristics of current control element 7 shown in FIG. 45. That is, $$VGS>VT \quad (4)$$

$$VS<VOFF \quad (5)$$

Since gate-to-source voltage VGS of drive transistor 6 is greater than threshold voltage VT, a current flows between the drain and source of drive transistor 6. Because of the current flowing between the drain and source of drive transistor 6, parasitic capacitor 8 of current control element 7 is charged, increasing inter-terminal voltage VL across current control element 7, i.e., source voltage VS of drive transistor 6.

Simultaneously, since gate voltage VG of drive transistor 6 is of constant value VA, gate-to-source voltage VGS of drive transistor 6 decreases toward threshold voltage VT, and source voltage VS of drive transistor 6 approaches (VA−VT).

Since drive transistor 6 is a thin-film transistor or the like formed on a glass substrate, the VGS-IDS characteristics representing the relationship between drain-to-source current IDS and gate-to-source voltage VGS vary greatly as VGS is indicated by VTa, VTb, and VTc with respect to same drain-to-source current IDS, depending on the characteristics of individual transistors 6*a*, 6*b*, 6*c*, as shown in FIG. 46.

As shown in FIG. 47, when a sufficient time elapses, gate-to-source voltages VGS of drive transistors 6*a*, 6*b*, 6*c* change from value VA×CL/(CS+CL) immediately after signal voltage VA is input to threshold values VTa, VTb, and VTc of the individual transistors. The times until threshold values VTa, VTb, and VTc are reached differ from each other as indicated by Ta, Tb, and Tc. When the sufficient time elapses, no current flows between the drain and source of drive transistor 6, bringing gate-to-source voltage VGS of drive transistor 6 to threshold voltage VT.

$$VGS=VT \quad (6)$$

Source voltage VS of drive transistor 6 is expressed by the following equation:

$$VS=VA-VT \quad (7)$$

It is necessary to select capacitance values CS, CL such that source voltage VS of drive transistor 6 is smaller than forward rise voltage VOFF of current control element 7 on the IL-VL characteristics of current control element 7 shown in FIG. 45.

$$VS<VOFF \quad (8)$$

Then, voltage VDATA input to signal line 3 is changed from VA to VB where VB is of the same value as VA (non-emitted state) or is of a value greater than VA (emitted state). Voltage difference (VB−VA) at the time VA switches to VB is applied as being divided between capacitance value CS of holding capacitor 5 between the gate and source of drive transistor 6 and capacitance value CL of parasitic capacitor 8 of current control element 7. Therefore, gate-to-source voltages VGS of drive transistor 6 and source voltage VS of drive transistor 6 at this time are given by the following equations:

$$VGS=VT+(1-CS/CL)\cdot(VB-VA) \quad (9)$$

$$VS=VA-VT+(VB-VA)CS/CL \quad (10)$$

As can be seen from the above equations, since (VGT−VT) is determined by (VB−VA), even if the threshold value of drive transistor 6 suffers a variation, such a variation is, compensated for. Thus, the current flowing through current control element 7 is controlled by setting VB and VA to appropriate values.

Then, selection transistor 4 is turned to cut-off state from conductive state, starting a non-selection period. When the non-selection period is started, gate-to-source voltages VGS of drive transistor 6 is held by holding capacitor 5.

Source voltage VS of drive transistor 6 increases as parasitic capacitor 8 of current control element 7 is charged through drive transistor 6, and gate voltage VG of drive transistor 6 simultaneously increases while gate-to-source voltages VGS is being kept constant by holding capacitor 5. When source voltage VS of drive transistor 6 exceeds forward rise voltage VOFF of current control element 7, current control element 7 starts emitting light, and subsequently keeps emitting light until the non-selection period ends.

When inter-terminal voltage VL across current control element 7 reaches a voltage that is sufficient to pass current IL determined by gate-to-source voltages VGS of drive transistor 6, gate voltage VG and source voltage VS of drive transistor 6 stop increasing and become constant.

Thereafter, since gate-to-source voltages VGS of drive transistor 6 is held by holding capacitor 5, constant current IL keeps flowing through current control element 7.

The drive circuit for the current control element according to the present embodiment comprises a minimum component arrangement including two transistors, i.e., selection transistor 4 and drive transistor 6, and holding capacitor 5, and is capable of correcting the threshold value of drive transistor 6 so as not to be susceptible to a change of the threshold value.

Figure 1:
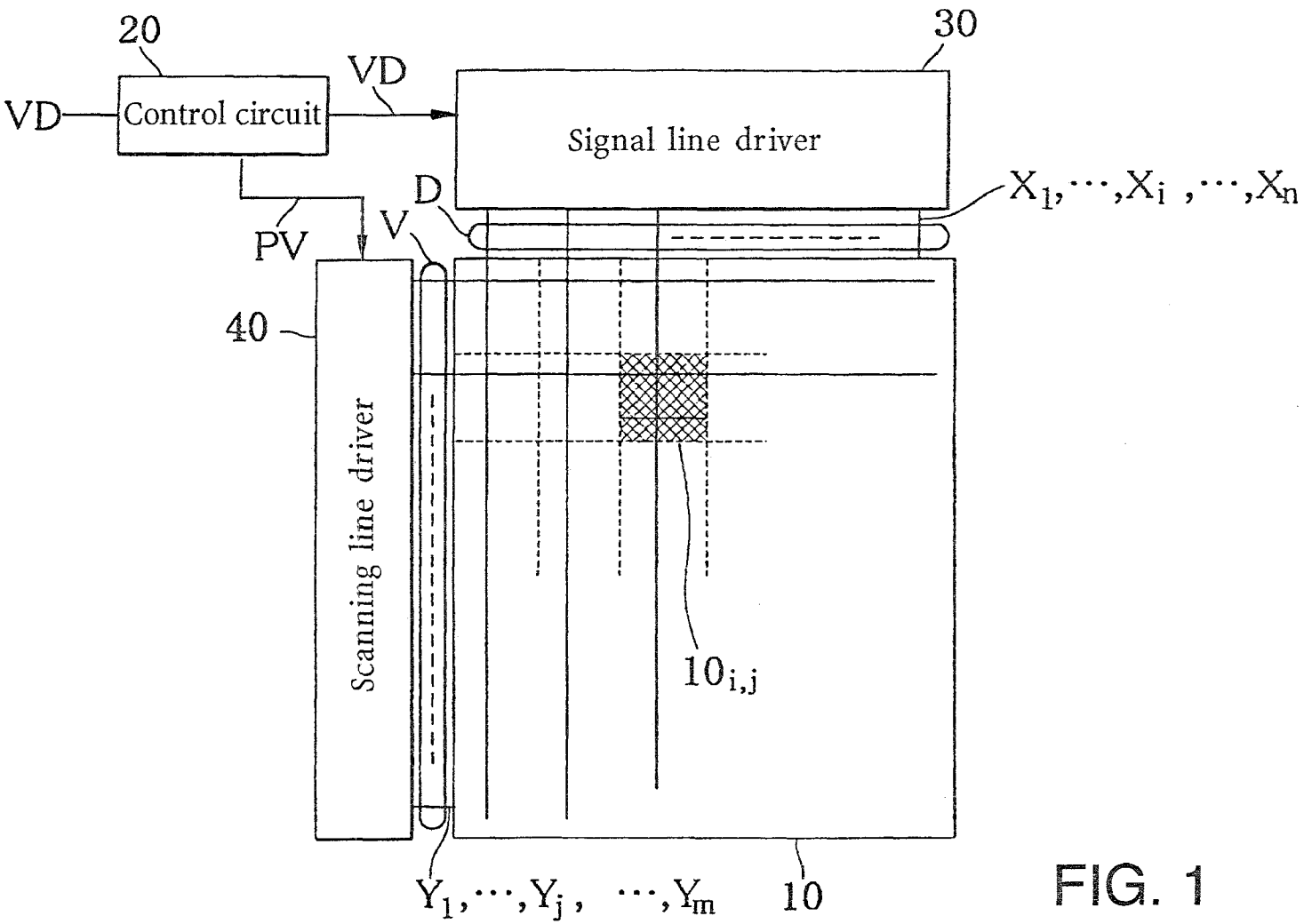
FIG. 1 is a block diagram of an electric arrangement of a conventional image display apparatus.
Figure 2:
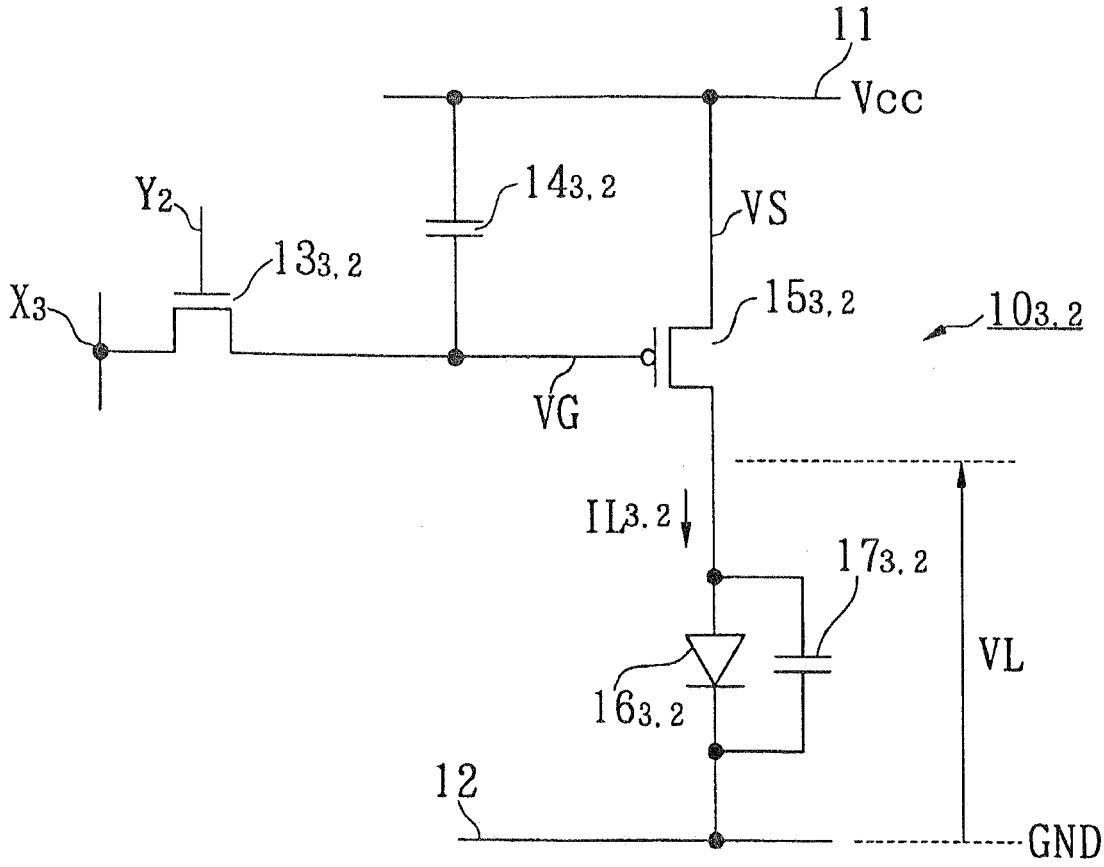
FIG. 2 is a circuit diagram showing an electric arrangement of a pixel in the image display apparatus shown in FIG. 1.
Figure 3:
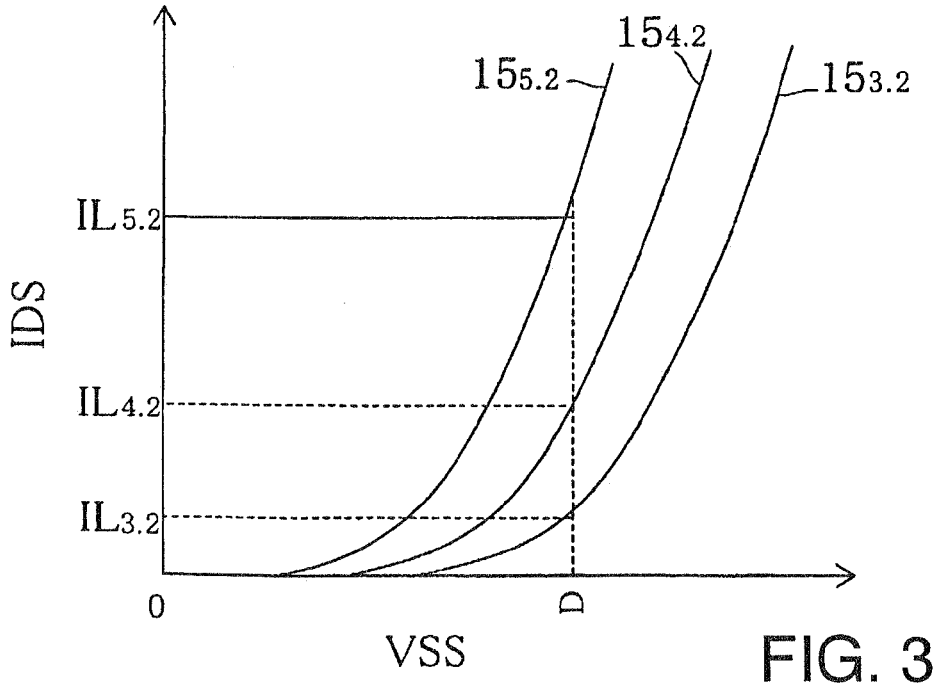
FIG. 3 is a graph showing the IDS-VGS characteristics of drive transistors of respective pixels.
Figure 4:
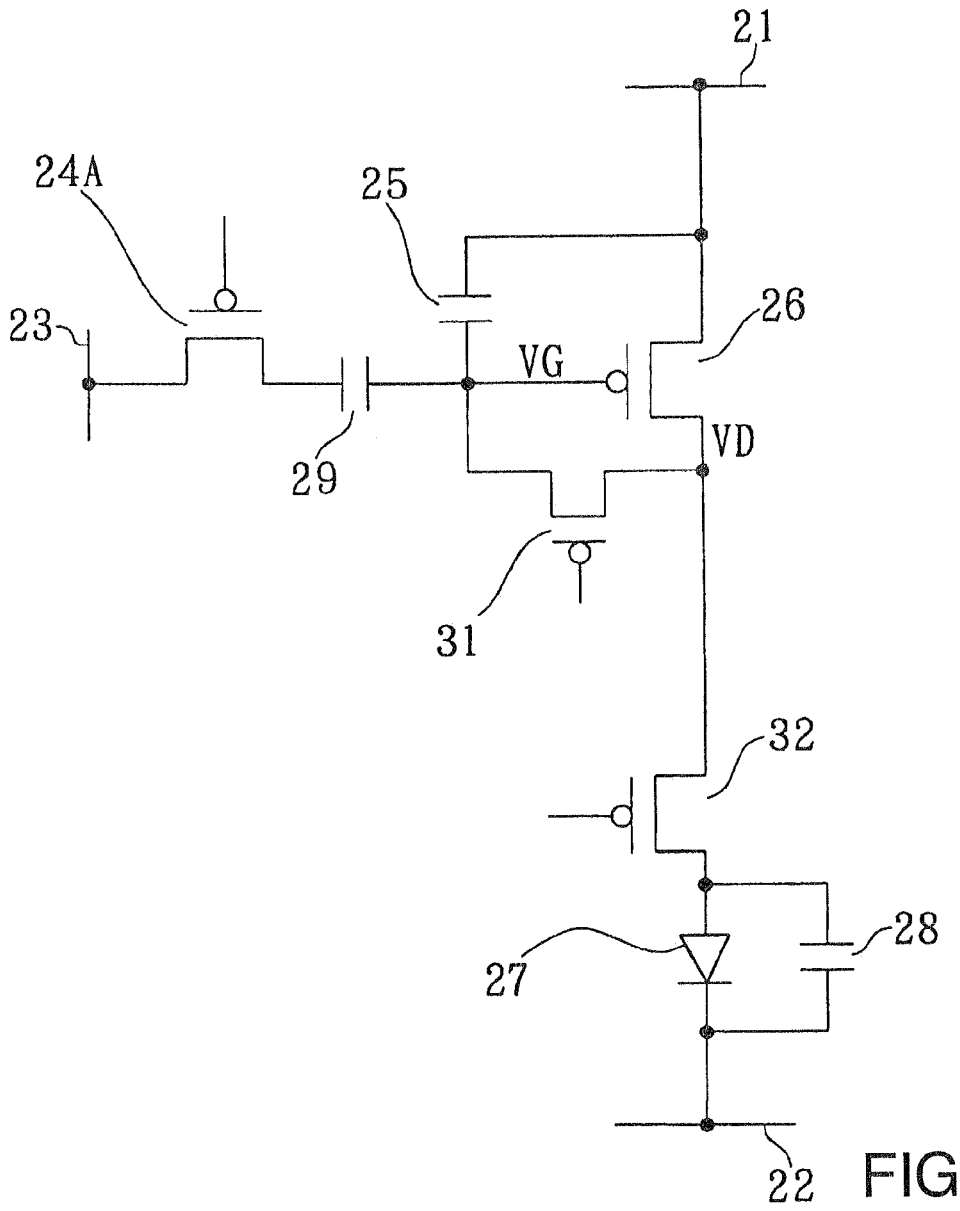
FIG. 4 is a diagram of an arrangement of a drive circuit for a conventional current control element.
Figure 5:
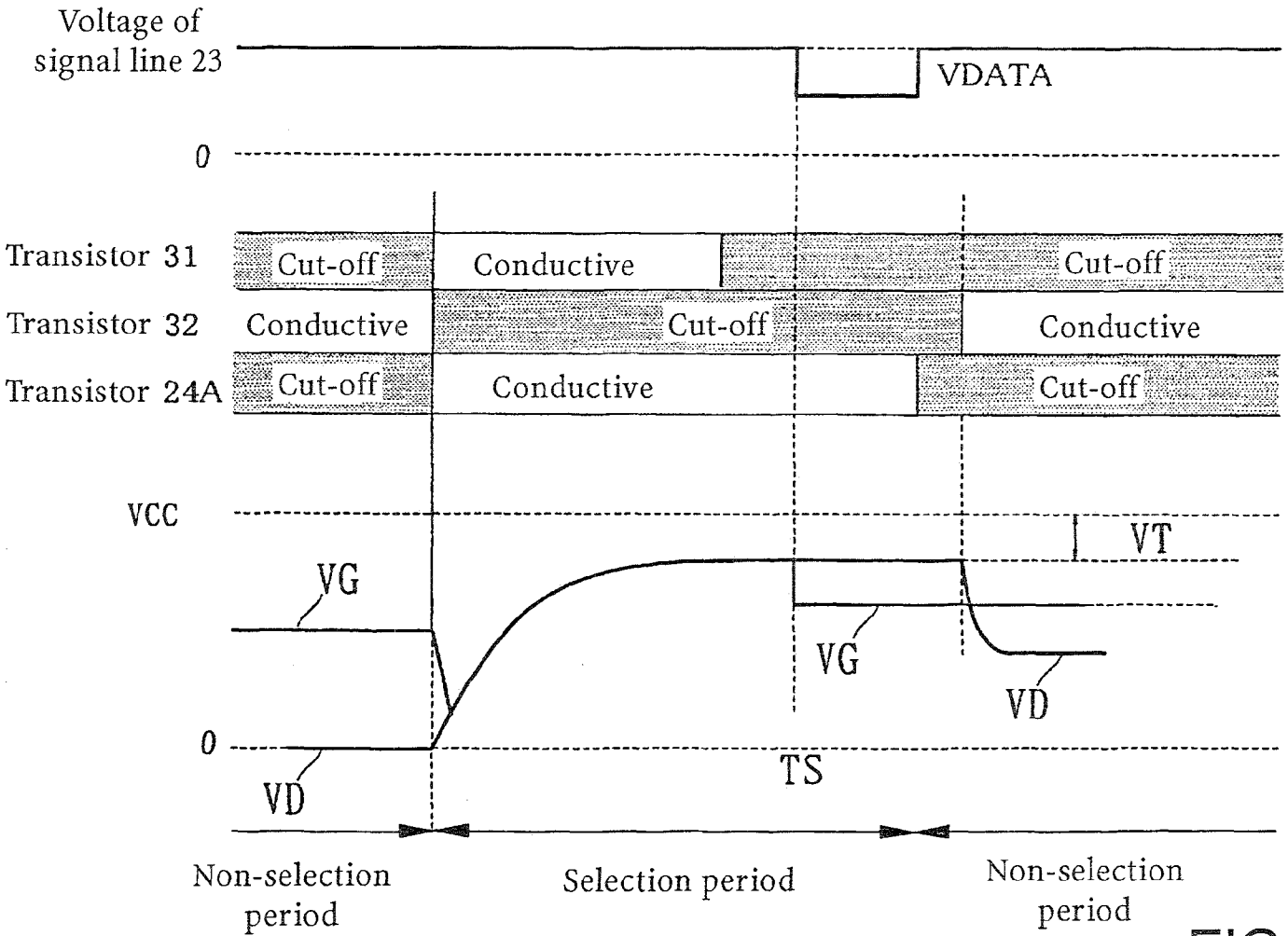
FIG. 5 is a timing chart showing the manner in which the circuit shown in FIG. 4 operates.

According to the present embodiment, since the number of components of the pixel circuit is ½ of the number of components of the conventional drive circuit for the current control element shown in FIG. 4, the aperture ratio of the pixel can be increased, and the manufacturing process is facilitated. Furthermore, since capacitance value CL of parasitic capacitor 8 of current control element 7 is generally greater than capacitance value CS of holding capacitor 5, data can be written in the drive circuit at a lower write voltage for better power consumption.

The drive circuit according to the thirteenth embodiment shown in FIG. 42 can be operated differently by different control methods. Embodiments for such different operations will be described below.

Fourteenth Embodiments

Figure 48:
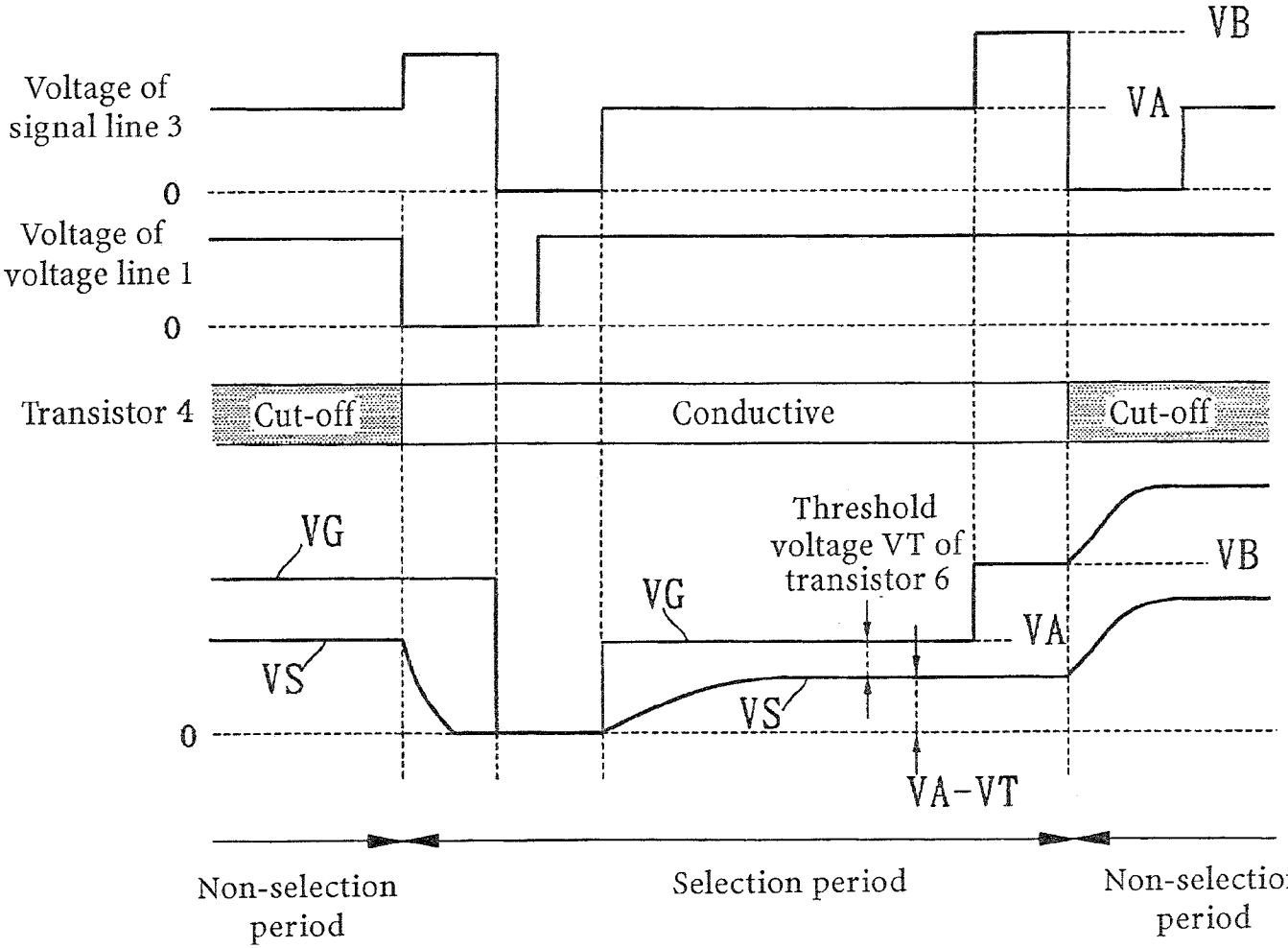
FIG. 48 is a timing chart showing the manner in which a drive circuit for a current control element according to a fourteenth embodiment of the present invention operates.

FIG. 48 is a timing chart showing the manner in which a drive circuit for a current control element according to a fourteenth embodiment of the present invention operates. The drive circuit for the current control element according to the present embodiment is the same as that shown in FIG. 42, but operates differently as its control method is different. Operation of the drive circuit for the current control element according to the fourteenth embodiment will be described below with reference to FIG. 48.

When a selection period of the drive circuit starts, selection transistor 4 is turned to conductive state from cut-off state. At this time, the voltage input to signal line 3 is a voltage large enough to turn on drive transistor 6. At the same time, the potential of power line 1 is set to 0 V.

Since drive transistor 6 is turned on, the charge of parasitic capacitor 8 of current control element 7 is discharged through drive transistor 6. After source voltage VS of drive transistor 6 becomes 0 V, the voltage of signal line 3 is brought to the ground potential 0 V. Since selection transistor 4 is turned on, the charge of holding capacitor 5 is discharged, bringing gate voltage VG of drive transistor 6 to 0 V.

Thereafter, the voltage of power line 1 is brought back to the original power line voltage level. Inasmuch as gate-to-source voltage VGS of drive transistor 6 is zero, no current flows between the drain and source of drive transistor 6.

Then, the input voltage of signal line 3 switches from 0 V to VA. Subsequently, the drive circuit operates in the same manner as with the thirteenth embodiment.

As described above, as with the thirteenth embodiment, the drive circuit for the current control element according to the fourteenth embodiment comprises a minimum component arrangement including two transistors, i.e., selection transistor 4 and drive transistor 6, and holding capacitor 5, and is capable of correcting the threshold value of drive transistor 6 so as not to be susceptible to a change of the threshold value. Furthermore, at an initial stage of the selection period, the drive transistor is turned on to bring the potential of power line 1 to 0 V. Therefore, the charges of parasitic capacitor 8 of current control element 7 can be discharged through drive transistor 6 to power line 1. As the source voltage of drive transistor 6 drops quickly, the selection period can be shortened.

Fifteenth Embodiment

Figure 49:
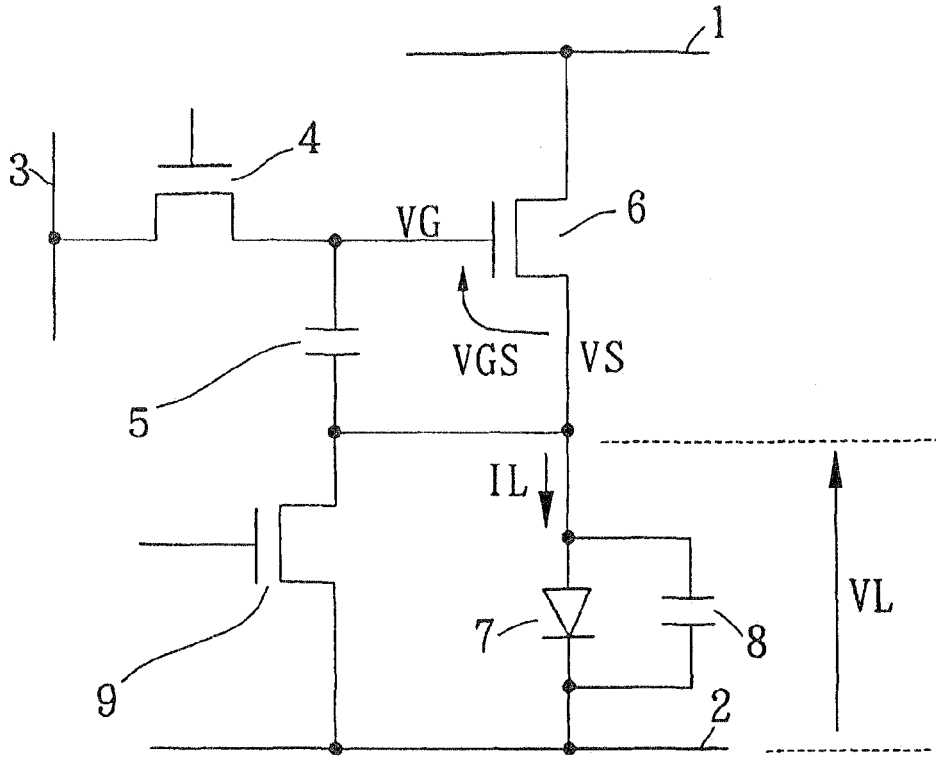
FIG. 49 is a circuit diagram of an arrangement of a drive circuit for a current control element according to a fifteenth embodiment of the present invention.
Figure 50:
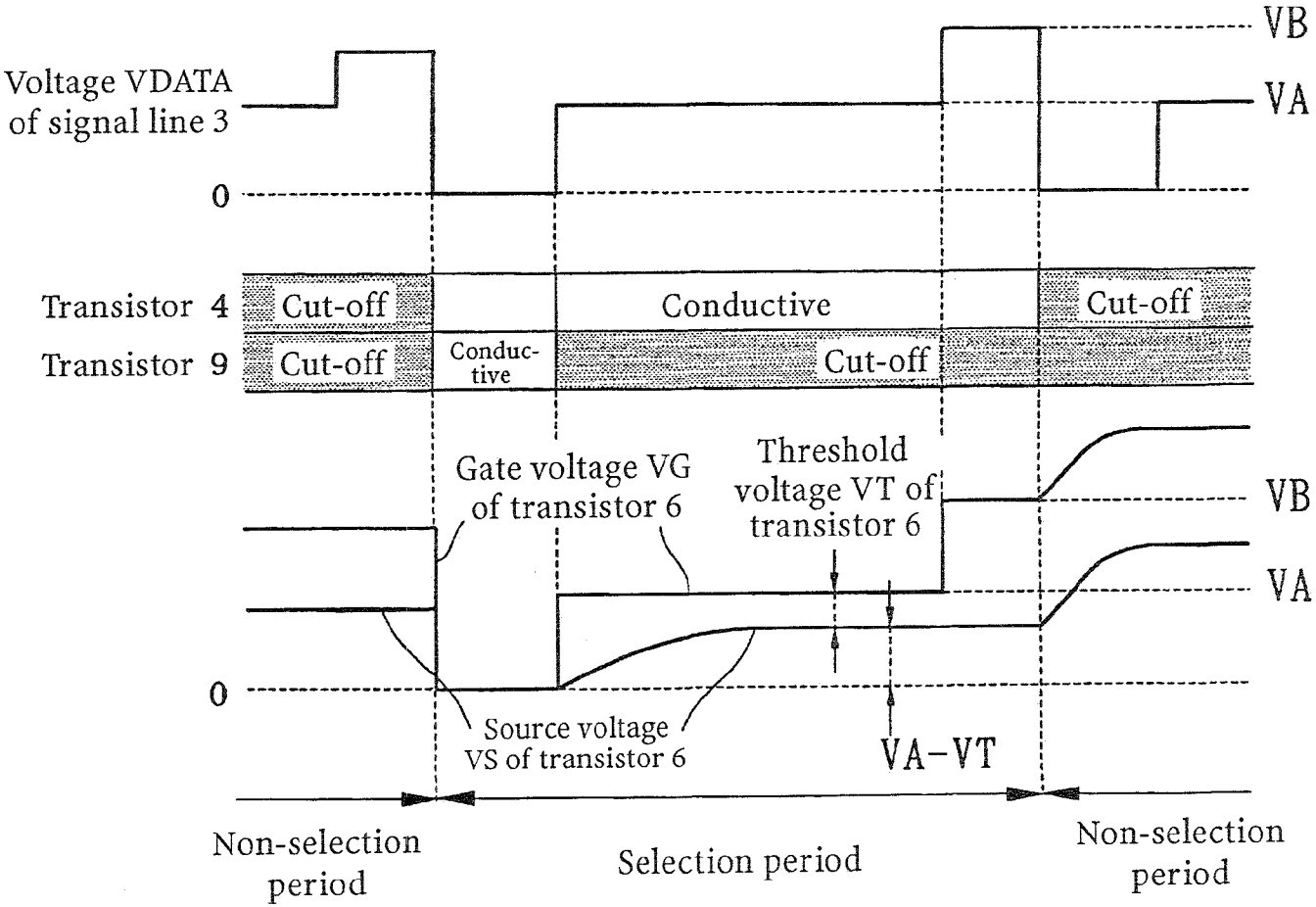
FIG. 50 is a timing chart showing the manner in which the drive circuit for the current control element shown in FIG. 49 operates.

FIG. 49 is a circuit diagram of an arrangement of a drive circuit for a current control element according to a fifteenth embodiment of the present invention. FIG. 50 is a timing chart showing the manner in which the drive circuit operates.

The drive circuit for the current control element shown in FIG. 49 generally comprises selection transistor 4, holding capacitor 5, drive transistor 6, current control element 7 such as a pixel display element, parasitic capacitor 8, and switching transistor 9, all connected between power line 1, ground line 2, and signal line 3. In this drive circuit, the constitutions of power line 1, ground line 2, signal line 3, selection transistor 4, holding capacitor 5, drive transistor 6, current control element 7, and parasitic capacitor 8 are identical to those of the thirteenth embodiment shown in FIG. 42. However, the drive circuit differs from the thirteenth embodiment in that it additionally has switching transistor 9 as shown in FIG. 49. Switching transistor 9 comprises an nMOS and has a gate electrode connected to the selection line, a drain electrode to the source electrode of drive transistor 6 and one end of holding capacitor 5, and a source electrode connected to ground line 2.

Operation of drive circuit for the current control element according to the present embodiment will be described below with reference to FIGS. 49 and 50.

When a selection period of the drive circuit starts, selection transistor 4 and switching transistor 9 are turned to conductive state from cut-off state under the control of the selection line. At this time, the voltage input to signal line 3 is 0 V which is the same potential as ground line 2. Since selection transistor 4 and switching transistor 9 are turned on, charges of holding capacitor 5 and charges of parasitic capacitor 8 of current control element 7 are discharged, bringing gate voltage VG and source voltage VS of drive transistor 6 to 0 V. At this time, since gate-to-source voltage VGS of drive transistor 6 is 0 V, no current flows between the drain and source of drive transistor 6.

Then, switching transistor 9 is turned to cut-off state under the control of the selection line, and the input voltage of signal line 3 switches from 0 V to VA.

Subsequent operation of the same as with the thirteenth embodiment.

As described above, the drive circuit for the current control element according to the fifteenth embodiment is capable of correcting the threshold value of drive transistor 6 so as not to be susceptible to a change of the threshold value, as with the circuit according to the thirteenth embodiment.

The drive circuit according to the fifteenth embodiment needs switching transistor 9 in addition to the drive circuit according to the thirteenth embodiment. However, since switching transistor 9 can reset holding capacitor 5 and parasitic capacitor 8 of current control element 7 independently of the writing in holding capacitor 5 by selection transistor 4, holding capacitor 5 and parasitic capacitor 8 can be reset more reliably by selecting a resetting time.

Sixteenth Embodiment

Figure 51:
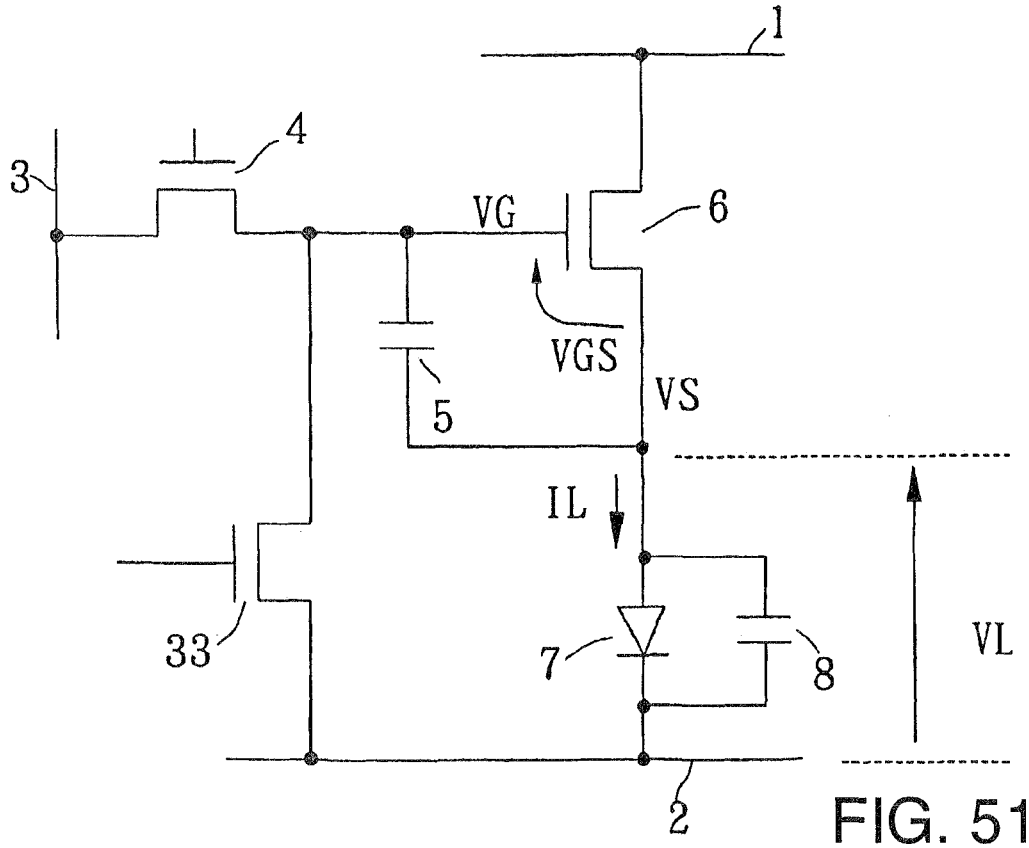
FIG. 51 is a circuit diagram of an arrangement of a drive circuit for a current control element according to a sixteenth embodiment of the present invention.
Figure 52:
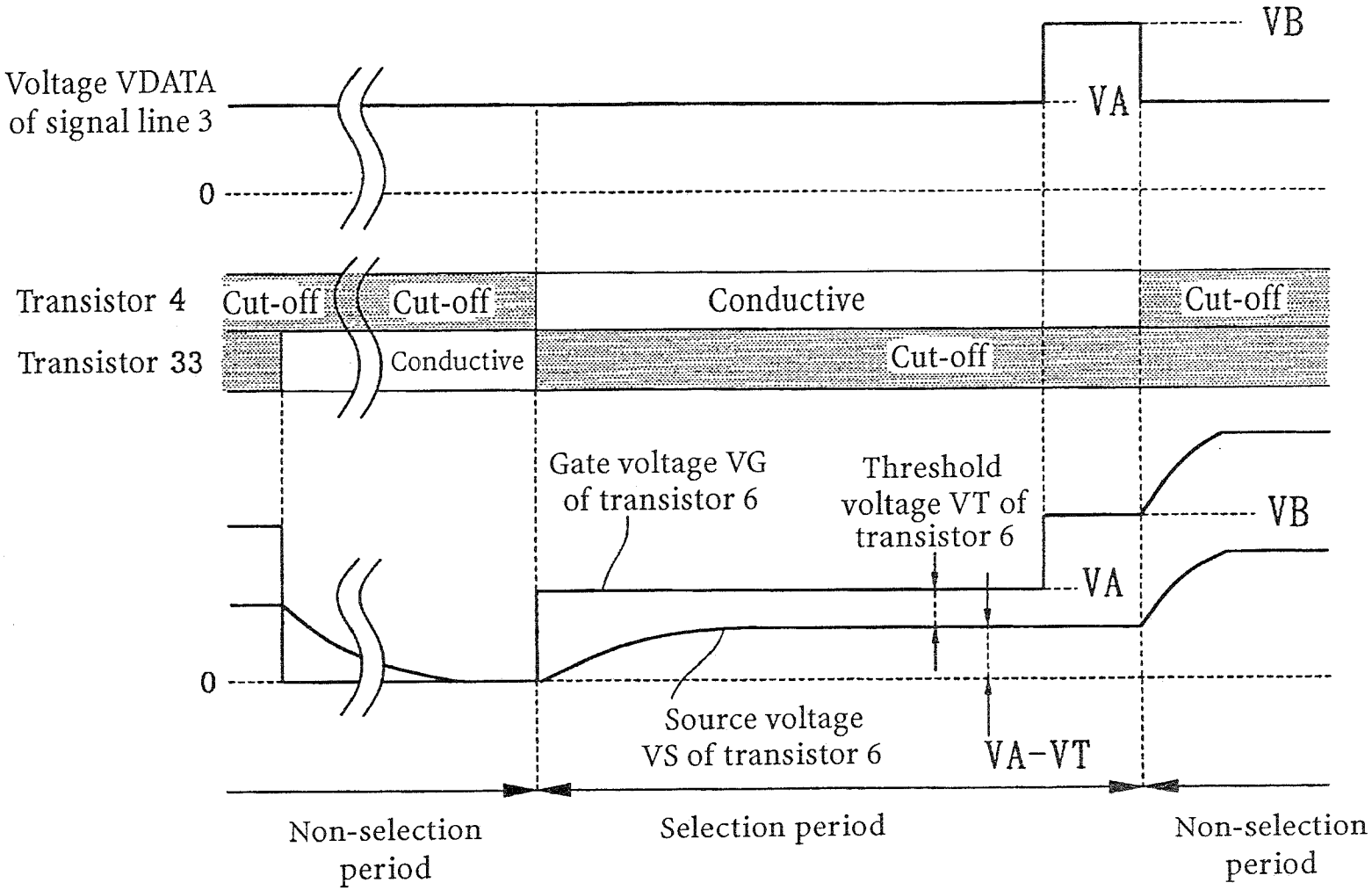
FIG. 52 is a timing chart showing the manner in which the drive circuit for the current control element shown in FIG. 51 operates.

FIG. 51 is a circuit diagram of an arrangement of a drive circuit for a current control element according to a sixteenth embodiment of the present invention. FIG. 52 is a timing chart showing the manner in which the drive circuit for the current control element operates.

The drive circuit for the current control element according to the sixteenth embodiment generally comprises selection transistor 4, holding capacitor 5, drive transistor 6, current control element 7, parasitic capacitor 8, and switching transistor 33, all connected between power line 1, ground line 2, and signal line 3. In this drive circuit for the current control element, the constitutions of power line 1, ground line 2, signal line 3, selection transistor 4, holding capacitor 5, drive transistor 6, current control element 7, and parasitic capacitor 8 are identical to those of the thirteenth embodiment shown in FIG. 42. However, the drive circuit differs from the thirteenth embodiment in that it additionally has switching transistor 9 as shown in FIG. 51. Switching transistor 33 comprises an nMOS and has a gate electrode connected to a selection line, a drain electrode to the source electrode of drive transistor 6 and one end of holding capacitor 5, and a source electrode connected to ground line 2.

Operation of drive circuit for the current control element according to the sixteenth embodiment will be described below with reference to FIGS. 51 and 52.

During a certain period before a selection period of the drive circuit starts, switching transistor 33 is turned to conductive state under the control of the selection line. Since switching transistor 33 is turned on, gate voltage VG drive transistor 6 is zero. Because gate-to-source voltage VGS of drive transistor 6 is a negative voltage, drive transistor 6 is turned to cut-off state. At this time, the charges stored in parasitic capacitor 8 of current control element 7 are discharged current control element 7 to ground line 2.

When a sufficiently long time elapses after switching transistor 33 is turned to conductive state, all the charges stored in parasitic capacitor 8 of current control element 7 are discharged, bringing source voltage VS of drive transistor 6 to 0 V. During this period, selection transistor 4 is turned into cut-off state under the control of the selection line.

When the selection period of the drive circuit starts, switching transistor 33 is turned to cut-off state from conductive state under the control of the selection line. Then, selection transistor 4 is turned to cut-off state from conductive state under the control of the selection line. At this time, VA is input as input voltage VDATA of signal line 3.

Subsequent operation of the same as with the thirteenth embodiment.

As described above, the drive circuit for the current control element according to the present embodiment is capable of correcting the threshold value of drive transistor 6 so as not to be susceptible to a change of the threshold value, as with the circuit according to the thirteenth embodiment. The drive circuit according to the present embodiment needs switching transistor 33 in addition to the drive circuit according to the first embodiment. However, since switching transistor 33 can reset holding capacitor 5 and parasitic capacitor 8 of current control element 7 independently of the writing in holding capacitor 5 by selection transistor 4, holding capacitor 5 and parasitic capacitor 8 can be reset more reliably by selecting a resetting time.

In the above thirteenth to sixteenth embodiments, the drive circuit for the current control element comprises nMOSs. However, the drive circuit may comprise P-channel field-effect transistors (pMOSs). Embodiments which employ pMOSs will be described below.

Seventeenth Embodiment

Figure 53:
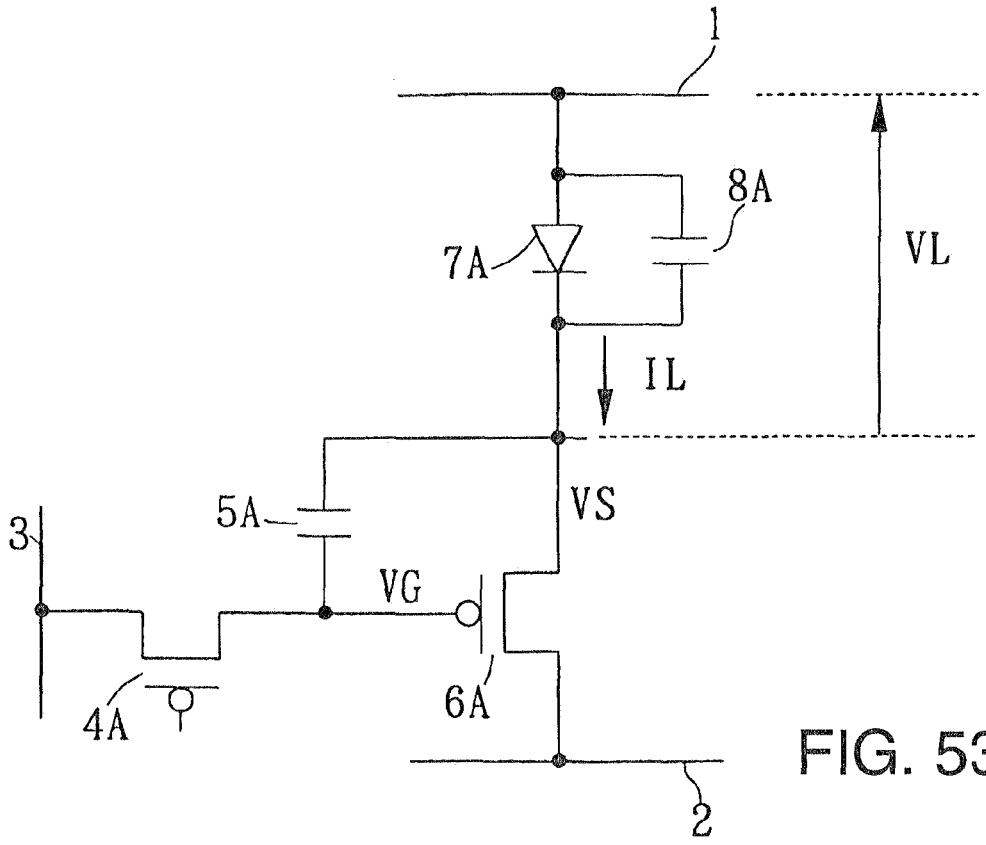
FIG. 53 is a circuit diagram of an arrangement of a drive circuit for a current control element according to a seventeenth embodiment of the present invention.

FIG. 53 is a circuit diagram of an arrangement of a drive circuit for a current control element according to a seventeenth embodiment of the present invention.

The drive circuit for the current control element according to the present embodiment generally comprises selection transistor 4A, holding capacitor 5A, drive transistor 6A, current control element 7A, and parasitic capacitor 8A, all connected between power line 1, ground line 2, and signal line 3. Selection transistor 4A comprises a pMOS and has a gate electrode connected to a selection line (not shown), a source electrode to signal line 3, and a drain electrode to the gate electrode of drive transistor 6A. Holding capacitor 5A is connected between the gate and source electrodes of drive transistor 6A. Drive transistor 6A comprises a pMOS and has its gate electrode connected to the drain electrode of selection transistor 4 and one end of holding capacitor 5A, a source electrode to the cathode of current control element 7A, and a drain electrode to ground line 2. Current control element 7A comprises a pixel display element such as an organic EL element, and is connected between power line 1 and the source electrode of drive transistor 6A. Current control element 7A emits light at a luminance depending on current IL from drive transistor 6A. Parasitic capacitor 8A comprises a parasitic capacitor across current control element 7A.

The drive circuit for the current control element according to the present embodiment differs from the drive circuit according to the thirteenth embodiment shown in FIG. 42 in that selection transistor 4 and drive transistor 6, each comprising an nMOS, are replaced with selection transistor 4A and drive transistor 6A, each comprising a pMOS. Since the voltages applied to the transistors and the current control element are opposite to those in the circuit shown in FIG. 42, the currents also have opposite directions. However, the drive circuit for the current control element according to the present embodiment operates in the same manner as the circuit shown in FIG. 42, and the timing chart shown in FIG. 43 is also applicable here. Therefore, a detailed description of the operation will not be described below.

The drive circuit for the current control element according to the present embodiment comprises a minimum component arrangement including two transistors, i.e., selection transistor 4A and drive transistor 6A, and holding capacitor 5A, and is capable of correcting the threshold value of drive transistor 6A so as not to be susceptible to a change of the threshold value.

According to the seventeenth embodiment, as with the thirteenth embodiment, the number of components of the pixel circuit is smaller than the number of components of the conventional drive circuit for the current control element, and the aperture ratio of the pixel is greater. The manufacturing process is facilitated, and the power consumption is reduced.

Eighteenth Embodiment

A drive circuit for a current control element according to an eighteenth embodiment of the present invention is of the same arrangement as the drive circuit according to the seventeenth embodiment shown in FIG. 53, but operates differently as its control method is different. Specifically, the drive circuit for the current control element according to the eighteenth embodiment differs from the circuit according to the fourth embodiment in that selection transistor 4 and drive transistor 6, each comprising an nMOS, are replaced with selection transistor 4A and drive transistor 6A, each comprising a pMOS. Since the voltages applied to the transistors and the current control element are opposite to those in the circuit according to the fourteenth embodiment, the currents also have opposite directions. However, the drive circuit for the current control element according to the present embodiment operates in the same manner as the circuit according to the fourteenth embodiment, and the timing chart shown in FIG. 48 is also applicable here. Therefore, a detailed description of the operation will not be described below.

The drive circuit for the current control element according to the present embodiment comprises a minimum component arrangement including two transistors, i.e., selection transistor 4A and drive transistor 6A, and holding capacitor 5A, and is capable of correcting the threshold value of drive transistor 6A so as not to be susceptible to a change of the threshold value, as with the seventeenth embodiment. Furthermore, since the source voltage of drive transistor 6A drops quickly, the selection period can be shortened.

Figure 54:
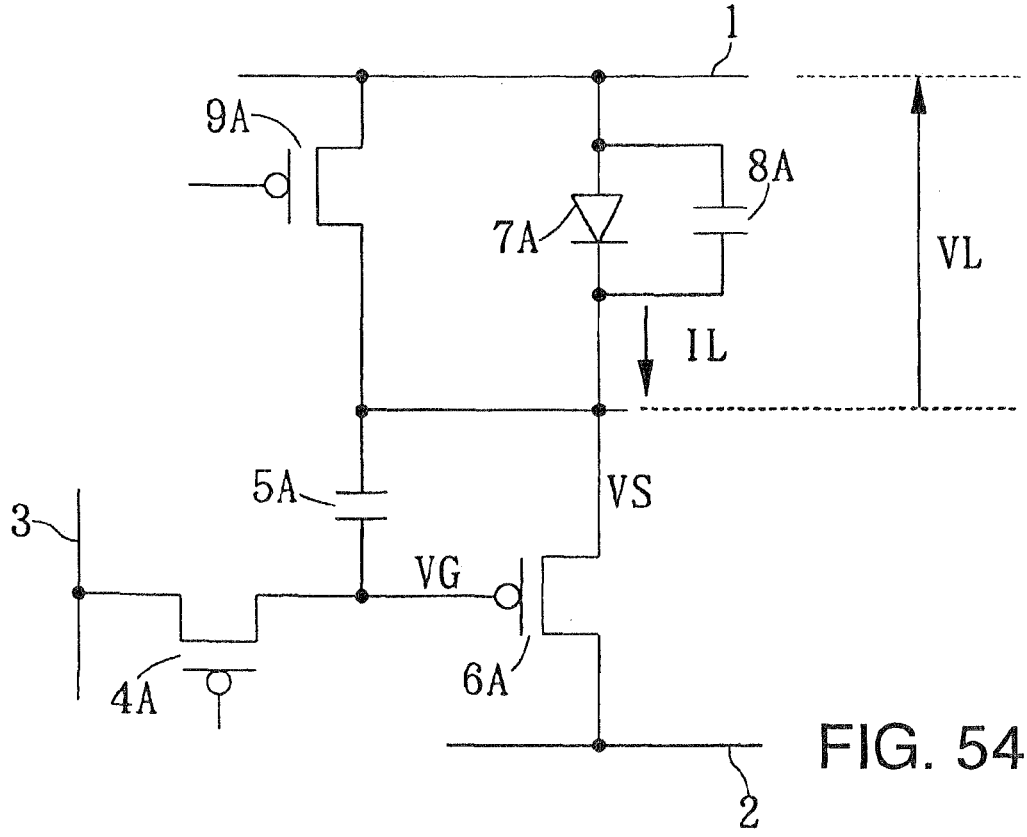
FIG. 54 is a circuit diagram of an arrangement of a drive circuit for a current control element according to a nineteenth embodiment of the present invention.

Nineteenth Embodiment,

FIG. 54 is a circuit diagram of an arrangement of a drive circuit for a current control element according to a nineteenth embodiment of the present invention.

The drive circuit for the current control element according to the present embodiment generally comprises selection transistor 4A, holding capacitor 5A, drive transistor 6A, current control element 7A, parasitic capacitor 8A, and switching transistor 9A, all connected between power line 1, ground line 2, and signal line 3. In this drive circuit for the current control element, the constitutions of power line 1, ground line 2, signal line 3, selection transistor 4A, holding capacitor 5A, drive transistor 6A, current control element 7A, and parasitic capacitor 8A are identical to those of the seventeenth embodiment shown in FIG. 53. However, the drive circuit differs from the seventeenth embodiment in that it additionally has switching transistor 9A as shown in FIG. 54. Switching transistor 9A comprises a pMOS and has a gate electrode connected to a selection line, a source electrode to power line 1, and a drain electrode to the source electrode of drive transistor 6A and one end of holding capacitor 5A.

The drive circuit for the current control element according to the nineteenth embodiment differs from the drive circuit according to the fifteenth embodiment shown in FIG. 49 in that selection transistor 4, drive transistor 6, and switching transistor 9, each comprising an nMOS, are replaced with selection transistor 4A, drive transistor 6A, and switching transistor 9A, each comprising a pMOS. Since the voltages applied to the transistors and the current control element are opposite to those in the circuit according to the fifteenth embodiment shown in FIG. 49, the currents also have opposite directions. However, the drive circuit for the current control element according to the present embodiment operates in the same manner as the circuit according to the fifteenth embodiment, and the timing chart shown in FIG. 50 is also applicable here. Therefore, a detailed description of the operation will not be described below.

As with the seventeenth embodiment, the drive circuit for the current control element according to the present embodiment is capable of correcting the threshold value of drive transistor 6A so as not to be susceptible to a change of the threshold value.

The drive circuit according to the nineteenth embodiment needs switching transistor 9A in addition to the drive circuit according to the seventeenth embodiment. However, since switching transistor 9A can reset holding capacitor 5A and parasitic capacitor 8A of current control element 7A independently of the writing in holding capacitor 5A by selection transistor 4A, holding capacitor 5A and parasitic capacitor 8A can be reset more reliably by selecting a resetting time.

Twentieth Embodiment

Figure 55:
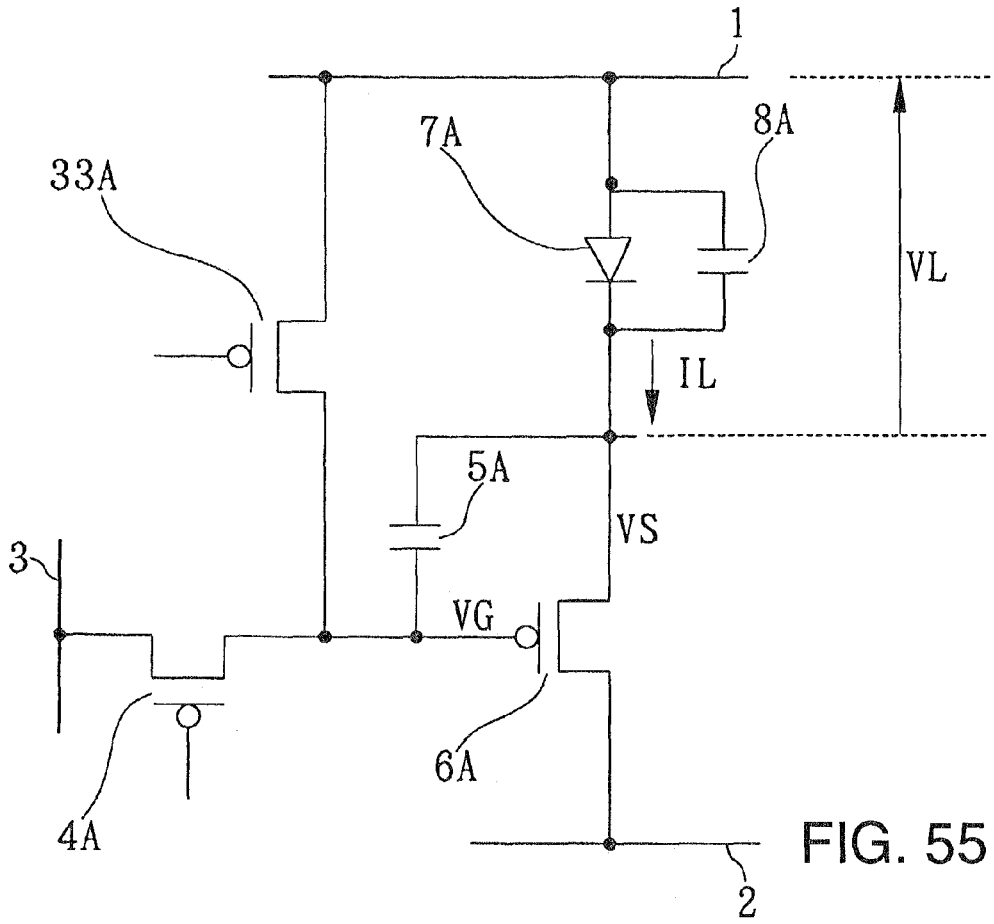
FIG. 55 is a circuit diagram of an arrangement of a drive circuit for a current control element according to a twentieth embodiment of the present invention.

FIG. 55 is a circuit diagram of an arrangement of a drive circuit for a current control element according to a twentieth embodiment of the present invention.

The drive circuit for the current control element according to the present embodiment generally comprises selection transistor 4A, holding capacitor 5A, drive transistor 6A, current control element 7A, parasitic capacitor 8A, and switching transistor 33A, all connected between power line 1, ground line 2, and signal line 3. In this drive circuit for the current control element, the constitutions of power line 1, ground line 2, signal line 3, selection transistor 4A, holding capacitor 5A, drive transistor 6A, current control element 7A, and parasitic capacitor BA are identical to those of the seventeenth embodiment shown in FIG. 53. However, the drive circuit differs from the seventeenth embodiment in that it additionally has switching transistor 33A as shown in FIG. 55. Switching transistor 33A comprises a pMOSP and has a gate electrode connected to a selection line, a source electrode to power line 1, and a drain electrode to the source electrode of drive transistor 6A and one end of holding capacitor 5A.

The drive circuit for the current control element according to the twentieth embodiment differs from the drive circuit according to the sixteenth embodiment shown in FIG. 51 in that selection transistor 4, drive transistor 6, and switching transistor 33, each comprising an nMOS, are replaced with selection transistor 4A, drive transistor 6A, and switching transistor 33A, each comprising a pMOS. Since the voltages applied to the transistors and the current control element are opposite to those in the circuit according to the sixteenth embodiment shown in FIG. 51, the currents also have opposite directions. However, the drive circuit for the current control element according to the present embodiment operates in the same manner as the circuit according to the sixteenth embodiment, and the timing chart shown in FIG. 52 is also applicable here. Therefore, a detailed description of the operation will not be described below.

As with the seventeenth embodiment, the drive circuit for the current control element according to the present embodiment is capable of correcting the threshold value of drive transistor 6A so as not to be susceptible to a change of the threshold value. The drive circuit according to the twentieth embodiment needs switching transistor 33A in addition to the drive circuit according to the seventeenth embodiment. However, since switching transistor 33A can reset holding capacitor 5A and parasitic capacitor 8A of current control element 7A independently of the writing in holding capacitor 5A by selection transistor 4A, holding capacitor 5A and parasitic capacitor 8A can be reset more reliably by selecting a resetting time.

While the first to twentieth embodiments of the present invention have been described in detail with reference to the drawings, the specific arrangements are not limited to these embodiments.

For example, selection transistor $\mathbf{53}_{3,2}$ and resetting transistor $\mathbf{58}_{3,2}$ shown in FIG. 7 may be a pMOS. In this case, however, the control signal input to their gate electrodes need to be of opposite phase to the control signal for nMOSs. Similarly, selection transistor $\mathbf{53}_{3,2}$ and resetting transistor $\mathbf{58}_{3,2}$ shown in FIG. 17 and selection transistor $\mathbf{53}_{3,2}$ shown in FIG. 20 may be an nMOS. Selection transistor $\mathbf{153}_{3,2}$ and resetting transistor $\mathbf{158}_{3,2}$ shown in FIG. 25 may be an nMOS. Similarly, selection transistor $\mathbf{153}_{3,2}$ and resetting transistor $\mathbf{158}_{3,2}$ shown in FIG. 27 and selection transistor $\mathbf{153}_{3,2}$ shown in FIG. 29 may be an nMOS.

pMOS $\mathbf{159}_{3,2}$ according to the ninth embodiment shown in FIG. 32 and pMOS $\mathbf{159}_{3,2}$ according to the tenth embodiment shown in FIG. 36 may be dispensed with to provide substantially the same operation and advantages as with those embodiments. Scanning signal V may be applied to scanning lines $Y_1, \ldots, Y_j, \ldots, Y_m$ not only in a line sequence, but also in any desired sequence. A feedback resistor may be inserted between the source electrode of drive transistor $\mathbf{55}_{3,2}$ shown in FIGS. 7, 17, and 20 and node 2, or between the source electrode of drive transistor $\mathbf{155}_{3,2}$ shown in FIGS. 25, 27, and 29 and node 2, or between the drain electrode thereof and power line 51 for reducing current variations. Likewise, a feedback resistor may be inserted between the source electrode of drive transistor $\mathbf{155}_{3,2}$ shown in FIGS. 32, 36, 38, and 41 and power line 1 for further reducing current variations. The display panels in the embodiments may comprise any current-driven display panel such as a light-emitting diode (LED) array, a field emission display (FED), or the like, other than the organic EL display.

In the fifteenth embodiment, the sixteenth embodiment, the nineteenth embodiment, and the twentieth embodiment, the switching transistor may discharge the charge of holding capacitor 5 and the charge of parasitic capacitor 8 in the non-selection period or in the initial stage of the selection period. They may be discharged in the selection period not only in its terminal stage, but also at any timing therein. If discharged in the initial stage of the selection period, it is necessary to turn off the selection transistor.

In each of the embodiments, if the drive transistor comprises an nMOS, the selection transistor and the switching transistor are not limited to nMOSs but may be a desired mixture of nMOS and pMOS. Similarly, if the drive transistor comprises a pMOS, the selection transistor and the switching transistor are not limited to pMOSs but may be a desired mixture of nMOS and pMOS.

Furthermore, the drive circuits for the current control elements according to the thirteenth to twentieth embodiments are also applicable to a drive circuit for a current control element in an image display apparatus wherein a number of current control elements, i.e., pixel display elements, are arrayed two-dimensionally in rows and columns of a matrix. In this case, the drive circuit also has the same operation and advantages as those of the previous embodiments.

In the fifteenth and sixteenth embodiments, the source electrode of switching transistor 9 is connected to ground line 2. However, the source electrode of switching transistor 9 may be connected to a power line having a different voltage from ground line 2, and the source voltage of drive transistor 6 upon resetting may be set to a voltage other than 0 V for greater circuit design tolerances. The nineteenth and twentieth embodiments may also be similarly modified.

The invention claimed is:

1. An image display apparatus comprising:

a pixel having a drive transistor and a pixel display element which are electrically connected in series between a first power line and a second power line, a holding capacitor electrically connected to a gate electrode of said drive transistor, and a selection transistor electrically connected between a signal line and the gate electrode of said drive transistor; and a controller for turning on said selection transistor thereby to write gradation pixel data in said holding capacitor from said signal line, discharging charges of the gradation pixel data written in said holding capacitor through said drive transistor for a predetermined time less than a frame time, and thereafter floating the gate electrode of said drive transistor thereby to hold the charges of the gradation pixel data stored in said holding capacitor;

a display panel having a plurality of signal lines to which corresponding gradation pixel data are applied and a plurality of scanning lines to which scanning signals are applied, said pixel at positioned each of points of intersection between said signal lines and said scanning lines; a signal line driver for applying said gradation pixel data to said signal lines based on a pixel input signal; and a scanning line driver for applying said scanning signals to said scanning lines; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and said pixel display element has a first electrode and a second electrode; wherein said first drain electrode/said first source electrode is connected to said signal line, said first source electrode/said first drain electrode is connected to said second gate electrode said first ate electrode is connected to said scanning line, and said selection transistor performs on/off control of a conduction state between said signal line and said second gate electrode based on said scanning signal; wherein said first power line is connected to said second drain electrode, said second source electrode is connected to said first electrode, and said drive transistor passes an output current controlled based on a voltage held by said holding capacitor from said second source electrode to said first electrode; and wherein said second power line is connected to said second electrode and said pixel display element displays a pixel at a gradation based on said output current of said drive transistor; and a plurality of resetting signal lines to which resetting signals are applied; and a resetting signal line driver for applying said resetting signals to said resetting signal lines;

wherein said pixel has a resetting transistor having a third drain electrode, a third source electrode, and a third gate electrode, and a parasitic capacitor is formed between said first electrode and said second electrode; wherein said third drain electrode/said third source electrode is connected to said second source electrode, said third source electrode/said third drain electrode is connected to said second power line, said third gate electrode is connected to said resetting signal line, and said resetting transistor performs on/off control of a conduction state between said second source electrode and said second power line based on said resetting signal; and wherein said control means turns on said resetting transistor thereby to discharge said holding capacitor and said parasitic capacitor, and thereafter turns on said selection transistor.

2. The image display apparatus according to claim 1, wherein said scanning signals are applied to said scanning lines in a preset sequence.

3. The image display apparatus according to claim 1, wherein said pixel display element comprises an organic electroluminescence element.

4. An image display apparatus comprising:

a pixel having a drive transistor and a pixel display element which are electrically connected in series between a first power line and a second power line, a holding capacitor electrically connected to a gate electrode of said drive transistor, and a selection transistor electrically connected between a signal line and the gate electrode of said drive transistor; and a controller for turning on said selection transistor thereby to write gradation pixel data in said holding capacitor from said signal line, discharging charges of the gradation pixel data written in said holding capacitor through said drive transistor for a predetermined time less than a frame time, and thereafter floating the gate electrode of said drive transistor thereby to hold the charges of the gradation pixel data stored in said holding capacitor;

a display panel having a plurality of signal lines to which corresponding gradation pixel data are applied and a plurality of scanning lines to which scanning signals are applied, said pixel being positioned at each of points of intersection between said signal lines and said scanning lines; a signal line driver for applying said gradation pixel data to said signal lines based on a pixel input signal; and a scanning line driver for applying said scanning signals to said scanning lines; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and said pixel display element has a first electrode and a second electrode; wherein said first drain electrode/said first source electrode is connected to said signal line, said first source electrode/said first drain electrode is connected to said second gate electrode, said first gate electrode is connected to said scanning line, and said selection transistor performs on/off control of a conduction state between said signal line and said second gate electrode based on said scanning signal; wherein said first power line is connected to said second drain electrode, said second source electrode is connected to said first electrode and said drive transistor passes an output current controlled based on a voltage held by said holding capacitor from said second source electrode to said first electrode; and wherein said second power line is connected to said second electrode, and said pixel display element displays a pixel at a gradation based on said output current of said drive transistor; and a plurality of resetting signal lines to which resetting signals are applied; and a resetting signal line driver for applying said resetting signals to said resetting signal lines;

wherein said pixel has a resetting transistor having a third drain electrode, a third source electrode, and a third gate electrode, and a parasitic capacitor is formed between said first electrode and said second electrode; wherein said third drain electrode/said third source electrode is connected to said second source electrode, said third source electrode/said third drain electrode is connected to said first power line, said third gate electrode is connected to said reset signal line, and said resetting transistor performs on/off control of a conduction state between said second source electrode and said first power line based on said resetting signal; and wherein said control means turns on said resetting transistor thereby to discharge said holding capacitor and said parasitic capacitor, and thereafter turns on said selection transistor.

5. An image display apparatus comprising:

a pixel having a drive transistor and a pixel display element which are electrically connected in series between a first power line and a second power line, a holding capacitor electrically connected to a gate electrode of said drive transistor, and a selection transistor electrically connected between a signal line and the gate electrode of said drive transistor; and a controller for turning on said selection transistor thereby to write gradation pixel data in said holding capacitor from said signal line, discharging charges of the gradation pixel data written in said holding capacitor through said drive transistor for a predetermined time less than a frame time, and thereafter floating the gate electrode of said drive transistor thereby to hold the charges of the gradation pixel data stored in said holding capacitor;

a display panel having a plurality of signal lines to which corresponding gradation pixel data are applied and a plurality of scanning lines to which scanning signals are applied, said pixel being positioned at each of points of intersection between said signal lines and said scanning lines; a signal line driver for applying said gradation pixel data to said signal lines based on a pixel input signal; and a scanning line driver for applying said scanning signals to said scanning lines; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and said pixel display element has a first electrode and a second electrode; wherein said first drain electrode/said first source electrode is connected to said signal line, said first source electrode/said first drain electrode is connected to said second gate electrode, said first gate electrode is connected to said scanning line, and said selection transistor performs on/off control of a conduction state between said signal line and said second gate electrode based on said scanning signal; wherein said first power line is connected to said second drain electrode, said second source electrode is connected to said first electrode and said drive transistor sasses an output current controlled based on a voltage held by said holding capacitor from said second source electrode to said first electrode; and wherein said second power line is connected to said second electrode and said pixel display element displays a pixel at a gradation based on said output current of said drive transistor, wherein said pixel display element has a parasitic capacitor between said first electrode and said second electrode; and wherein said controller turns on said resetting transistor and supplies a resetting signal voltage from said signal line thereby to discharge said holding capacitor and said parasitic capacitor, and thereafter writes said gradation pixel data from said signal line in said holding capacitor.

6. An image display apparatus comprising:

a pixel having a drive transistor and a pixel display element which are electrically connected in series between a first power line and a second power line, a holding capacitor electrically connected to a gate electrode of said drive transistor, and a selection transistor electrically connected between a signal line and the gate electrode of said drive transistor; and a controller for turning on said selection transistor thereby to write gradation pixel data in said holding capacitor from said signal line, discharging charges of the gradation pixel data written in said holding capacitor through said drive transistor for a predetermined time less than a frame time, and thereafter floating the gate electrode of said drive transistor thereby to hold the charges of the gradation pixel data stored in said holding capacitor;

a display panel having a plurality of signal lines to which corresponding gradation pixel data are applied and a plurality of scanning lines to which scanning signals are applied, said pixel being positioned at each of points of intersection between said signal lines and said scanning lines; a signal line driver for applying said gradation pixel data to said signal lines based on a pixel input signal; and a scanning line driver for applying said scanning signals to said scanning lines; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and said pixel display element has a first electrode and a second electrode; wherein said first drain electrode/said first source electrode is connected to said signal line, said first source electrode/said first drain electrode is connected to said second gate electrode, said first gate electrode is connected to said scanning line, and said selection transistor performs on/off control of a conduction state between said signal line and said second gate electrode based on said scanning signal; wherein said first power line is connected to said second drain electrode, said second source electrode is connected to said first electrode and said drive transistor passes an output current controlled based on a voltage held by said holding capacitor from said second source electrode to said first electrode; and wherein said second power line is connected to said second electrode, and said pixel display element displays a pixel at a gradation based on said output current of said drive transistor; and a power supply circuit for supplying a first power voltage and a second power voltage respectively for said first power line and said second power line to said display panel; wherein said pixel display element has a parasitic capacitor between said first electrode and said second electrode; and wherein said controller sets said first power voltage to a resetting signal voltage thereby to discharge said holding capacitor and said parasitic capacitor, and thereafter turns on said selection transistor thereby to write said gradation pixel data from said signal line in said holding capacitor.

7. An image display apparatus comprising:

a pixel having a drive transistor and a pixel display element which are electrically connected in series between a first power line and a second power line, a holding capacitor electrically connected to a gate electrode of said drive transistor, and a selection transistor electrically connected between a signal line and the gate electrode of said drive transistor; and a controller for turning on said selection transistor thereby to write gradation pixel data in said holding capacitor from said signal line, discharging charges of the gradation pixel data written in said holding capacitor through said drive transistor for a predetermined time less than a frame time, and thereafter floating the gate electrode of said drive transistor thereby to hold the charges of the gradation pixel data stored in said holding capacitor;

a display panel having a plurality of signal lines to which corresponding gradation pixel data are applied, a plurality of control lines to which control line drive signals are applied, and a plurality of scanning lines to which scanning signals are applied, said pixel being positioned at each of points of intersection between said signal lines and said scanning lines;

a signal line driver for applying said gradation pixel data to said signal lines based on a pixel input signal;

a scanning line driver for applying said scanning signals to said scanning lines; and a control line driver for applying said control line drive signals to said control lines; wherein said pixel has a control transistor having a third drain electrode, a third source electrode, and a third gate electrode; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and each pixel display element has a first electrode, a second electrode, and a parasitic capacitor between said first electrode and said second electrode; wherein said first drain electrode/said first source electrode is connected to said signal line, said first source electrode/said first drain electrode is connected to said second gate electrode, said first gate electrode is connected to said scanning line, and said selection transistor performs on/off control of a conduction state between said signal line and said second gate electrode based on said scanning signal; wherein said first power line is connected to said second source electrode, said drive transistor passes an output current controlled based on a voltage held by said holding capacitor from said second drain electrode to said first electrode; wherein said third drain electrode/said third source electrode is connected to said second gate electrode, said third source electrode/said third drain electrode is connected to said second drain electrode, said third gate electrode is connected to said control line, and said control transistor performs on/off control of a conduction state between said second gate electrode and said second drain electrode based on said control line drive signal: wherein said second power line is connected to said second electrode, and said pixel display element displays a pixel at a gradation based on said output current of said drive transistor; and wherein said controller turns on said selection transistor and turns off said control transistor thereby to write said gradation pixel data from said signal line in said holding capacitor, turns off said selection transistor and turns on said control transistor thereby to discharge charges of said gradation pixel data written in said holding capacitor through said drive transistor for a predetermined time, and thereafter turns off said control transistor thereby to float said second gate electrode to hold the charges of said gradation pixel data stored in said holding capacitor.

8. An image display apparatus comprising:

a pixel having a drive transistor and a pixel display element which are electrically connected in series between a first power line and a second power line, a holding capacitor electrically connected to a gate electrode of said drive transistor, and a selection transistor electrically connected between a signal line and the gate electrode of said drive transistor; and a controller for turning on said selection transistor thereby to write gradation pixel data in said holding capacitor from said signal line, discharging charges of the gradation pixel data written in said holding capacitor through said drive transistor for a predetermined time less than a frame time, and thereafter floating the gate electrode of said drive transistor thereby to hold the charges of the gradation pixel data stored in said holding capacitor;

a display panel having a plurality of signal lines to which corresponding gradation pixel data are applied, a plurality of control lines to which control line drive signals are applied, and a plurality of scanning lines to which scanning signals are applied, said pixel being positioned at each of points of intersection between said signal lines and said scanning lines;

a signal line driver for applying said gradation pixel data to said signal lines based on a pixel input signal;

a scanning line driver for applying said scanning signals to said scanning lines; and a control line driver for applying said control line drive signals to said control lines; wherein said pixel has a control transistor having a third drain electrode, a third source electrode, and a third gate electrode; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and each pixel display element has a first electrode, a second electrode, and a parasitic capacitor between said first electrode and said second electrode; wherein said first drain electrode/said first source electrode is connected to said signal line, said first source electrode/said first drain electrode is connected to said second gate electrode, said first gate electrode is connected to said scanning line, and said selection transistor performs on/off control of a conduction state between said signal line and said second gate electrode based on said scanning signal; wherein said first power line is connected to said second source electrode, said drive transistor passes an output current controlled based on a voltage held by said holding capacitor from said second drain electrode to said first electrode; wherein said third drain electrode/said third source electrode is connected to said second gate electrode, said third source electrode/said third drain electrode is connected to said second drain electrode, said third gate electrode is connected to said control line, and said control transistor performs on/off control of a conduction state between said second gate electrode and said first drain electrode based on said control line drive signal: wherein said second power line is connected to said second electrode, and said pixel display element displays a pixel at a gradation based on said output current of said drive transistor; and wherein said controller turns on said selection transistor and turns on said control transistor thereby to write said gradation pixel data from said signal line in said holding capacitor, turns off said selection transistor and turns on said control transistor thereby to discharge charges of said gradation pixel data written in said holding capacitor through said drive transistor for a predetermined time, and thereafter turns off said control transistor thereby to float said second gate electrode to hold the charges of said gradation pixel data stored in said holding capacitor.

9. An image display apparatus comprising:

a pixel having a drive transistor and a pixel display element which are electrically connected in series between a first power line and a second power line, a holding capacitor electrically connected to a gate electrode of said drive transistor, and a selection transistor electrically connected between a signal line and the gate electrode of said drive transistor; and a controller for turning on said selection transistor thereby to write gradation pixel data in said holding capacitor from said signal line, discharging charges of the gradation pixel data written in said holding capacitor through said drive transistor for a predetermined time less than a frame time, and thereafter floating the gate electrode of said drive transistor thereby to hold the charges of the gradation pixel data stored in said holding capacitor;

a display panel having a plurality of signal lines to which corresponding gradation pixel data are applied, a plurality of control lines to which control line drive signals are applied, and a plurality of scanning lines to which scanning signals are applied, said pixel being positioned at each of points of intersection between said signal lines and said scanning lines;

a signal line driver for applying said gradation pixel data to said signal lines based on a pixel input signal;

a scanning line driver for applying said scanning signals to said scanning lines; and a control line driver for applying said control line drive signals to said control lines; wherein said pixel has a control transistor having a third drain electrode, a third source electrode, and a third gate electrode; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and each pixel display element has a first electrode, a second electrode, and a parasitic capacitor between said first electrode and said second electrode; wherein said first drain electrode/said first source electrode is connected to said signal line, said first source electrode/said first drain electrode is connected to said second drain electrode, said first gate electrode is connected to said scanning line, and said selection transistor performs on/off control of a conduction state between said signal line and said second drain electrode based on said scanning signal; wherein said first power line is connected to said second source electrode, said drive transistor passes an output current controlled based on a voltage held by said holding capacitor from said second drain electrode to said first electrode; wherein said third drain electrode/said third source electrode is connected to said second gate electrode, said third source electrode/said third drain electrode is connected to said second drain electrode, said third gate electrode is connected to said control line, and said control transistor performs on/off control of a conduction state between said second gate electrode and said second drain electrode based on said control line drive signal; wherein said second power line is connected to said second electrode, and said pixel display element displays a pixel at a gradation based on said output current of said drive transistor; and wherein said controller turns on said selection transistor and turns on said control transistor thereby to write said gradation pixel data from said signal line in said holding capacitor, turns off said selection transistor and turns on said control transistor thereby to discharge charges of said gradation pixel data written in said holding capacitor through said drive transistor for a predetermined time, and thereafter turns off said control transistor thereby to float said second gate electrode to hold the charges of said gradation pixel data stored in said holding capacitor.

10. An image display apparatus comprising:

a pixel having a drive transistor and a pixel display element which are electrically connected in series between a first power line and a second power line, a holding capacitor electrically connected to a gate electrode of said drive transistor, and a selection transistor electrically connected between a signal line and the gate electrode of said drive transistor; and a controller for turning said selection transistor thereby to write gradation pixel data in said holding capacitor from said signal line, discharging charges of the gradation pixel data written in said holding capacitor through said drive transistor for a predetermined time less than a frame time, and thereafter floating the gate electrode of said drive transistor thereby to hold the charges of the gradation pixel data stored in said holding capacitor;

a display panel having a plurality of signal lines to which corresponding gradation pixel data are applied, a plurality of control lines to which control line drive signals are applied, and a plurality of scanning lines to which scanning signals are applied, said pixel being positioned at each of points of intersection between said signal lines and said scanning lines;

a signal line driver for applying said gradation pixel data to said signal lines based on a pixel input signal;

a scanning line driver for applying said scanning signals to said scanning lines; and a control line driver for applying said control line drive signals to said control lines; wherein each pixel has a control transistor having a third drain electrode, a third source electrode, and a third gate electrode, and an input drive transistor having a fourth drain electrode, a fourth source electrode, and a fourth gate electrode; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and each pixel display element has a first electrode, a second electrode, and a parasitic capacitor between said first electrode and said second electrode; wherein said first drain electrode/said first source electrode is connected to said signal line, said first source electrode/said first drain electrode is connected to said third drain electrode/said third source electrode, said first gate electrode is connected to said scanning line, and said selection transistor performs on/off control of a conduction state between said signal line and said third drain electrode/said third source electrode based on said scanning signal; wherein said first power line is connected to said second source electrode, said drive transistor passes a first output current controlled based on a voltage held by said holding capacitor from said second drain electrode to said first electrode; wherein said third drain electrode/said third source electrode is connected to said first source electrode/said first drain electrode, said third source electrode/said third drain electrode is connected to said second gate electrode, said third gate electrode is connected to said control line, and said control transistor performs on/off control of a conduction state between said first source electrode/said first drain electrode and said second gate electrode based on said control line drive signal; wherein said first power line is connected to said fourth source electrode, said fourth drain electrode is connected to said first source electrode/said first drain electrode, said fourth gate electrode is connected to said second gate electrode, said input drive transistor passes a second output current controlled based on a voltage between said fourth source electrode and said fourth gate electrode from said fourth source electrode to said fourth drain electrode; wherein said second power line is connected to said second electrode, and said pixel display element displays a pixel at a gradation based on said first output current of said drive transistor; and wherein said controller turns on said selection transistor and turns on said control transistor thereby to write said gradation pixel data from said signal line in said holding capacitor, turns off said selection transistor and turns on said control transistor thereby to discharge charges of said gradation pixel data written in said holding capacitor through said input drive transistor for a predetermined time, and thereafter turns off said control transistor thereby to float said second gate electrode to hold the charges of said gradation pixel data stored in said holding capacitor.

11. An image display apparatus comprising:

pixel having a drive transistor and a pixel display element which are electrically connected in series between a first power line and a second power line a holding capacitor electrically connected to a gate electrode of said drive transistor, and a selection transistor electrically connected between a signal line and the gate electrode of said drive transistor; and a controller for turning on said selection transistor thereby to write gradation pixel data in said holding capacitor from said signal line, discharging charges of the gradation pixel data written in said holding capacitor through said drive transistor for a predetermined time less than a frame time, and thereafter floating the gate electrode of said drive transistor thereby to hold the charges of the gradation pixel data stored in said holding capacitor;

a display panel having a plurality of signal lines to which corresponding gradation pixel data are applied, a plurality of control lines to which control line drive signals are applied, and a plurality of scanning lines to which scanning signals are applied, said pixel being positioned at each of points of intersection between said signal lines and said scanning lines;

a signal line driver for applying said gradation pixel data to said signal lines based on a pixel input signal:

a scanning line driver for applying said scanning signals to said scanning lines; and a control line driver for applying said control line drive signals to said control lines; wherein said pixel has a control transistor having a third drain electrode, a third source electrode, and a third gate electrode, and an input drive transistor having a fourth drain electrode, a fourth source electrode, and a fourth gate electrode; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and each pixel display element has a first electrode, a second electrode, and a parasitic capacitor between said first electrode and said second electrode; wherein said first drain electrode/said first source electrode is connected to said signal line, said first source electrode/said first drain electrode is connected to said third drain electrode/said third source electrode, said first gate electrode is connected to said scanning line, and said selection transistor performs on/off control of a conduction state between said signal line and said third drain electrode/said third source electrode based on said scanning signal; wherein said first power line is connected to said second source electrode, said drive transistor passes a first output current controlled based on a voltage held by said holding capacitor from said second drain electrode to said first electrode; wherein said third drain electrode/said third source electrode is connected to said first source electrode/said first drain electrode and said fourth gate electrode, said third source electrode/said third drain electrode is connected to said second gate electrode, said third gate electrode is connected to said control line, and said control transistor performs on/off control of a conduction state between said first source electrode/said first drain electrode and said second gate electrode based on said control line drive signal; wherein said first power line is connected to said fourth source electrode, said fourth drain electrode is connected to said first source electrode/said first drain electrode, said fourth gate electrode is connected to said fourth drain electrode, said input drive transistor passes a second output current controlled based on a voltage between said fourth source electrode and said fourth gate electrode from said fourth source electrode to said fourth drain electrode; wherein said second power line is connected to said second electrode, and said pixel display element displays a pixel at a gradation based on said first output current of said drive transistor; and wherein said controller turns on said selection transistor and turns on said control transistor thereby to write said gradation pixel data from said signal line in said holding capacitor, turns off said selection transistor and turns on said control transistor thereby to discharge charges of said gradation pixel data written in said holding capacitor through said input drive transistor for a predetermined time, and thereafter turns off said control transistor thereby to float said second gate electrode to hold the charges of said gradation pixel data stored in said holding capacitor.

12. An image display apparatus comprising: pixel having a drive transistor and a pixel display element which are electrically connected in series between a first power line and a second power line, a holding capacitor electrically connected to a gate electrode of said drive transistor, and a selection transistor electrically connected between a signal line and the gate electrode of said drive transistor; and a controller for turning on said selection transistor thereby to write gradation pixel data in said holding capacitor from said signal line, discharging charges of the gradation pixel data written in said holding capacitor through said drive transistor for a predetermined time less than a frame time, and thereafter floating the gate electrode of said drive transistor thereby to hold the charges of the gradation pixel data stored in said holding capacitor a resetting transistor having a drain electrode connected to a node between the drive transistor and the pixel display element, a source electrode connected to one of the first power line and the second power line, and a gate electrode connected to a resetting signal line.

13. A control method for an image display apparatus including a pixel having a drive transistor and a pixel display element which are connected in series between a first power line and a second power line, a holding capacitor connected to a gate electrode of said drive transistor, and a selection transistor connected between a signal line and the gate electrode of said drive transistor, comprising: a pixel data writing step of turning on said selection transistor thereby to write gradation pixel data in said holding capacitor from said signal line; a discharging step of discharging charges of the gradation pixel data written in said holding capacitor through said drive transistor for a predetermined time less than a frame time and after said discharging step, a pixel data holding step of floating the gate electrode of said drive transistor thereby to hold the charges of the gradation pixel data stored in said holding capacitor, wherein said image display apparatus further includes: a display panel having a plurality of signal lines to which corresponding gradation pixel data are applied and a plurality of scanning lines to which scanning signals are applied, said pixel being positioned at each of points of intersection between said signal lines and said scanning lines; a signal line driver for applying said gradation pixel data to said signal lines based on a pixel input signal; and a scanning line driver for applying said scanning signals to said scanning lines; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and said pixel display element has a first electrode and a second electrode; wherein said first drain electrode/said first source electrode is connected to said signal line, said first source electrode/said first drain electrode is connected to said second gate electrode said first gate electrode is connected to said scanning line, said selection transistor performs on/off control of a conduction state between said signal line and said second gate electrode based on said scanning signal wherein said first power line is connected to said second drain electrode, said second source electrode is connected to said first electrode, and said drive transistor passes an output current controlled based on a voltage held by said holding capacitor from said second source electrode to said first electrode; and wherein said second power line is connected to said second electrode, and said pixel display element displays a pixel at a gradation based on said output current of said drive transistor wherein said image display apparatus further includes: a plurality of resetting signal lines to which resetting signals are applied; and a resetting signal line driver for applying said resetting signals to said resetting signal lines; wherein each pixel has a resetting transistor having a third drain electrode, a third source electrode, and a third gate electrode, and a parasitic capacitor is formed between said first electrode and said second electrode; wherein said third drain electrode/said third source electrode is connected to said second source electrode, said third source electrode/said third drain electrode is connected to said second power line, said third gate electrode is connected to said reset signal line, and said resetting transistor performs on/off control of a conduction state between said second source electrode and said second power line based on said resetting signal; and wherein said control method further comprises an additional discharging step of turning on said resetting transistor thereby to discharge said holding capacitor and said parasitic capacitor before said pixel data writing step; and wherein said selection transistor is turned off in said pixel data holding step to float said second gate electrode.

14. The control method according to claim 13, wherein said scanning signals are applied to said scanning lines in a preset sequence.

15. The control method according to claim 13, wherein said pixel display element comprises an organic electroluminescence element.

16. , A control method for an image display apparatus including a pixel having a drive transistor and a pixel display element which are connected in series between a first power line and a second power line, a holding capacitor connected to a gate electrode of said drive transistor, and a selection transistor connected between a signal line and the gate electrode of said drive transistor, comprising: a pixel data writing step of turning on said selection transistor thereby to write gradation pixel data in said holding capacitor from said signal line; a discharging step of discharging charges of the gradation pixel data written in said holding capacitor through said drive transistor for a predetermined time less than a frame time and after said discharging step, a pixel data holding step of floating the gate electrode of said drive transistor thereby to hold the charges of the gradation pixel data stored in said holding capacitor, wherein said image display apparatus further includes: a display panel having a plurality signal lines to which corresponding gradation pixel data are applied and a plurality scanning lines to which scanning signals are applied, said pixel being positioned at each of points of intersection between said signal lines and said scanning lines; a signal line driver for applying said gradation pixel data to said signal lines based on a pixel input signal; and a scanning line driver for applying said scanning signals to said scanning lines; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and said pixel display element has a first electrode and a second electrode; wherein said first drain electrode/said first source electrode is connected to said signal line, said first source electrode/said first drain electrode is connected to said second gate electrode, said first gate electrode is connected to said scanning line, said selection transistor performs on/off control of a conduction state between said signal line and said second gate electrode based on said scanning signal; wherein said first power line is connected to said second drain electrode, said second source electrode is connected to said first electrode and said drive transistor passes an output current controlled based on a voltage held by said holding capacitor from said second source electrode to said first electrode; and wherein said second power line is connected to said second electrode, and said pixel display element displays a pixel at a gradation based on said output current of said drive transistor, wherein said image display apparatus includes: a plurality of resetting signal lines to which resetting signals are applied; and a resetting signal line driver for applying said resetting signals to said resetting signal lines; wherein each pixel has a resetting transistor having a third drain electrode, a third source electrode, and a third gate electrode, and a parasitic capacitor is formed between said first electrode and said second electrode; wherein said third drain electrode/said third source electrode is connected to said second source electrode, said third source electrode/said third drain electrode is connected to said first power line, said third gate electrode is connected to said resetting signal line, and said resetting transistor performs on/off control of a conduction state between said second source electrode and said first power line based on said resetting signal; and wherein said control method further comprises an additional discharging step of turning on said resetting transistor thereby to discharge said holding capacitor and said parasitic capacitor before said pixel data writing step; and wherein said selection transistor is turned off in said pixel data holding step to float said second gate electrode.

17. A control method for an image display apparatus including a pixel having a drive transistor and a pixel display element which are connected in series between a first power line and a second power line, a holding capacitor connected to a gate electrode of said drive transistor and a selection transistor connected between a signal line and the gate electrode of said drive transistor, comprising: a pixel data writing step of turning on said selection transistor thereby to write gradation pixel data in said holding capacitor from said signal line; a discharging step of discharging charges of the gradation pixel data written in said holding capacitor through said drive transistor for a predetermined time less than a frame time and after said discharging step, a pixel data holding step of floating the gate electrode of said drive transistor thereby to hold the charges of the gradation pixel data stored in said holding capacitor, wherein said image display apparatus further includes: a display panel having a plurality of signal lines to which corresponding gradation pixel data are applied and a plurality of scanning lines to which scanning signals are applied, said pixel being positioned at each of points of intersection between said signal lines and said scanning lines; a signal line driver for applying said gradation pixel data to said signal lines based on a pixel input signal; and a scanning line driver for a lying said scanning signals to said scanning lines; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and said pixel display element has a first electrode and a second electrode; wherein said first drain electrode/said first source electrode is connected to said signal line, said first source electrode/said first drain electrode is connected to said second gate electrode, said first gate electrode is connected to said scanning line, said selection transistor performs on/off control of a conduction state between said signal line and said second gate electrode based on said scanning signal; wherein said first power line is connected to said second drain electrode, said second source electrode is connected to said first electrode, and said drive transistor passes an output current controlled based on a voltage held by said holding capacitor from said second source electrode to said first electrode; and wherein said second power line is connected to said second electrode, and said pixel display element displays a pixel at a gradation based on said output current of said drive transistor, wherein said pixel display element has a parasitic capacitor between said first electrode and said second electrode; and wherein said control method further comprises an additional discharging step of turning on said selection transistor and supplying a resetting signal voltage from said signal line thereby to discharge said holding capacitor and said parasitic capacitor before said pixel data writing step; and wherein said selection transistor is turned off in said pixel data holding step to float said second gate electrode.

18. A control method for an image display apparatus including a pixel having a drive transistor and a pixel display element which are connected in series between a first power line and a second power line, a holding capacitor connected to a gate electrode of said drive transistor, and a selection transistor connected between a signal line and the gate electrode of said drive transistor, comprising: a pixel data writing step of turning on said selection transistor thereby to write gradation pixel data in said holding capacitor from signal line; a discharging step of discharging charges of the gradation pixel data written in said holding capacitor through said drive transistor for a predetermined time less than a frame time and after said discharging step, a pixel data holding step of floating the gate electrode of said drive transistor thereby to hold the charges of the gradation pixel data stored in said holding capacitor, wherein said image display apparatus further includes: a display panel having a plurality of signal lines to which corresponding gradation pixel data are applied and a plurality of scanning lines to which scanning signals are applied, said pixel being positioned at each of points of intersection between said signal lines and said scanning lines; a signal line driver for applying said gradation pixel data to said signal lines based on a pixel input signal; and a scanning line driver for applying said scanning signals to said scanning lines; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and said pixel display element has a first electrode and a second electrode; wherein said first drain electrode/said first source electrode is connected to said signal line, said first source electrode/said first drain electrode is connected to said second gate electrode, said first gate electrode is connected to said scanning line, said selection transistor performs on/off control of a conduction state between said signal line and said second gate electrode based on said scanning signal; wherein said first power line is connected to said second drain electrode, said second source electrode is connected to said first electrode, and said drive transistor passes an output current controlled based on a voltage held by said holding capacitor from said second source electrode to said first electrode; and wherein said second power line is connected to said second electrode, and said pixel display element displays a pixel at a gradation based on said output current of said drive transistor, wherein said image display apparatus further includes a power supply circuit for supplying a first power voltage and a second power voltage respectively for said first power line and said second power line to said display panel; wherein said pixel display element has a parasitic capacitor between said first electrode and said second electrode; and wherein said control method further comprises an additional discharging step of setting said first power voltage to a resetting signal voltage thereby to discharge said holding capacitor and said parasitic capacitor before said pixel data writing step; and wherein said selection transistor is turned off in said pixel data holding step to float said second gate electrode.

19. A control method for an image display apparatus including a pixel having a drive transistor and a pixel display element which are connected in series between a first power line and a second power line, a holding capacitor connected to a gate electrode of said drive transistor, and a selection transistor connected between a signal line and the gate electrode of said drive transistor, comprising: a pixel data writing step of turning on said selection transistor thereby to write gradation pixel data in said holding capacitor from said signal line; a discharging step of discharging charges of the gradation pixel data written in said holding capacitor through said drive transistor for a predetermined time less than a frame time and after said discharging step, a pixel data holding step of floating the gate electrode of said drive transistor thereby to hold the charges of the gradation pixel data stored in said holding capacitor, wherein said image display apparatus further includes: a display panel having a plurality of signal lines to which corresponding gradation pixel data are applied, a plurality of control lines to which control line drive signals are applied, and a plurality of scanning lines to which scanning signals are applied, said pixel being positioned at each of points of intersection between said signal lines and said scanning lines; a signal line driver for applying said gradation pixel data to said signal lines based on a pixel input signal; a scanning line driver for applying said scanning signals to said scanning lines; and a control line driver for applying said control line drive signals to said control lines; wherein said pixel has a control transistor having a third drain electrode, a third source electrode, and a third gate electrode; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and each pixel display element has a first electrode, a second electrode, and a parasitic capacitor between said first electrode and said second electrode; wherein said first drain electrode/said first source electrode is connected to said signal line, said first source electrode/said first drain electrode is connected to said second gate electrode, said first gate electrode is connected to said scanning line, and said selection transistor, performs on/off control of a conduction state between said signal line and said second gate electrode based on said scanning signal; wherein said first power line is connected to said second source electrode, said drive transistor passes an output current controlled based on a voltage held by said holding capacitor from said second drain electrode to said first electrode; wherein said third drain electrode/said third source electrode is connected to said second gate electrode, said third source electrode/said third drain electrode is connected to said second drain electrode, said third gate electrode is connected to said control line, and said control transistor performs on/off control of a conduction state between said second gate electrode and said second drain electrode based on said control line drive signal; wherein said second power line is connected to said second electrode, and said pixel display element displays a pixel at a gradation based on said output current of said drive transistor; and wherein said selection transistor is turned on and said control transistor is turned off thereby to write said gradation pixel data from said signal line in said holding capacitor in said pixel data writing step; said selection transistor is turned off and said control transistor is turned on thereby to discharge charges of said gradation pixel data written in said holding capacitor through said drive transistor for a predetermined time in said discharging step; and said control transistor is turned off thereby to float said second gate electrode in said pixel data holding step.

20. A control method for an image display apparatus including a pixel having a drive transistor and a pixel display element which are connected in series between a first power line and a second power line, a holding capacitor connected to a gate electrode of said drive transistor, and a selection transistor connected between a signal line and the gate electrode of said drive transistor, comprising: a pixel data writing step of turning on said selection transistor thereby to write gradation pixel data in said holding capacitor from said signal line; a discharging step of discharging charges of the gradation pixel data written in said holding capacitor through said drive transistor for a predetermined time less than a frame time and after said discharging step, a pixel data holding step of floating the gate electrode of said drive transistor thereby to hold the charges of the gradation pixel data stored in said holding capacitor, wherein said image display apparatus further includes: a display panel having a plurality of signal lines to which corresponding gradation pixel data are applied, a plurality of control lines to which control line drive signals are applied, and a plurality of scanning lines to which scanning signals are applied, said pixel being positioned at each of points of intersection between said signal lines and said scanning lines; a signal line driver for applying said gradation pixel data to said signal lines based on a pixel input signal; a scanning line driver for applying said scanning signals to said scanning lines; and a control line driver for applying said control line drive signals to said control lines; wherein said pixel has a control transistor having a third drain electrode, a third source electrode, and a third gate electrode; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and each pixel display element has a first electrode, a second electrode, and a parasitic capacitor between said first electrode and said second electrode; wherein said first drain electrode/said first source electrode is connected to said signal line, said first source electrode/said first drain electrode is connected to said second gate electrode, said first gate electrode is connected to said scanning line, and said selection transistor performs on/off control of a conduction state between said signal line and said second gate electrode based on said scanning signal; wherein said first power line is connected to said second source electrode, said drive transistor passes an output current controlled based on a voltage held by said holding capacitor from said second drain electrode to said first electrode; wherein said third drain electrode/said third source electrode is connected to said second gate electrode, said third source electrode/said third drain electrode is connected to said second drain electrode, said third gate electrode is connected to said control line, and said control transistor performs on/off control of a conduction state between said second gate electrode and said first drain electrode based on said control line drive signal; wherein said second power line is connected to said second electrode, and said pixel display element displays a pixel at a gradation based on said output current of said drive transistor; and wherein said selection transistor is turned on and said control transistor is turned on thereby to write said gradation pixel data from said signal line in said holding capacitor in said pixel data writing step; said selection transistor is turned off and said control transistor is turned on thereby to discharge charges of said gradation pixel data written in said holding capacitor through said drive transistor for a predetermined time in said discharging step; said control transistor is turned off thereby to float said second gate electrode in said pixel data holding step.

21. A control method for an image display apparatus including a pixel having a drive transistor and a pixel display element which are connected in series between a first power line and a second power line, a holding capacitor connected to a gate electrode of said drive transistor, and a selection transistor connected between a signal line and the gate electrode of said drive transistor, comprising: a pixel data writing step of turning on said selection transistor thereby to write gradation pixel data in said holding from said signal line; a discharging step of discharging charges of the gradation pixel data written in said holding capacitor through said drive transistor for a predetermined time less than a frame time and after said discharging step, a pixel data holding step of floating the gate electrode of said drive transistor thereby to hold the charges of the gradation pixel data stored in said holding capacitor, wherein said image display apparatus further includes: a display panel having a plurality of signal lines to which corresponding gradation pixel data are applied, a plurality of control lines to which control line drive signals are applied, and a plurality of scanning lines to which scanning signals are applied, said pixel being positioned at each of points of intersection between said signal lines and said scanning lines; a signal line driver for applying said gradation pixel data to said signal lines based on a pixel input signal; a scanning line driver for applying said scanning signals to said scanning lines; and a control line driver for applying said control line drive signals to said control lines; wherein said pixel has a control transistor having a third drain electrode, a third source electrode, and a third gate electrode; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and each pixel display element has a first electrode, a second electrode, and a parasitic capacitor between said first electrode and said second electrode; wherein said first drain electrode/said first source electrode is connected to said signal line, said first source electrode/said first drain electrode is connected to said second drain electrode, said first gate electrode is connected to said scanning line, and said selection transistor performs on/off control of a conduction state between said signal line and said second drain electrode based on said scanning signal; wherein said first power line is connected to said second source electrode, said drive transistor passes an output current controlled based on a voltage held by said holding capacitor from said second drain electrode to said first electrode; wherein said third drain electrode/said third source electrode is connected to said second gate electrode, said third source electrode/said third drain electrode is connected to said second drain electrode, said third gate electrode is connected to said control line, and said control transistor performs on/off control of a conduction state between said second gate electrode and said second drain electrode based on said control line drive signal; wherein said second power line is connected to said second electrode, and said pixel display element displays a pixel at a gradation based on said output current of said drive transistor; and wherein said selection transistor is turned on and said control transistor is turned on thereby to write said gradation pixel data from said signal line in said holding capacitor in said pixel data writing step; said selection transistor is turned off and said control transistor is turned on thereby to discharge charges of said gradation pixel data written in said holding capacitor through said drive transistor for a predetermined time in said discharging step; and said control transistor is turned off thereby to float said second gate electrode in said pixel data holding step.

22. A control method for an image display apparatus including a pixel having a drive transistor and a pixel display element which are connected in series between a first power line and a second power line, a holding capacitor connected to a gate electrode of said drive transistor, and a selection transistor connected between a signal line and the gate electrode of said drive transistor, comprising: a pixel data writing step of turning on said selection transistor thereby to write gradation pixel data in said holding capacitor from said signal line; a discharging step of discharging charges of the gradation pixel data written in said holding capacitor through said drive transistor for a predetermined time less than a frame time and after said discharging step, a pixel data holding step of floating the gate electrode of said drive transistor thereby to hold the charges of the gradation pixel data stored in said holding capacitor, wherein said image display apparatus further includes: a display panel having a plurality of signal lines to which corresponding gradation pixel data are applied, a plurality of control lines to which control line drive signals are applied, and a plurality of scanning lines to which scanning signals are applied, said pixel being positioned at each of points of intersection between said signal lines and said scanning lines; a signal line driver for applying said gradation pixel data to said signal lines based on a pixel input signal; a scanning line driver for applying said scanning signals to said scanning lines; and a control line driver for applying said control line drive signals to said control lines; wherein said pixel has a control transistor having a third drain electrode, a third source electrode, and a third gate electrode, and an input drive transistor having a fourth drain electrode, a fourth source electrode, and a fourth gate electrode; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and each pixel display element has a first electrode, a second electrode, and a parasitic capacitor between said first electrode and said second electrode; wherein said first drain electrode/said first source electrode is connected to said signal line, said first source electrode/said first drain electrode is connected to said third drain electrode/said third source electrode, said first gate electrode is connected to said scanning line, and said selection transistor performs on/off control of a conduction state between said signal line and said third drain electrode/said third source electrode based on said scanning signal; wherein said first power line is connected to said second source electrode, said drive transistor passes a first output current controlled based on a voltage held by said holding capacitor from said second drain electrode to said first electrode; wherein said third drain electrode/said third source electrode is connected to said first source electrode/said first drain electrode, said third source electrode/said third drain electrode is connected to said second gate electrode, said third gate electrode is connected to said control line, and said control transistor performs on/off control of a conduction state between said first source electrode/said first drain electrode and said second gate electrode based on said control line drive signal; wherein said first power line is connected to said fourth source electrode, said fourth drain electrode is connected to said first source electrode/said first drain electrode, said fourth gate electrode is connected to said second gate electrode, said input drive transistor passes a second output current controlled based on a voltage between said fourth source electrode and said fourth gate electrode from said fourth source electrode to said fourth drain electrode; wherein said second power line is connected to said second electrode, and said pixel display element displays a pixel at a gradation based on said first output current of said drive transistor; and wherein said selection transistor is turned on and said control transistor is turned on thereby to write said gradation pixel data from said signal line in said holding capacitor in said pixel data writing step; said selection transistor is turned off and said control transistor is turned on thereby to discharge charges of said gradation pixel data written in said holding capacitor through said input drive transistor for a predetermined time in said discharging step; and said control transistor is turned off thereby to float said second gate electrode in said pixel data holding step.

23. An image display apparatus comprising:

a pixel having a drive transistor and a pixel display element which are electrically connected in series between a first power line and a second power line, a holding capacitor electrically connected to a gate electrode of said drive transistor, and a selection transistor electrically connected between a signal line and the gate electrode of said drive transistor; and a controller for turning on said selection transistor thereby to write gradation pixel data in said holding capacitor from said signal line, discharging charges of the gradation pixel data written in said holding capacitor through said drive transistor for a predetermined time less than a frame time, and thereafter floating the gate electrode of said drive transistor thereby to hold the charges of the gradation pixel data stored in said holding capacitor, wherein said display element comprises an organic electroluminescesnce element; and wherein said image display apparatus further includes: a display panel having a plurality of signal lines to which corresponding gradation pixel data are applied, a plurality of control lines to which control line drive signals are applied, and a plurality of scanning lines to which scanning signals are applied, said pixel being positioned at each of points of intersection between said signal lines and said scanning lines; a signal line driver for applying said gradation pixel data to said signal lines based on a pixel input signal; a scanning line driver for applying said scanning signals to said scanning lines; and a control line driver for applying said control line drive signals to said control lines; wherein said pixel has a control transistor having a third drain electrode, a third source electrode, and a third gate electrode, and an input drive transistor having a fourth drain electrode, a fourth source electrode, and a fourth gate electrode; wherein said selection transistor has a first drain electrode, a first source electrode, and a first gate electrode, said drive transistor has a second drain electrode, a second source electrode, and a second gate electrode, said holding capacitor holds a voltage between said second gate electrode and said second source electrode, and each pixel display element has a first electrode, a second electrode, and a parasitic capacitor between said first electrode and said second electrode; wherein said first drain electrode/said first source electrode is connected to said signal line, said first source electrode/said first drain electrode is connected to said third drain electrode/said third source electrode, said first gate electrode is connected to said scanning line, and said selection transistor performs on/off control of a conduction state between said signal line and said third drain electrode/said third source electrode based on said scanning signal; wherein said first power line is connected to said second source electrode, said drive transistor passes a first output current controlled based on a voltage held by said holding capacitor from said second drain electrode to said first electrode; wherein said third drain electrode/said third source electrode is connected to said first source electrode/said first drain electrode and said fourth gate electrode, said third source electrode/said third drain electrode is connected to said second gate electrode, said third gate electrode is connected to said control line, and said control transistor performs on/off control of a conduction state between said first source electrode/said first drain electrode and said second gate electrode based on said control line drive signal; wherein said first power line is connected to said fourth source electrode, said fourth drain electrode is connected to said first source electrode/said first drain electrode, said fourth gate electrode is connected to said fourth drain electrode, said input drive transistor passes a second output current controlled based on a voltage between said fourth source electrode and said fourth gate electrode from said fourth source electrode to said fourth drain electrode; wherein said second power line is connected to said second electrode, and said pixel display element displays a pixel at a gradation based on said first output current of said drive transistor; and wherein said selection transistor is turned on and said control transistor is turned on thereby to write said gradation pixel data from said signal line in said holding capacitor in said pixel data writing step; said selection transistor is turned off and said control transistor is turned on thereby to discharge charges of said gradation pixel data written in said holding capacitor through said input drive transistor for a predetermined time in said discharging step; and said control transistor is turned off thereby to float said second gate electrode in said pixel data holding step.

* * * * *